US010272672B2

(12) United States Patent
Kashimura

(10) Patent No.: US 10,272,672 B2
(45) Date of Patent: Apr. 30, 2019

(54) HEAD UNIT, LIQUID DISCHARGE APPARATUS, AND MANUFACTURING METHOD OF HEAD UNIT

(71) Applicant: SEIKO EPSON CORPORATION, Tokyo (JP)

(72) Inventor: Toru Kashimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/837,135

(22) Filed: Dec. 11, 2017

(65) Prior Publication Data

US 2018/0178511 A1 Jun. 28, 2018

(30) Foreign Application Priority Data

Dec. 22, 2016 (JP) ..... 2016-248691
Sep. 29, 2017 (JP) ..... 2017-191774
Sep. 29, 2017 (JP) ..... 2017-191775
Sep. 29, 2017 (JP) ..... 2017-191776

(51) Int. Cl.
*B41J 2/045* (2006.01)
*B41J 2/14* (2006.01)
*B41J 2/16* (2006.01)

(52) U.S. Cl.
CPC ..... *B41J 2/04541* (2013.01); *B41J 2/04581* (2013.01); *B41J 2/04588* (2013.01);
(Continued)

(58) Field of Classification Search
CPC ..... B41J 2/04541; B41J 2/04581; B41J 2/04588; B41J 2/04593; B41J 2/04596; B41J 2/14233; B41J 2/14201; B41J 2/1607; B41J 2002/14362; B41J 2002/14491; B41J 2/18; B41J 2/20
See application file for complete search history.

(56) References Cited

U.S. PATENT DOCUMENTS

2007/0002102 A1* 1/2007 Kubo ..... B41J 2/14201 347/68
2009/0244201 A1* 10/2009 Saito ..... B41J 2/14233 347/68
(Continued)

FOREIGN PATENT DOCUMENTS

JP 2011-143654 A 7/2011
JP 2013-010228 A 1/2013
(Continued)

*Primary Examiner* — Lamson D Nguyen

(57) ABSTRACT

There is provided a head unit including: a first board; a driving module, and a second board; and a flexible wiring board which connects the first board and the second board to each other, in which the flexible wiring board includes a first wiring layer, a second wiring layer which opposes the first wiring layer, a first output terminal which is connected to a first end of the driving element, a second output terminal which is connected to a second end of the driving element, a first wiring which is connected to the first output terminal, a second wiring which is connected to the second output terminal, and a through-hole which connects the first wiring layer and the second wiring layer, in which the second wiring is provided on the second wiring layer, and in which the second wiring and the second output terminal are connected to each other.

13 Claims, 22 Drawing Sheets

(52) U.S. Cl.
CPC ..... *B41J 2/04593* (2013.01); *B41J 2/04596* (2013.01); *B41J 2/14201* (2013.01); *B41J 2/14233* (2013.01); *B41J 2/1607* (2013.01); *B41J 2002/14362* (2013.01); *B41J 2002/14491* (2013.01); *B41J 2202/18* (2013.01); *B41J 2202/20* (2013.01)

(56) References Cited

U.S. PATENT DOCUMENTS

| | | | | |
|---|---|---|---|---|
| 2011/0175957 | A1 | 7/2011 | Nishizaka | |
| 2016/0114582 | A1 * | 4/2016 | Hagiwara ..... | B41J 2/14233 347/50 |
| 2017/0256032 | A1 | 9/2017 | Nozawa et al. | |

FOREIGN PATENT DOCUMENTS

| | | | |
|---|---|---|---|
| JP | 2016-051103 | A | 4/2016 |
| JP | 2016-063252 | A | 4/2016 |

* cited by examiner

| (SIH, SIL) | T1 | | T2 | |
|---|---|---|---|---|
| | Sa | Sb | Sa | Sb |
| (1, 1) [LARGE DOT] | H | L | H | L |
| (1, 0) [MEDIUM DOT] | H | L | L | H |
| (0, 1) [SMALL DOT] | L | L | L | H |
| (0, 0) [NOT RECORDED] | L | H | L | L |

HEAD UNIT, LIQUID DISCHARGE APPARATUS, AND MANUFACTURING METHOD OF HEAD UNIT

BACKGROUND

1. Technical Field

The present invention relates to a head unit, a liquid discharge apparatus, and a manufacturing method of a head unit.

2. Related Art

As a liquid discharge apparatus, such as an ink jet printer which prints an image or text by discharging ink, an apparatus which uses piezoelectric elements is known. The piezoelectric elements are each provided corresponding to each of a plurality of discharge sections in a head (ink jet head), each of the piezoelectric elements is driven following a driving signal, and accordingly, a predetermined amount of ink (liquid) is discharged at a predetermined timing from a nozzle of the discharge section, and dots are formed. JP-A-2013-10228 discloses an ink jet head provided with a wiring that transfers a driving signal to a piezoelectric element via a flexible print circuit board (FPC).

In recent years, in an ink jet head (head unit), the number of nozzles (the number of driving elements, such as piezoelectric elements) that are driven at the same time has increased due to an increase in density of the nozzles, and accordingly, an electric current that flows through a driving signal transfer wiring provided on a wiring board, such as an FPC, has also increased. Meanwhile, when the number of driving modules including multiple driving elements that are electrically connected to the driving signal transfer wiring of one wiring board increases, in order to avoid an increase in size of the ink jet head, it is necessary to reduce the size of each of the driving modules, and the size of the wiring board connected to the driving module becomes extremely small. Therefore, while the electric current that flows through the driving signal transfer wiring increases, a wiring impedance increases without sufficiently ensuring a wiring area of the wiring board, and as a result, there is a possibility that transfer accuracy of the driving signal deteriorates and discharge accuracy of liquid deteriorates. In addition, since the wiring impedance increases, heat generation of the wiring board becomes large, and as a result, there is a concern that the temperature of the wiring board increases and the wiring board is damaged. Furthermore, as the heat is transmitted to the driving module from the wiring board, the temperature of the liquid discharged from the nozzle becomes higher as the nozzle becomes closer to the wiring board, and deviation of the temperature of the ink is likely to be generated between the nozzles. Then, since viscosity of the ink changes according to the temperature, there is a possibility that a difference in viscosity of the ink between the nozzles increases, a difference in amount of ink discharged from each of the nozzles increases, and discharge accuracy deteriorates. Specifically, in the ink jet head provided with the driving module including 600 or more driving elements which are aligned at a density of 300 or more driving elements per one inch, the number of driving elements which are driven at the same time increases, a large electric current is likely to flow, and thus, such a problem becomes more serious.

Furthermore, when the size of the wiring board connected to the driving module decreases, there is a problem that it becomes difficult to manufacture the ink jet head. Specifically, in the ink jet head provided with the driving module including 600 or more driving elements which are aligned at a density of 300 or more driving elements per one inch, a pitch of a connection terminal of the wiring board becomes extremely small, and thus a connection failure may occur when a connection position between the wiring board and the driving module is shifted by several μm, thereby making it more difficult to manufacture the ink jet head.

SUMMARY

An advantage of some aspects of the invention is to provide a head unit which can reduce a concern about deterioration of a driving signal on a wiring board connected to a driving module including multiple driving elements of which the density is high, and can discharge liquid with high accuracy, and a liquid discharge apparatus provided with the head unit.

Another advantage of some aspects of the invention is to provide a head unit which can reduce a heat generation amount of a wiring board connected to a driving module including multiple driving elements of which the density is high, and a liquid discharge apparatus provided with the head unit.

Still another advantage of some aspects of the invention is to provide a head unit which can avoid a difficulty of manufacturing while a wiring board connected to a driving module including multiple driving elements of which the density is high is provided, a liquid discharge apparatus provided with the head unit, and a manufacturing method of a head unit.

The invention can be realized in the following application examples.

APPLICATION EXAMPLE 1

According to this application example, there is provided a head unit including a first board; a driving module including 600 or more driving elements which are aligned at a density of 300 or more driving elements per one inch, and a second board; and a flexible wiring board which connects the first board and the second board to each other, in which the flexible wiring board includes a first wiring layer, a second wiring layer which opposes the first wiring layer, a first output terminal which is electrically connected to a first end of the driving element, a second output terminal which is electrically connected to a second end of the driving element, a first wiring which is electrically connected to the first output terminal, a second wiring which is electrically connected to the second output terminal, and a through-hole which electrically connects the first wiring layer and the second wiring layer to each other, in which the second wiring is provided on the second wiring layer, and in which the second wiring and the second output terminal are electrically connected to each other via the through-hole.

The driving element may be, for example, a piezoelectric element, or may be a heating element. In addition, the flexible wiring board may be a single layer board, or may be a multiple layer board.

The "driving module including 600 or more driving elements which are aligned at a density of 300 or more driving elements per one inch" may be a driving module including a plurality of driving element rows in which 300 or more driving elements are aligned at a density of 300 or more driving elements per one inch, or may be a driving module including only one driving element row in which 600 or more driving elements are aligned at a density of 300 or more driving elements per one inch.

The first wiring is any one of a reference voltage signal transfer wiring which transfers the reference voltage signal and a driving signal transfer wiring which transfers a driving signal, and the second wiring may be any one of the reference voltage signal transfer wiring and the driving signal transfer wiring.

The "through-hole" is a structure including an opening portion (hole) which penetrates between the first wiring layer and the second wiring layer of the flexible wiring board, and a conductor which is provided on an inner surface thereof and electrically connects the first wiring layer and the second wiring layer to each other, and is also called "via".

In the head unit according to the application example, since the driving module includes multiple driving elements of which the density is high, the number of driving elements which are driven at the same time increases, and on the flexible wiring board connected to the driving module, an electric current that flows through a first wiring which is electrically connected to a first end of the driving element via a first output terminal, or an electric current that flows through a second wiring which is electrically connected to a second end of the driving element via a second output terminal, are likely to increase. Meanwhile, in the head unit according to the application example, the flexible wiring board includes the first wiring layer and the second wiring layer, and as the second wiring is provided on the second wiring layer and the first wiring is provided on the first wiring layer, or as the first wiring is also provided on the second wiring layer when there is a sufficiently empty region on the second wiring layer, areas of each of the first wiring and the second wiring are sufficiently ensured. Therefore, in the head unit according to the application example, the wiring impedance of the first wiring or the second wiring which transfers the driving signal that drives the driving element is reduced, and it is possible to reduce a concern that the driving signal deteriorates on the flexible wiring board, and thus, it is possible to discharge liquid with high accuracy.

Furthermore, in the head unit according to the application example, since the flexible wiring board includes a first wiring layer and the second wiring layer, the size decreases while a large wiring region is ensured, and thus, it is possible to correspond to a decrease in size of the driving module. Therefore, it is possible to realize a small size of the head unit according to the application example.

APPLICATION EXAMPLE 2

In the head unit according to the application example, the flexible wiring board may further include a first input terminal which is electrically connected to the first wiring, and a second input terminal which is electrically connected to the second wiring, the first output terminal and the second output terminal may be provided along a first side of the flexible wiring board, and the first input terminal and the second input terminal may be provided along a second side different from the first side of the flexible wiring board.

In the head unit according to the application example, on the flexible wiring board, the first input terminal and the second input terminal, and the first output terminal and the second output terminal are provided along sides different from each other, and thus, the first wiring and the second wiring are effectively disposed. Therefore, in the head unit according to the application example, the wiring impedance of each of the first wiring and the second wiring is reduced, it is possible to reduce a concern that the driving signal deteriorates on the flexible wiring board, and thus, it is possible to discharge liquid with high accuracy.

APPLICATION EXAMPLE 3

In the head unit according to the application example, the flexible wiring board may further include a control signal input terminal into which a control signal that controls discharge of liquid is input, a control signal transfer wiring which is electrically connected to the control signal input terminal, and transfers the control signal, and a control signal output terminal which is electrically connected to the control signal transfer wiring, and outputs the control signal to the driving module, and the control signal transfer wiring may be provided in a region that does not oppose a region in which the second wiring is provided, on the first wiring layer of the flexible wiring board.

In the head unit according to the application example, on the flexible wiring board, the control signal transfer wiring and the second wiring do not oppose each other, and thus, it is possible to reduce influence of noise radiated from the second wiring on the control signal. Therefore, in the head unit according to the application example, on the flexible wiring board, it is possible to reduce a concern that transfer accuracy of the control signal deteriorates, and thus, it is possible to discharge liquid with high accuracy.

APPLICATION EXAMPLE 4

In the head unit according to the application example, the flexible wiring board may further include a power source voltage signal input terminal into which a power source voltage signal is input, a power source voltage signal transfer wiring which is electrically connected to the power source voltage signal input terminal, and transfers the power source voltage signal, and a power source voltage signal output terminal which is electrically connected to the power source voltage signal transfer wiring, and outputs the power source voltage signal to the driving module, the power source voltage signal transfer wiring may be provided on the second wiring layer of the flexible wiring board, and the control signal transfer wiring may be provided in a region which opposes a region in which the power source voltage signal transfer wiring is provided.

In the head unit according to the application example, on the flexible wiring board, the control signal transfer wiring and the power source voltage signal transfer wiring oppose each other, and thus, the control signal is guarded by the power source voltage signal transfer wiring. Therefore, in the head unit according to the application example, on the flexible wiring board, it is possible to reduce a concern that transfer accuracy of the control signal deteriorates, and thus, it is possible to discharge liquid with high accuracy.

APPLICATION EXAMPLE 5

In the head unit according to the application example, the first wiring may be provided on the first wiring layer, and the first wiring may oppose the second wiring.

In the head unit according to the application example, an electric current path in which the electric current flows in an order of the second wiring, the driving element, and the first wiring, or in an order of the first wiring, the driving element, and the second wiring, exists, but on the flexible wiring board, the first wiring and the second wiring are provided to oppose each other on the two wiring layers different from each other, and thus, the electric current path becomes short. Therefore, in the head unit according to the application example, it is possible to reduce an impedance of the electric current path for driving the driving element, and thus, it is possible to discharge liquid with high accuracy.

APPLICATION EXAMPLE 6

In the head unit according to the application example, the flexible wiring board may have a plurality of second wirings, each of which is the second wiring. The first wiring may be a reference voltage signal transfer wiring which transfers a reference voltage signal, and the plurality of the second wirings may include a first driving signal transfer wiring that transfers a first driving signal, and a second driving signal transfer wiring that transfers a second driving signal.

In the head unit according to the application example, as the first driving signal transfer wiring and the second driving signal transfer wiring are provided on the second wiring layer, and the reference voltage signal transfer wiring is provided on the first wiring layer, or as the reference voltage signal transfer wiring is also provided on the second wiring layer when there is a sufficient empty region on the second wiring layer, areas of each of the first driving signal transfer wiring, the second driving signal transfer wiring, and the reference voltage signal transfer wiring is sufficiently ensured. Therefore, in the head unit according to the application example, the wiring impedance of each of the first driving signal transfer wiring and the second driving signal transfer wiring is reduced, it is possible to reduce a concern that the first driving signal and the second driving signal deteriorate on the flexible wiring board, and thus, it is possible to discharge liquid with high accuracy.

APPLICATION EXAMPLE 7

In the head unit according to the application example, an amplitude of the first driving signal may be greater than that of the second driving signal, and on the second wiring layer, the first driving signal transfer wiring may be provided closer to an end side of the flexible wiring board than the second driving signal transfer wiring.

In the head unit according to the application example, on the flexible wiring board, the first driving signal transfer wiring which transfers the first driving signal having a large amplitude is provided on the end side, and thus, the wiring which transfers various signals is provided in the region separated from the first driving signal transfer wiring. Therefore, in the head unit according to the application example, on the flexible wiring board, it is possible to reduce influence of large noise radiated from the first driving signal transfer wiring on various signals, and thus, it is possible to discharge liquid with high accuracy.

APPLICATION EXAMPLE 8

In the head unit according to the application example, the width of the first driving signal transfer wiring may be different from the width of the second driving signal transfer wiring.

In the head unit according to the application example, on the flexible wiring board, the first driving signal transfer wiring having an appropriate width that corresponds to the amplitude of the first driving signal and the second driving signal transfer wiring having an appropriate width that corresponds to the amplitude of the second driving signal, and thus, it is possible to set the wiring impedance of each of the first driving signal transfer wiring and the second driving signal transfer wiring to be an appropriate value. Therefore, in the head unit according to the application example, it is possible to reduce a concern that the transfer accuracy of the first driving signal and the second driving signal deteriorates, and thus, it is possible to discharge liquid with high accuracy.

APPLICATION EXAMPLE 9

In the head unit according to the application example, an amplitude of the first driving signal may be greater than that of the second driving signal, and the width of the first driving signal transfer wiring may be greater than the width of the second driving signal transfer wiring.

In the head unit according to the application example, on the flexible wiring board, the width of the first driving signal transfer wiring that transfers the first driving signal having an amplitude greater than that of the second driving signal, is greater than the width of the second driving signal transfer wiring that transfers the second driving signal, and thus, it is possible to further reduce the wiring impedance of the first driving signal transfer wiring. Therefore, in the head unit according to the application example, it is possible to reduce a concern that the transfer accuracy of the first driving signal and the second driving signal deteriorates, and thus, it is possible to discharge liquid with high accuracy.

APPLICATION EXAMPLE 10

In the head unit according to the application example, the flexible wiring board may further include a power source voltage signal transfer wiring that transfers a power source voltage signal or a ground voltage signal transfer wiring that transfers a ground voltage signal, and on the second wiring layer, the second wiring may be provided closer to an end side of the flexible wiring board than the power source voltage signal transfer wiring or the ground voltage signal transfer wiring.

In the head unit according to the application example, on the flexible wiring board, the second wiring through which a large electric current flows is provided closer to the end side than the power source voltage signal transfer wiring or the ground voltage signal transfer wiring, and thus, various signals are guarded against the noise radiated from the second wiring by the power source voltage signal transfer wiring or the ground voltage signal transfer wiring. Therefore, in the head unit according to the application example, on the flexible wiring board, it is possible to reduce influence of large noise radiated from the second wiring on the various signals, and thus, it is possible to discharge liquid with high accuracy.

APPLICATION EXAMPLE 11

In the head unit according to the application example, both of the first driving signal transfer wiring and the second driving signal transfer wiring may be provided on the second wiring layer, and the reference voltage signal transfer wiring may be provided on the first wiring layer, and may oppose both of the first driving signal transfer wiring and the second driving signal transfer wiring.

In the head unit according to the application example, the electric current path through which the electric current flows in an order of the first driving signal transfer wiring or the second driving signal transfer wiring, the driving element, and the reference voltage signal transfer wiring, or in a reverse order, exists, but on the flexible wiring board, the first driving signal transfer wiring and the second driving signal transfer wiring, and the reference voltage signal transfer wiring are provided to oppose each other on the two wiring layers different from each other, and thus, each of the electric current paths becomes short. Therefore, in the head unit according to the application example, it is possible to reduce the impedance of each of the electric current paths for driving the driving element, and thus, it is possible to discharge liquid with high accuracy.

APPLICATION EXAMPLE 12

In the head unit according to the application example, the first wiring may be provided on the first wiring layer, and the second wiring may be thicker than the first wiring.

In the head unit according to the application example, since the second wiring is thicker than the first wiring, the impedance value per unit area becomes smaller than that of the first wiring, and a heat generation amount caused by the electric current that flows through the second wiring is more efficiently reduced. Therefore, in the head unit according to the application example, it is possible to reduce the heat generation amount of the wiring board, and thus, the wiring board is unlikely to be damaged, and it is possible to discharge liquid with high accuracy.

APPLICATION EXAMPLE 13

According to this application example, there is provided a liquid discharge apparatus including a first board; a driving module including 600 or more driving elements which are aligned at a density of 300 or more driving elements per one inch, and a second board; and a flexible wiring board which connects the first board and the second board to each other, in which the flexible wiring board includes a first wiring layer, a second wiring layer which opposes the first wiring layer, a first output terminal which is electrically connected to a first end of the driving element, a second output terminal which is electrically connected to a second end of the driving element, a first wiring which is electrically connected to the first output terminal, a second wiring which is electrically connected to the second output terminal, and a through-hole which electrically connects the first wiring layer and the second wiring layer to each other, in which the second wiring is provided on the second wiring layer, and in which the second wiring and the second output terminal are electrically connected to each other via the through-hole.

In the liquid discharge apparatus according to the application example, since the driving module includes multiple driving elements of which the density is high, the number of driving elements which are driven at the same time increases, and on the flexible wiring board connected to the driving module, the electric current that flows through the first wiring which is electrically connected to the first end of the driving element via the first output terminal, or the electric current that flows through the second wiring which is electrically connected to the second end of the driving element via the second output terminal are likely to increase. Meanwhile, in the liquid discharge apparatus according to the application example, as the flexible wiring board includes the first wiring layer and the second wiring layer, the second wiring is provided on the second wiring layer, and the first wiring is provided on the first wiring layer, or as the first wiring is also provided on the second wiring layer when there is a sufficient empty region on the second wiring layer, areas of each of the first wiring and the second wiring is sufficiently ensured. Therefore, in the liquid discharge apparatus according to the application example, the wiring impedance of the first wiring or the second wiring which transfers the driving signal that drives the driving element is reduced, it is possible to reduce a concern that the driving signal deteriorates on the flexible wiring board, and thus, it is possible to discharge liquid with high accuracy.

Furthermore, in the liquid discharge apparatus according to the application example, since the flexible wiring board includes the first wiring layer and the second wiring layer, the size decreases while a large wiring region is ensured, and thus, it is possible to correspond to a decrease in size of the driving module.

APPLICATION EXAMPLE 14

According to this application example, there is provided a manufacturing method of a head unit including a first board, a driving module including 600 or more driving elements which are aligned at a density of 300 or more driving elements per one inch, and a second board, and a flexible wiring board, in which the flexible wiring board includes a first wiring layer, a second wiring layer which opposes the first wiring layer, a first output terminal which is provided on the first wiring layer, and is electrically connected to a first end of the driving element, a second output terminal which is provided on the first wiring layer, and is electrically connected to a second end of the driving element, a first wiring which is electrically connected to the first output terminal, a second wiring which is provided on the second wiring layer, and is electrically connected to the second output terminal, a first input terminal which is electrically connected to the first wiring, a second input terminal which is electrically connected to the second wiring, and a through-hole which electrically connects the first wiring layer and the second wiring layer to each other, and in which the second wiring and the second output terminal are electrically connected to each other via the through-hole, the method including: connecting the first output terminal and the second output terminal to the second board in a second region of the first wiring layer; connecting the first input terminal and the second input terminal to the first board in a first region of the first wiring layer.

In the manufacturing method of a head unit according to the application example, on the flexible wiring board, as the second wiring provided on the second wiring layer is electrically connected to the second output terminal via the through-hole, both of the first output terminal and the second output terminal can be disposed on the first wiring layer, and the first output terminal and the second output terminal can be relatively easily connected to the second board of the driving module in the second region. Furthermore, on the flexible wiring board, as both of the first input terminal and the second input terminal are provided on the first wiring layer similar to the first output terminal and the second output terminal, in a state where the first output terminal and the second output terminal are connected to the second board of the driving module, when the first input terminal and the second input terminal are connected to the first board in the first region, it is possible to relatively easily adjust the connection position. Therefore, in the manufacturing method of the head unit according to the application example, it is possible to avoid a case where the manufacturing becomes difficult while providing the wiring board connected to the driving module including multiple driving elements of which the density is high.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, appropriate embodiments of the invention will be described in detail by using the drawings. The drawings to be used are for convenience of description. In addition, the embodiments which will be described hereinafter do not unjustly limit the contents of the invention described in the range of the claims. In addition, an overall configuration which will be described hereinafter is not necessary configuration requirement of the invention.

1. Outline of Liquid Discharge Apparatus

A printing apparatus which is an example of a liquid discharge apparatus according to the embodiment is an ink jet printer which forms an ink dot group on a printing medium, such as a paper sheet, and accordingly, prints an image (including letters or figures) which corresponds to image data, by discharging ink (liquid) in accordance with the image data supplied from a host computer on the outside.

Figure 1:
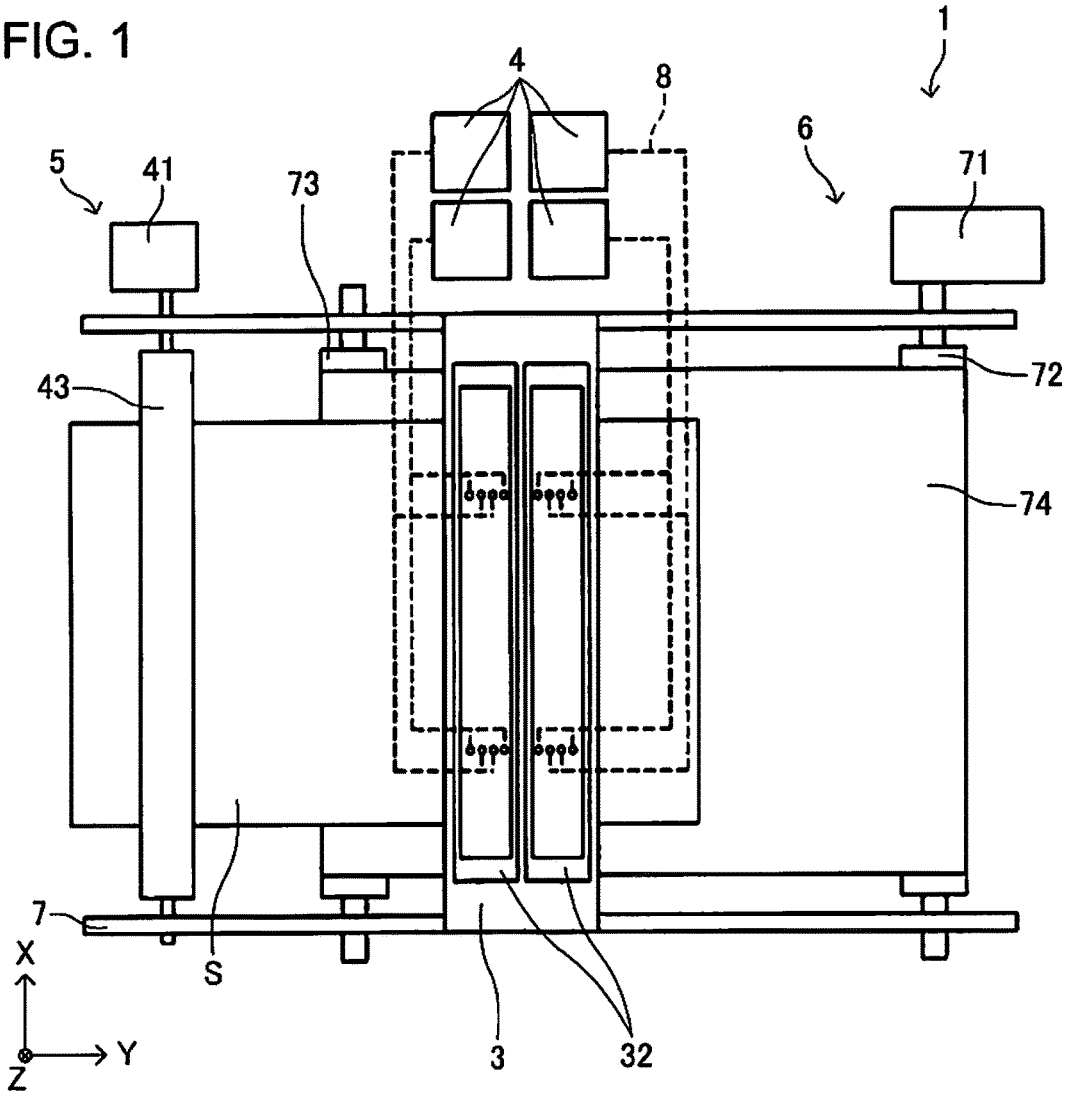
FIG. 1 is a plan view illustrating a schematic configuration of a liquid discharge apparatus.
Figure 2:
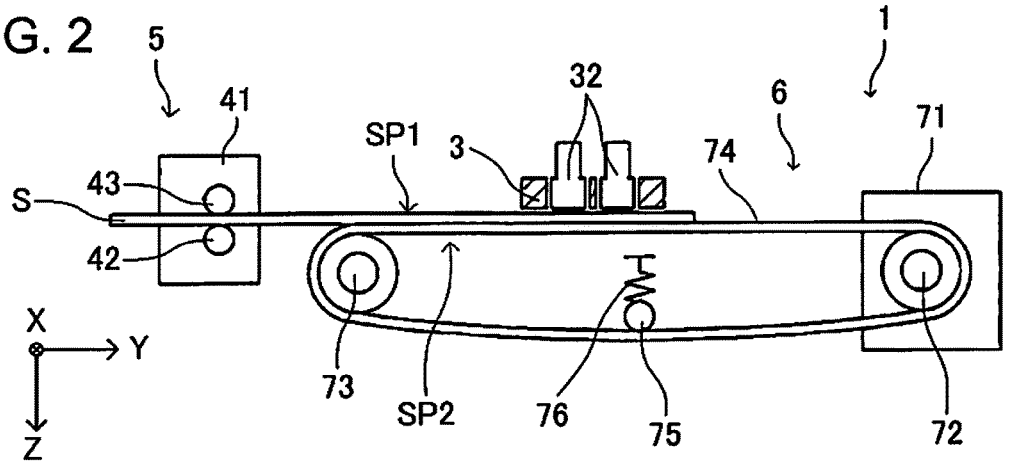
FIG. 2 is a side view illustrating a schematic configuration of the liquid discharge apparatus.

FIG. 1 is a plan view schematically illustrating a liquid discharge apparatus 1. FIG. 2 is a side view of the liquid discharge apparatus 1. Here, a width direction (an upward direction from a lower part of a paper surface in FIG. 1) of the liquid discharge apparatus 1 is referred to as "first direction X". In addition, a direction toward a second transport roller 72 from a first driven roller 43 is referred to as "second direction Y". In addition, a height direction (paper surface perpendicular direction in FIG. 1) of the liquid discharge apparatus 1 which intersects with both of the first direction X and the second direction Y, is referred to as "third direction Z". In addition, in the embodiment, the first direction X, the second direction Y, and the third direction Z are orthogonal to each other, but dispositions of each of the configurations are not necessarily limited to a case where the directions are orthogonal to each other.

The liquid discharge apparatus 1 of the embodiment is a line head type ink jet printer which performs printing only by transporting a recording sheet S which is an ejecting medium.

The liquid discharge apparatus 1 includes a plurality of head units 32 (ink jet head), a base 3 on which the head unit 32 is loaded, a liquid storage unit 4, such as an ink tank or the like in which the ink is stored, a first transport unit 5, a second transport unit 6, and an apparatus main body 7.

Figure 3:
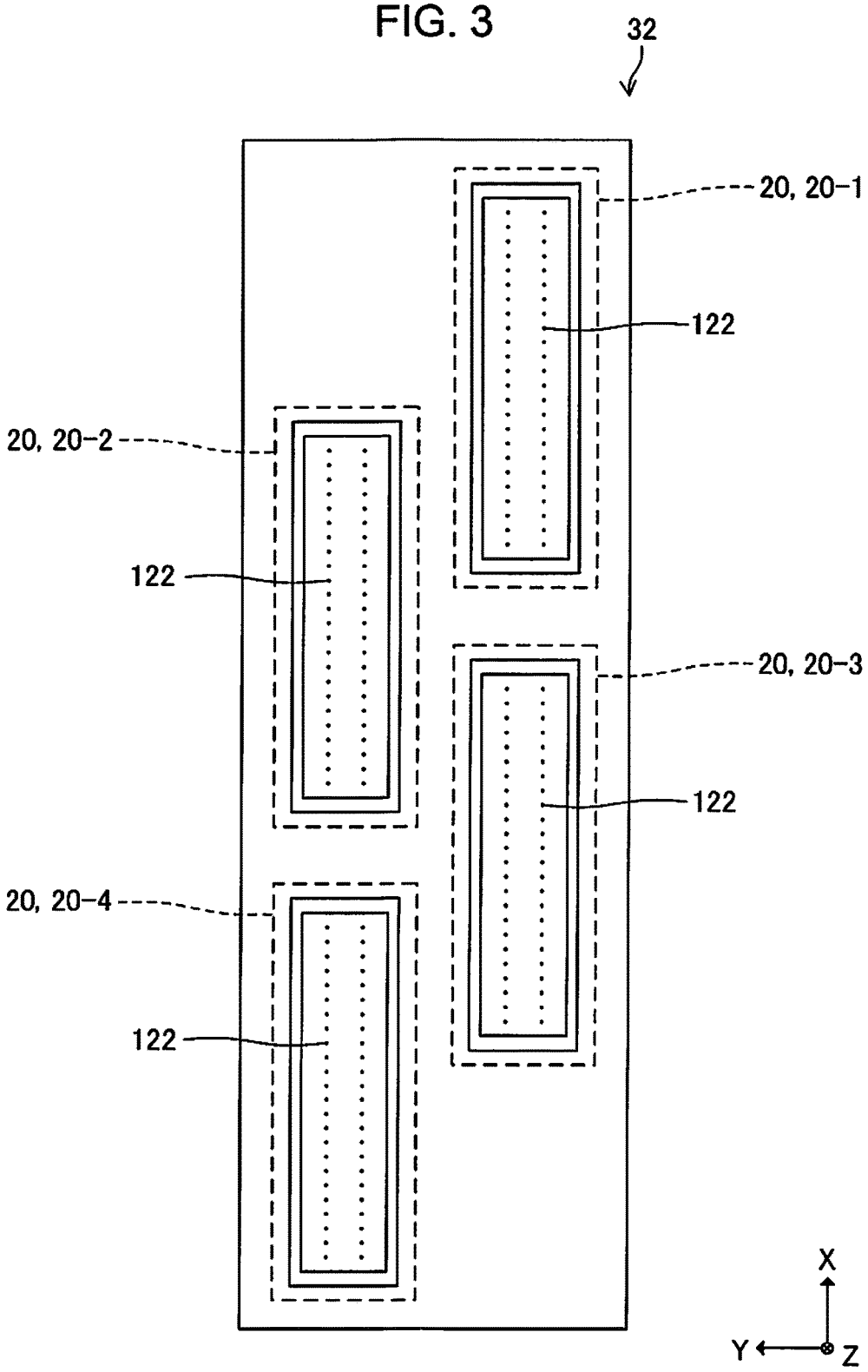
FIG. 3 is a plan view illustrating a nozzle surface of a head unit.

In the head unit 32, as illustrated in FIG. 3, a plurality of driving modules 20 (20-1 to 20-4) are aligned in the width direction (first direction X) of the recording sheet S which intersects with a transport direction of the recording sheet S. In addition, on a surface (third direction Z) which opposes the recording sheet S in each of the driving modules 20, multiple nozzles 122 which discharge the ink provided in the driving module 20 are aligned with a predetermined interval in the first direction X. In addition, as will be described later, one piezoelectric element 60 (refer to FIG. 4) which is a driving element for discharging the liquid is provided for each of the nozzles 122. In particular, in the embodiment, the driving module 20 includes 600 or more nozzles 122 (piezoelectric elements 60) which are aligned at a density of 300 or more nozzles per one inch. For example, the driving module 20 may include a plurality of nozzle rows (two rows in FIG. 3), 300 or more nozzles 122 (piezoelectric elements 60) may be provided in each of the nozzle rows, and the driving module 20 may include only one nozzle row provided with 600 or more nozzles 122 (piezoelectric elements 60). In addition, in FIG. 3, positions of the driving module 20 and the nozzle 122 when the head unit 32 is viewed from the third direction Z are virtually illustrated. At least parts of the positions of the nozzles 122 of end portions of the driving modules 20 (for example, the driving module 20-1 and the driving module 20-2) adjacent to each other in the second direction Y, overlap each other. In addition, the nozzles 122 are aligned with a predetermined interval in the first direction X by the width or more in the first direction X of the recording sheet S. In other words, as the head unit 32 discharges the ink from the nozzle 122 toward the recording sheet S transported without stopping below the head unit 32, the liquid discharge apparatus 1 performs the printing on the recording sheet S.

In addition, in FIG. 3, considering the condition of the paper surface, a case where the number of driving modules 20 included in the head unit 32 is four (driving modules 20-1 to 20-4) is illustrated, but the number is not limited thereto. In other words, the number of driving modules 20 may be greater than four, or may be less than four. In addition, the driving module 20 of FIG. 3 is disposed in a zigzag shape, but the disposition is not limited thereto.

Returning to FIGS. 1 and 2, the base 3 holds two head units 32 installed in the second direction Y.

The liquid storage unit 4 supplies the ink to the head unit 32. In the embodiment, the liquid storage unit 4 is fixed to the apparatus main body 7, and supplies the ink to the head unit 32 via a supply pipe 8, such as a tube, from the liquid storage unit 4.

The first transport unit 5 is provided on one side in the second direction Y of the head unit 32. The first transport unit 5 includes a first transport roller 42, and a first driven roller 43 driven by the first transport roller 42. The first transport roller 42 is provided on a rear surface SP2 side on a side opposite to a landing surface SP1 on which the ink lands on the recording sheet S, and is driven by a driving force of a first driving motor 41. In addition, the first driven roller 43 is provided on the landing surface SP1 side of the recording sheet S, and nips the recording sheet S between the first driven roller 43 and the first transport roller 42. The first driven roller 43 presses the recording sheet S to the first transport roller 42 side by a biasing member, such as a spring or the like which is not illustrated.

The second transport unit 6 includes a second driving motor 71, a second transport roller 72, a second driven roller 73, a transport belt 74, and a tension roller 75.

The second transport roller 72 is driven by the driving force of the second driving motor 71. The transport belt 74 is configured of an endless belt, and is hooked to an outer circumference of the second transport roller 72 and the second driven roller 73. The transport belt 74 is provided on the rear surface SP2 side of the recording sheet S. The tension roller 75 is provided between the second transport roller 72 and the second driven roller 73, abuts against an inner circumferential surface of the transport belt 74, and imparts tension to the transport belt 74 by the biasing force of the 76, such as a spring. Accordingly, in the transport belt 74, a surface which opposes the head unit 32 between the second transport roller 72 and the second driven roller 73 is flat.

In other words, in the liquid discharge apparatus 1 of the embodiment, the recording sheet S is transported in the second direction Y by the first transport unit 5 and the second transport unit 6. In addition, by ejecting the ink from the head unit 32 and by allowing the ejected ink to land on the landing surface SP1 of the recording sheet S, the printing is performed.

In addition, in the embodiment, as the liquid discharge apparatus 1, a line head type ink jet printer in which the head unit 32 is fixed to the apparatus main body 7, and which performs the printing only by transporting the recording sheet S, is illustrated as an example. However, the embodiment of the liquid discharge apparatus 1 is not limited to the line head type. For example, the liquid discharge apparatus 1 may be a serial type ink jet printer which loads the head unit 32 on a carriage that moves in the first direction X which intersects with the second direction Y that is the transport direction of the recording sheet S, and performs the printing while moving the head unit 32 in the first direction X.

2. Electric Configuration of Liquid Discharge Apparatus

Figure 4:
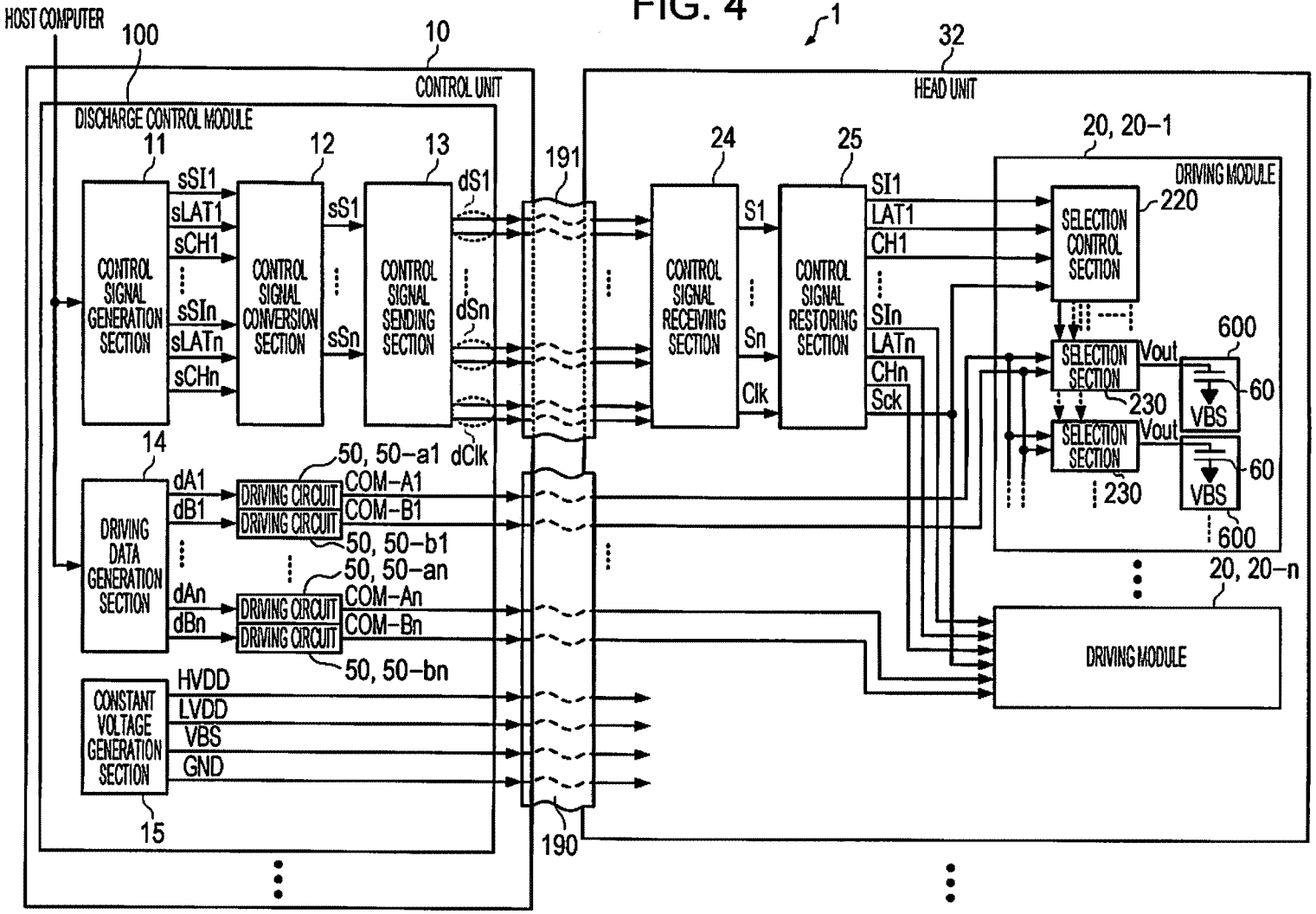
FIG. 4 is a block diagram illustrating an electric configuration of the liquid discharge apparatus.

FIG. 4 is block diagram illustrating an electric configuration of the liquid discharge apparatus 1 of the embodiment. As illustrated in FIG. 4, the liquid discharge apparatus 1 includes the N head units 32 (refer to FIGS. 1 and 2), a control unit 10 which controls discharge of the liquid from each of the head units 32, and N flexible flat cables 190 and N flexible flat cables 191 which connect the control unit 10 and each of the head units 32 to each other.

The control unit 10 includes N discharge control modules 100. N discharge control modules 100 respectively include a control signal generation section 11, a control signal conversion section 12, a control signal sending section 13, a driving data generation section 14, and a constant voltage generation section 15.

The control signal generation section 11 outputs various control signals or the like for controlling each of the portions when various signals of image data or the like are supplied from the host computer.

Specifically, the control signal generation section 11 generates n (n≥1) original printing data signals sSI1 to sSIn, n original latch signals sLAT1 to sLATn, and n original change signal sCH1 to sCHn, as a plurality of types of original control signals which control the discharge of the liquid from a discharge section 600 based on various signals from the host computer, and outputs the signals to a control signal conversion section 12 in a parallel format. In addition, in the plurality of types of original control signals, a part of the signals may be included, or other signals may be included.

The control signal conversion section 12 converts (serializes) an original printing data signal sSIi (i is any number among 1 to n), the original latch signal sLATi, and the original change signal sCHi which are output from the control signal generation section 11 respectively into one serial type original serial control signal sSi, and outputs the signal to the control signal sending section 13.

The control signal sending section 13 converts n original serial control signals sS1 to sSn output from the control signal conversion section 12 respectively into differential signals dS1 to dSn configured of two signals, and sends the differential signals dS1 to dSn to the head unit 32 via the flexible flat cable 191. In addition, the control signal sending section 13 generates a differential clock signal dClk to be used in high-speed serial data transfer of the differential signals dS1 to dSn via the flexible flat cable 191, and sends the differential clock signal dClk to the head unit 32 via the flexible flat cable 191. For example, the control signal sending section 13 generates low voltage differential signaling (LVDS) transfer type differential signals dS1 to dSn and the differential clock signals dClk, and sends the signals to the head unit 32. The LVDS transfer type differential signal can realize the high-speed data transfer since an amplitude thereof is approximately 350 mV. In addition, the control signal sending section 13 may generate various high-speed transfer types (for example, low voltage positive emitter coupled logic (LVPECL) or current mode logic (CML) other than the LVDS) of differential signals dS1 to dSn and the differential clock signal dClk, and may send the signals to the head unit 32.

Based on the various signals from the host computer, the driving data generation section 14 generates 2n pieces of driving data dA1 to dAn and dB1 to dBn which are digital data that serves as an original of the driving signal that drives the n driving modules 20 (20-1 to **20-*n*) included in the head unit 32, and sends the signals to the head unit 32 via the flexible flat cable 190. In the embodiment, the driving data dA1 to dAn and dB1 to dBn are digital data obtained by analogue/digital-converting a waveform (driving waveform) of the driving signals. However, the driving data dA1 to dAn and dB1** to dBn may be digital data which indicates a difference with respect to recent driving data, or may be digital data which regulates correspondence of the length of each section of which inclination is constant in the driving waveform and each of the inclinations.

n driving circuits **50-*a*1 to 50-*an* respectively generate driving signals COM-A1 to COM-An which drive each of the driving modules 20-1 to 20-*n* provided in the head unit 32 based on the driving data dA1 to dAn output from the driving data generation section 14. Similarly, n driving circuits 50-*b*1 to 50-*bn* respectively generate driving signals COM-B1 to COM-Bn which drive each of the driving modules 20-1 to 20-*n* based on the driving data dB1 to dBn output from the driving data generation section 14. For example, the driving circuits 50-*a*1 to 50-*an* and 50-*b*1 to 50-*bn* may respectively generate the driving signals COM-A1 to COM-An and COM-B1 to COM-Bn by performing D-class amplification after digital/analogue-converting the driving data dA1 to dAn and dB1 to dBn. In addition, the 2n driving circuits 50 (50-*a*1 to 50-*an* and 50-*b*1 to 50-*bn***) may have the same circuit configuration except that the input driving data and the output driving signal are different.

The constant voltage generation section 15 generates a high power source voltage signal HVDD having a constant voltage (for example, 42 V), a low power source voltage signal LVDD having a constant voltage (for example, 3.3 V), a reference voltage signal VBS having a constant voltage (for example, 6 V), and a ground voltage signal GND having a ground voltage (0 V). In addition, the control signal generation section 11, the control signal conversion section 12, the control signal sending section 13, and the driving data generation section 14 are operated as the low power source voltage signal LVDD and the ground voltage signal GND are supplied. In addition, the driving circuits **50-*a*1 to 50-*an* are operated as the high power source voltage signal HVDD, the low power source voltage signal LVDD, the reference voltage signal VBS, and the ground voltage signal GND are supplied. The high power source voltage signal HVDD, the low power source voltage signal LVDD, the reference voltage signal VBS, and the ground voltage signal GND are transferred to the head unit 32 via the flexible flat cable 190**.

In addition, in addition to the above-described processing, the control unit 10 performs processing for driving the first driving motor 41 or the second driving motor 71. Accordingly, the recording sheet S is transported in the predetermined direction.

The head unit 32 includes the n driving modules 20 (20-1 to **20-*n*), a control signal receiving section 24, and a control signal restoring section 25. The control signal receiving section 24 and the control signal restoring section 25** are operated as the low power source voltage signal LVDD and the ground voltage signal GND are supplied.

The control signal receiving section 24 receives the LVDS transfer type differential signals dS1 to dSn sent from the control signal sending section 13, converts the received differential signals dS1 to dSn respectively into serial control signals S1 to Sn by differential amplification, and outputs the converted serial control signals S1 to Sn to the control signal restoring section 25. In addition, the control signal receiving section 24 receives the LVDS transfer type differential clock signal dClk sent from the control signal sending section 13, converts the received differential clock signal dClk into a clock signal Clk by the differential amplification, and outputs the converted clock signal Clk to the control signal restoring section 25. In addition, the control signal receiving section 24 may receive various high-speed transfer types (for example, LVPECL or CML other than LVDS) of differential signals dS1 to dSn and the differential clock signal dClk.

The control signal restoring section 25 generates a clock signal Sck, n printing data signals SI1 to SIn, n latch signals LAT1 to LATn, and n change signals CH1 to CHn, as the plurality of types of control signals which control the discharge of the liquid from the discharge section 600, based on the serial control signals S1 to Sn converted by the control signal receiving section 24. Specifically, by restoring (deserializing) the original printing data signal sSIi, the original latch signal sLATi, and the original change signal sCHi which are included in a serial control signal Si (i is any number among 1 to n) output from the control signal receiving section 24, the control signal restoring section 25 generates a printing data signal SIi, a latch signal LATi, and a change signal CHi, and outputs the signals to a driving module **20-*i*. In addition, the control signal restoring section 25 performs predetermined processing (for example, dividing processing at a predetermined division ratio) to the clock signal Clk output from the control signal receiving section 24, generates the clock signal Sck synchronized with the printing data signals SI1 to SIn, the latch signals LAT1 to LATn, and the change signals CH1 to CHn, and outputs n driving modules 20 (20-1 to 20-*n***).

The n driving modules 20 (20-1 to **20-*n*) have the same configuration, and respectively include a selection control sections 220, m selection sections 230, and m discharge sections 600. In the embodiment, m is an integer which is equal to or greater than 600. The selection control section 220 is operated as the low power source voltage signal LVDD and the ground voltage signal GND are supplied. In addition, the selection section 230** is operated as the high power source voltage signal HVDD and the ground voltage signal GND are supplied.

In the driving modules **20-*i* (i is any number among 1 to n), the selection control section 220 instructs each of the selection sections 230 that which one of driving signals COM-Ai and COM-Bi is supposed to be selected (or which one is supposed not to be selected), by the clock signal Sck, the printing data signal SIi, the latch signal LATi, and the change signal Chi which are output from the control signal restoring section 25**.

Each of the selection sections 230 selects the driving signals COM-Ai to COM-Bi in accordance with the instruction of the selection control section 220, outputs the signals to the corresponding discharge section 600 as a driving signal Vout, and applies the driving signal Vout to one end of the piezoelectric element 60 included in the discharge section 600. In addition, the reference voltage signal VBS is commonly applied to the other end of all of the piezoelectric elements 60. The piezoelectric elements 60 are provided corresponding to each of the discharge sections 600, and are displaced as the driving signal Vout (driving signals COM-Ai and COM-Bi) are applied. In addition, the piezoelectric element 60 is displaced in accordance with a potential difference between the driving signal Vout (driving signals COM-Ai and COM-Bi) and the reference voltage signal VBS, and discharges the liquid (ink). In this manner, the driving module 20-*i* discharges the liquid as the driving signal COM-Ai and the driving signal COM-Bi are exclusively selected and applied to one end of the piezoelectric element 60, and as the reference voltage signal VBS is applied to the other end of the piezoelectric element 60 and the piezoelectric element 60 is driven. In other words, the driving signals COM-Ai and COM-Bi are signals for discharging the liquid by driving each of the discharge sections 600.

In addition, the driving signals COM-A1 to COM-An and COM-B1 to COM-Bn are signals of high voltage (several tens of V) since the signals are signals for driving the discharge section 600, and in the n driving circuits 50 (50-*a*1 to 50-*n* and 50-*b*1 to 50-*bn*) which generate each of the driving signals COM-A1 to COM-An and COM-B1 to COM-Bn, power consumption is likely to increase and the temperature is likely to increase. In addition, when the waveforms of the driving signals COM-A1 to COM-An and COM-B1 to COM-Bn change in accordance with the temperature characteristics of the driving circuits 50 (50-*a*1 to 50-*n* and 50-*b*1 to 50-*bn*), influence on discharge accuracy of the liquid from the discharge section 600 is generated. Therefore, the temperature sensor is provided in the vicinity of the driving circuits 50-*a*1 to 50-*an* and 50-*b*1 to 50-*bn*, and the discharge control module 100 may generate the driving data dA1 to dAn and dB1 to dBn such that the temperature of the waveforms of the driving signals COM-A1 to COM-An and COM-B1 to COM-Bn is adjusted based on the output signal of the temperature sensor. In addition, even when the temperature of the waveforms of the driving signals COM-A1 to COM-An and COM-B1 to COM-Bn is corrected, the discharge characteristics change according to the temperature characteristics of the piezoelectric element 60, and as a result, there is a case where influence on discharge accuracy of the liquid is generated. Therefore, the temperature sensor is provided in the vicinity (for example, in the vicinity of a nozzle plate 121 (refer to FIG. 12)) of the discharge section 600 (piezoelectric element 60), the discharge control module 100 may receive an output signal of the temperature sensor via the flexible flat cable 190 or the flexible flat cable 191, and may generate the driving data dA1 to dAn and dB1 to dBn in order to cancel the change in temperature characteristics of the piezoelectric element 60 based on the output signal of the temperature sensor. As the discharge control module 100 performs these processing, it is possible to improve discharge accuracy of the liquid from the discharge section 600.

3. Configuration of Driving Signal

As a method for forming dots on the recording sheet S, in addition to a method for forming one dot by discharging an ink droplet one time, when it is possible to discharge the ink droplets two or more times during a unit period, there is a method (second method) for forming one dot by allowing one or more ink droplets discharged during the unit period to land, and by combining the one or more landed droplets to each other, and a method (third method) for forming two or more dots by combining the two or more ink droplets to each other.

In the embodiment, according to the second method, as one dot, by discharging the ink at the maximum two times, four gradations, such as "large dot", "medium dot", "small dot", and "not recorded (no dot)", are expressed. In order to express the four gradations, in the embodiment, in the driving modules 20-*i* (i is any number among 1 to n), two types of driving signals COM-Ai and COM-Bi are prepared, and in each of them, a front half pattern and a rear half pattern are included in one cycle. A configuration in which, in one cycle, the driving signals COM-Ai and COM-Bi at the front half and at the rear half are selected (or not selected) in accordance with the gradation to be expressed, and are supplied to the piezoelectric element 60, is employed.

Figure 5:
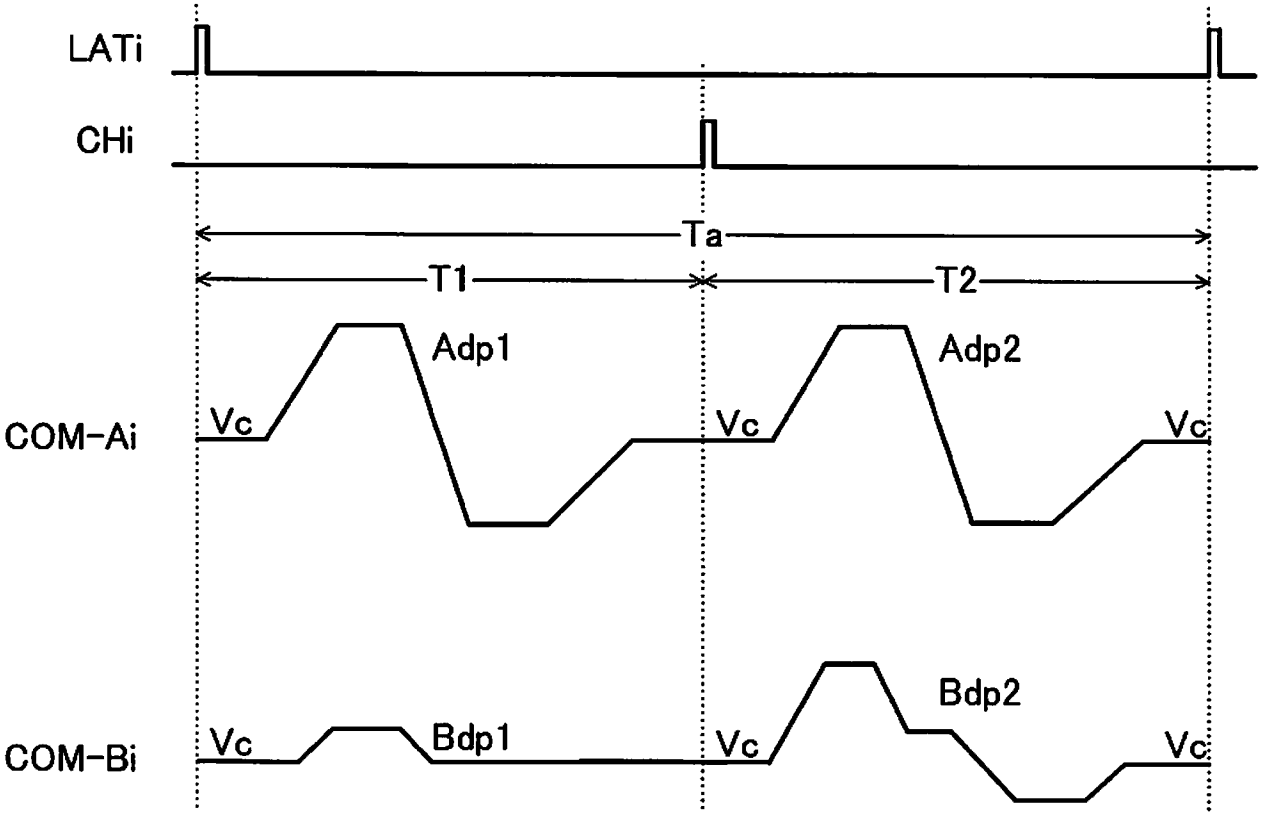
FIG. 5 is a view illustrating waveforms of driving signals.

FIG. 5 is a view illustrating the waveforms of the driving signals COM-Ai and COM-Bi. As illustrated in FIG. 5, the driving signal COM-Ai has a waveform in which a trapezoidal waveform Adp1 disposed in a period T1 after the latch signal LATi rises until the change signal CHi rises, and a trapezoidal waveform Adp2 disposed in a period T2 after the change signal CHi rises until the next latch signal LATi rises, are continuous to each other. By setting the period after the period T1 and the period T2 to be a cycle Ta, in each of the cycles Ta, new dots are formed on the recording sheet S.

In the embodiment, the trapezoidal waveforms Adp1 and Adp2 are waveforms which are substantially the same as each other, and are waveforms in which a predetermined amount, specifically, an approximately medium amount of ink is respectively discharged from the nozzle 122 corresponding to the piezoelectric element 60 when each of the waveforms is supplied to one end of the piezoelectric element 60.

The driving signal COM-Bi has a waveform in which a trapezoidal waveform Bdp1 disposed in the period T1 and a trapezoidal waveform Bdp2 disposed in the period T2 are continuous to each other. In the embodiment, the trapezoidal waveforms Bdp1 and Bdp2 are waveforms different from each other. Among these, the trapezoidal waveform Bdp1 is a waveform for preventing an increase in viscosity of the ink by finely vibrating the ink near an open hole portion of the nozzle 122. Therefore, even when the trapezoidal waveform Bdp1 is supplied to one end of the piezoelectric element 60, the ink droplet from the nozzle 122 which corresponds to the piezoelectric element 60 is not discharged. In addition, the trapezoidal waveform Bdp2 is a waveform different from the trapezoidal waveform Adp1 (Adp2). The trapezoidal waveform Bdp2 is a waveform in which the ink of which the amount is smaller than the predetermined amount is discharged from the nozzle 122 that corresponds to the piezoelectric element 60 when the trapezoidal waveform Bdp2 is supplied to one end of the piezoelectric element 60.

In addition, any of the voltage at a start timing of the trapezoidal waveforms Adp1, Adp2, Bdp1, and Bdp2, and the voltage at the end timing is common as a voltage Vc. In other words, the trapezoidal waveforms Adp1, Adp2, Bdp1, and Bdp2 are respectively waveforms which start at the voltage Vc and ends at the voltage Vc.

Figure 6:
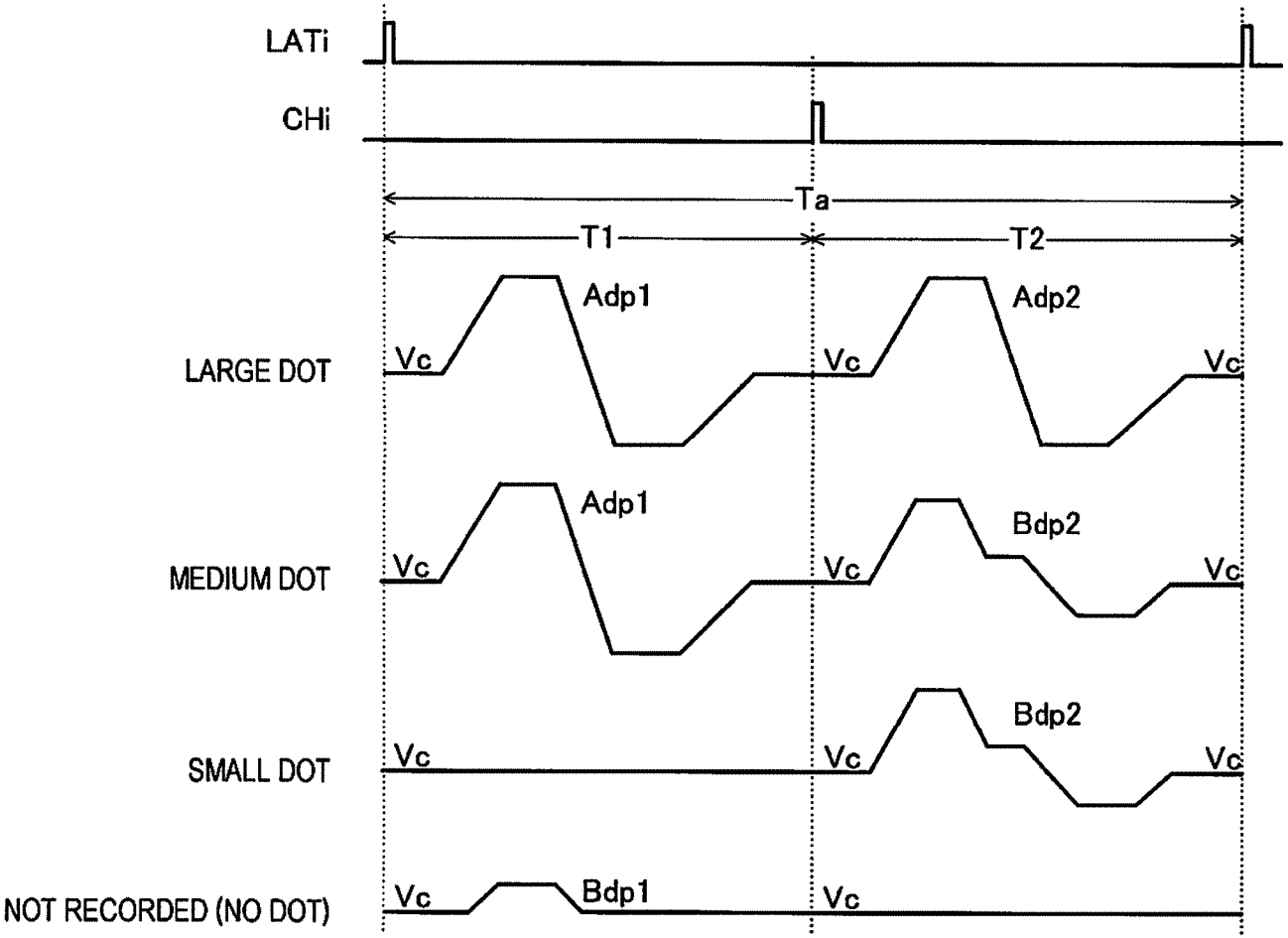
FIG. 6 is a view illustrating waveforms of a driving signal.

FIG. 6 is a view illustrating the waveforms of the driving signal Vout which corresponds to each of "large dot", "medium dot", "small dot", and "not recorded".

As illustrated in FIG. 6, the driving signal Vout which corresponds to "large dot" has a waveform in which the trapezoidal waveform Adp1 of the driving signal COM-Ai in the period T1 and the trapezoidal waveform Adp2 of the driving signal COM-Ai in the period T2 are continuous to each other. When the driving signal Vout is supplied to one end of the piezoelectric element 60, in the cycle Ta, the approximately medium amount of ink is discharged two times from the nozzle 122 which corresponds to the piezoelectric element 60. Therefore, on the recording sheet S, each drop of ink lands and is integrated with each other, and the large dot is formed.

The driving signal Vout which corresponds to "medium dot" has a waveform in which the trapezoidal waveform Adp1 of the driving signal COM-Ai in the period T1 and the trapezoidal waveform Bdp2 of the driving signal COM-Bi in the period T2 are continuous to each other. When the driving signal Vout is supplied to one end of the piezoelectric element 60, in the cycle Ta, the approximately medium amount and approximately small amount of ink are discharged two times from the nozzle 122 which corresponds to the piezoelectric element 60. Therefore, on the recording sheet S, each drop of ink lands and is integrated with each other, and the medium dot is formed.

The driving signal Vout which corresponds to "small dot" becomes the immediately previous voltage Vc held by capacitive properties of the piezoelectric element 60 in the period T1, and has the trapezoidal waveform Bdp2 of the driving signal COM-Bi in the period T2. When the driving signal Vout is supplied to one end of the piezoelectric element 60, in the cycle Ta, only the approximately small amount of ink is discharged in the period T2 from the nozzle 122 which corresponds to the piezoelectric element 60. Therefore, on the recording sheet S, the ink lands and the small dot is formed.

The driving signal Vout which corresponds to "not recorded" has the trapezoidal waveform Bdp1 of the driving signal COM-Bi in the period T1, and the immediately previous voltage Vc held by the capacitive properties of the piezoelectric element 60 in the period T2. When the driving signal Vout is supplied to one end of the piezoelectric element 60, in the cycle Ta, as the nozzle 122 which corresponds to the piezoelectric element 60 only finely vibrates in the period T2, the ink is not discharged. Therefore, on the recording sheet S, the ink does not land, and the dot is not formed.

4. Configuration of Selection Control Section and Selection Section

Figure 7:
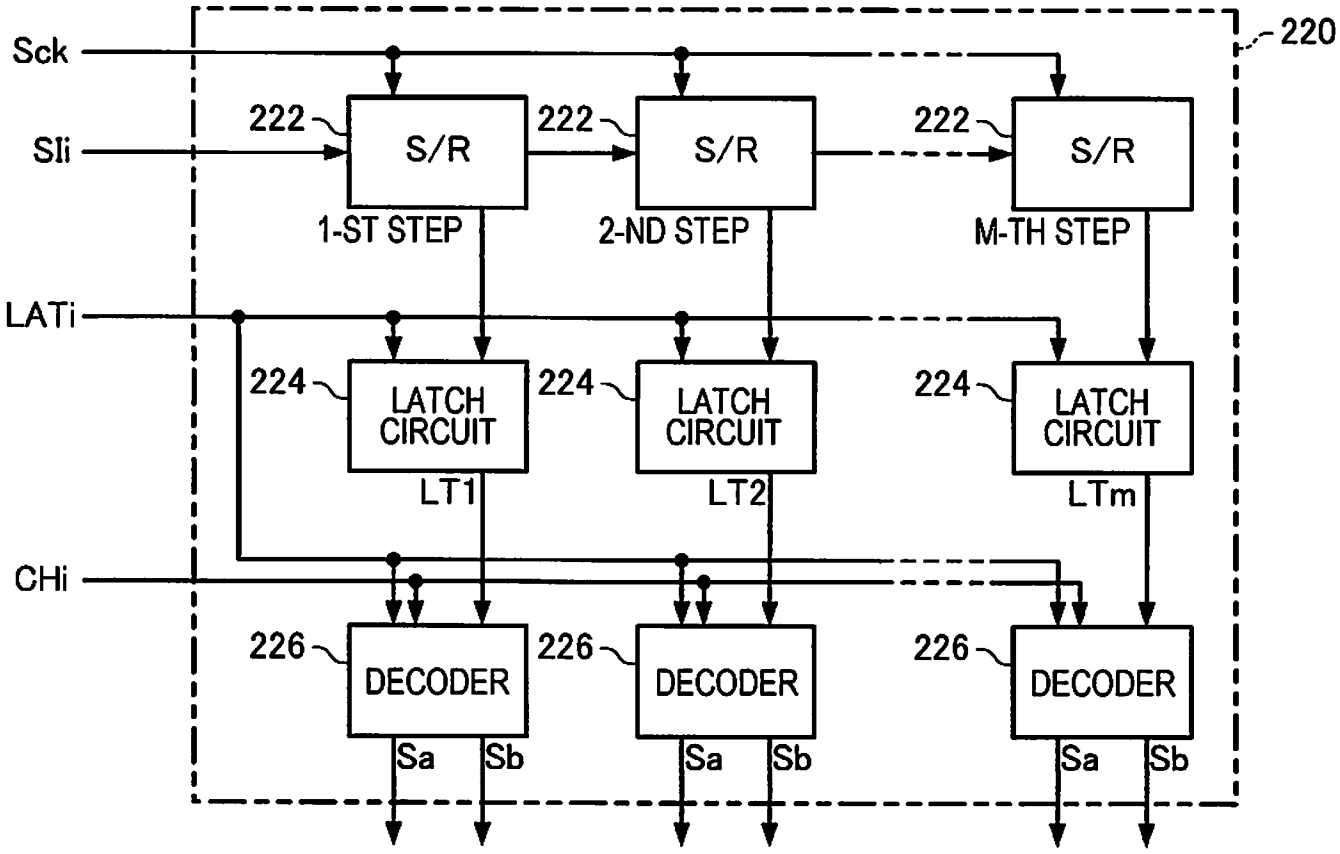
FIG. 7 is a view illustrating a configuration of a selection control section.

FIG. 7 is a view illustrating a configuration of the selection control section 220. As illustrated in FIG. 7, the clock signal Sck, the printing data signal SIi, the latch signal LATi, and the change signal CHi are supplied to the selection control section 220. In the selection control section 220, a group of a shift register (S/R) 222, a latch circuit 224, and a decoder 226 is provided corresponding to each of the piezoelectric elements 60 (nozzles 122).

The printing data signal SIi is a signal, which corresponds to each of m discharge sections 600, that includes two-bit printing data (SIH and SIL) for selecting any of "large dot", "medium dot", "small dot", and "not recorded", and has 2m bits in total.

The printing data signal SIi is serially supplied from the control signal restoring section 25 in synchronization with the clock signal Sck. A configuration for the temporary holding each two-bit printing data (SIH and SIL) included in the printing data signal SIi corresponding to the nozzle, is the shift register 222.

Specifically, a configuration in which the shift registers 222 having the number of steps which corresponds to the piezoelectric elements 60 (nozzles) are connected to each other in cascade, and the printing data signals SIi which are serially supplied are consecutively transferred in a later step according to the clock signal Sck, is employed.

In addition, when the number of piezoelectric elements 60 is m (m is a plural number), in order to distinguish the shift register 222, the shift register 222 are written as the first step, the second step, . . . and the m-th step in order from the upstream side on which the printing data signal SIi is supplied.

Each of the m latch circuits 224 latches the two-bit printing data (SIH and SIL) which is held by each of the m shift registers 222 at the rise of the latch signal LATi.

Each of the m decoders 226 decodes the two-bit printing data (SIH and SIL) latched by each of the m latch circuits 224, outputs selection signals Sa and Sb in each of the periods T1 and T2 regulated by the latch signal LATi and the change signal CHi, and regulates the selection by the selection section 230.

Figures 8, 9:
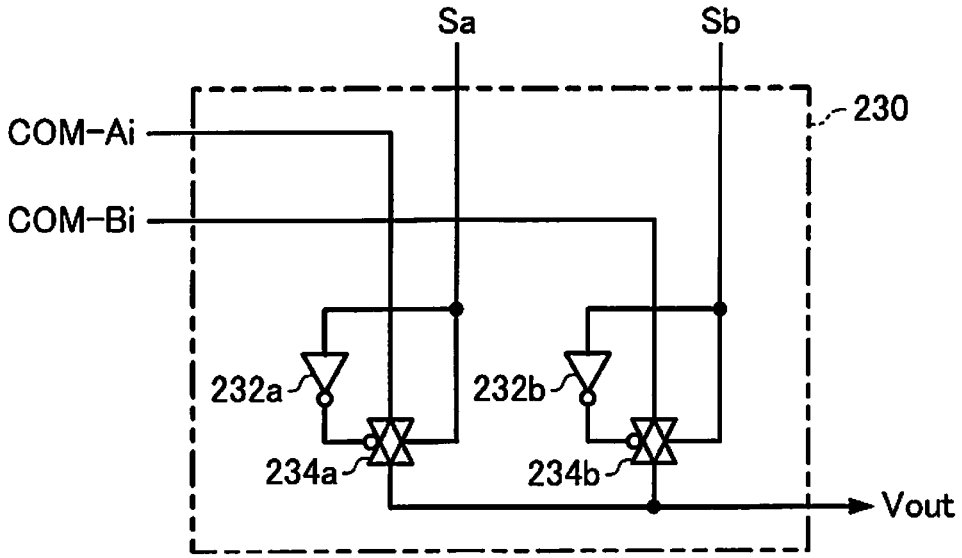
FIG. 8 is a view illustrating decode contents of a decoder.
FIG. 9 is a view illustrating a configuration of a selection section.

FIG. 8 is a view illustrating decode contents in the decoder 226. In the decoder 226, for example, a case where the latched two-bit printing data (SIH and SIL) is (1, 0) means a case where the signal is output when logic levels of the selection signals Sa and Sb are respectively set to be H and L levels in the period T1 and are respectively set to be L and H levels in the period T2.

In addition, the logic levels of the selection signals Sa and Sb are shifted to a higher amplitude logic by a level shifter (not illustrated) than the logic levels of the clock signal Sck, the printing data signal SIi, the latch signal LATi, and the change signal CHi.

FIG. 9 is a view illustrating a configuration of the selection section 230 which corresponds to one piezoelectric element 60 (nozzle 122).

As illustrated in FIG. 9, the selection section 230 includes inverters (NOT circuit) 232*a* and 232*b* and transfer gates 234*a* and 234*b*.

The selection signal Sa from the decoder 226 is logic-inverted by the inverter 232*a* while being supplied to a positive control end at which a round mark is not given in the transfer gate 234*a*, and is supplied to a negative control end at which a round mark is given in the transfer gate 234*a*. Similarly, the selection signal Sb is logic-inverted by the inverter 232*b* while being supplied to a positive control end of the transfer gate 234*b*, and is supplied to a negative control end of the transfer gate 234*b*.

The driving signal COM-Ai is supplied to an input end of the transfer gate 234*a*, and the driving signal COM-Bi is supplied to an input end of the transfer gate 234*b*. Output ends of the transfer gates 234*a* and 234*b* are commonly connected to each other, and the driving signal Vout is output to the discharge section 600 via the common connection terminal.

When the selection signal Sa is the H level, the transfer gate 234*a* is conductive (ON) between the input end and the output end, and when the selection signal Sa is the L level, the transfer gate 234*a* is non-conductive (OFF) between the input end and the output end. The transfer gate 234*b* is also similarly turned On and OFF between the input end and the output end in accordance with the selection signal Sb.

Next, operations of the selection control section 220 and the selection section 230 will be described with reference to FIG. 10.

The printing data signal SIi is serially supplied in synchronization with the clock signal Sck in each of the nozzles from the control signal restoring section 25, and is consecutively transferred in the shift register 222 which corresponds to the nozzle. In addition, when the supply of the clock signal Sck from the control signal receiving section 24 is stopped, a state where the two-bit printing data (SIH and SIL) which corresponds to the nozzle is held in each of the shift registers 222. In addition, the printing data signal SIi is supplied in order that corresponds to the final m-th step, . . . , the second step, and the first step in the shift register 222.

Here, when the latch signal LATi rises, each of the latch circuits 224 simultaneously latches the two-bit printing data (SIH and SIL) held by the shift register 222. In FIG. 10, LT1, LT2, . . . and LTm illustrate the two-bit printing data (SIH and SIL) which are latched by the latch circuit 224 that corresponds to the shift register 222 of the first step, the second step, . . . , and the m-th step.

The decoder 226 outputs the logic levels of the selection signals Sa and Sb by the contents illustrated in FIG. 8, in each of the periods T1 and T2 in accordance with the size of the dots regulated by the latched two-bit printing data (SIH and SIL).

In other words, in the decoder 226, the printing data (SIH and SIL) is (1, 1), and in a case of regulating the size of the large dot, the selection signals Sa and Sb are set to be the H and L levels in the period T1, and are also set to be the H and L levels in the period T2. In addition, in the decoder 226, the printing data (SIH and SIL) is (1, 0), and in a case of regulating the size of the medium dot, the selection signals Sa and Sb are set to be the H and L levels in the period T1, and are set to be the L and H levels in the period T2. In addition, in the decoder 226, the printing data (SIH and SIL) is (0, 1), and in a case of regulating the size of the small dot, the selection signals Sa and Sb are set to be the L and L levels in the period T1, and are set to be the L and H levels in the period T2. In addition, in the decoder 226, the printing data (SIH and SIL) is (0, 0), and in a case of regulating the not-recorded state, the selection signals Sa and Sb are set to be the L and H levels in the period T1, and are set to be the L and L levels in the period T2.

When the printing data (SIH and SIL) is (1, 1), the selection section 230 selects the driving signal COM-Ai (trapezoidal waveform Adp1) since the selection signals Sa and Sb are the H and L levels in the period T1, and selects the driving signal COM-Ai (trapezoidal waveform Adp2) since the Sa and Sb are also the H and L levels in the period T2. As a result, the driving signal Vout which corresponds to "large dot" illustrated in FIG. 6 is generated.

In addition, when the printing data (SIH and SIL) is (1, 0), the selection section 230 selects the driving signal COM-Ai (trapezoidal waveform Adp1) since the selection signals Sa and Sb are the H and L levels in the period T1, and selects the driving signal COM-Bi (trapezoidal waveform Bdp2) since the Sa and Sb are the L and H levels in the period T2. As a result, the driving signal Vout which corresponds to "medium dot" illustrated in FIG. 6 is generated.

In addition, when the printing data (SIH and SIL) is (0, 1), the selection section 230 selects none of the driving signals COM-Ai and COM-Bi since the selection signals Sa and Sb are the L and L levels in the period T1, and selects the driving signal COM-Bi (trapezoidal waveform Bdp2) since the Sa and Sb are the L and H levels in the period T2. As a result, the driving signal Vout which corresponds to "small dot" illustrated in FIG. 6 is generated. In addition, in the period T1, since none of the driving signals COM-Ai and COM-Bi is selected, one end of the piezoelectric element 60 is open, but the driving signal Vout is held at the immediately previous voltage Vc due to the capacitive properties of the piezoelectric element 60.

In addition, when the printing data (SIH and SIL) is (0, 0), the selection section 230 selects the driving signal COM-Bi (trapezoidal waveform Bdp1) since the selection signals Sa and Sb are the L and H levels in the period T1, and selects none of the driving signals COM-Ai and COM-Bi since the Sa and Sb are the L and L levels in the period T2. As a result, the driving signal Vout which corresponds to "not recorded" illustrated in FIG. 6 is generated. In addition, in the period T2, since none of the driving signals COM-Ai and COM-Bi is selected, one end of the piezoelectric element 60 is open, but the driving signal Vout is held at the immediately previous voltage Vc due to the capacitive properties of the piezoelectric element 60.

Figure 10:
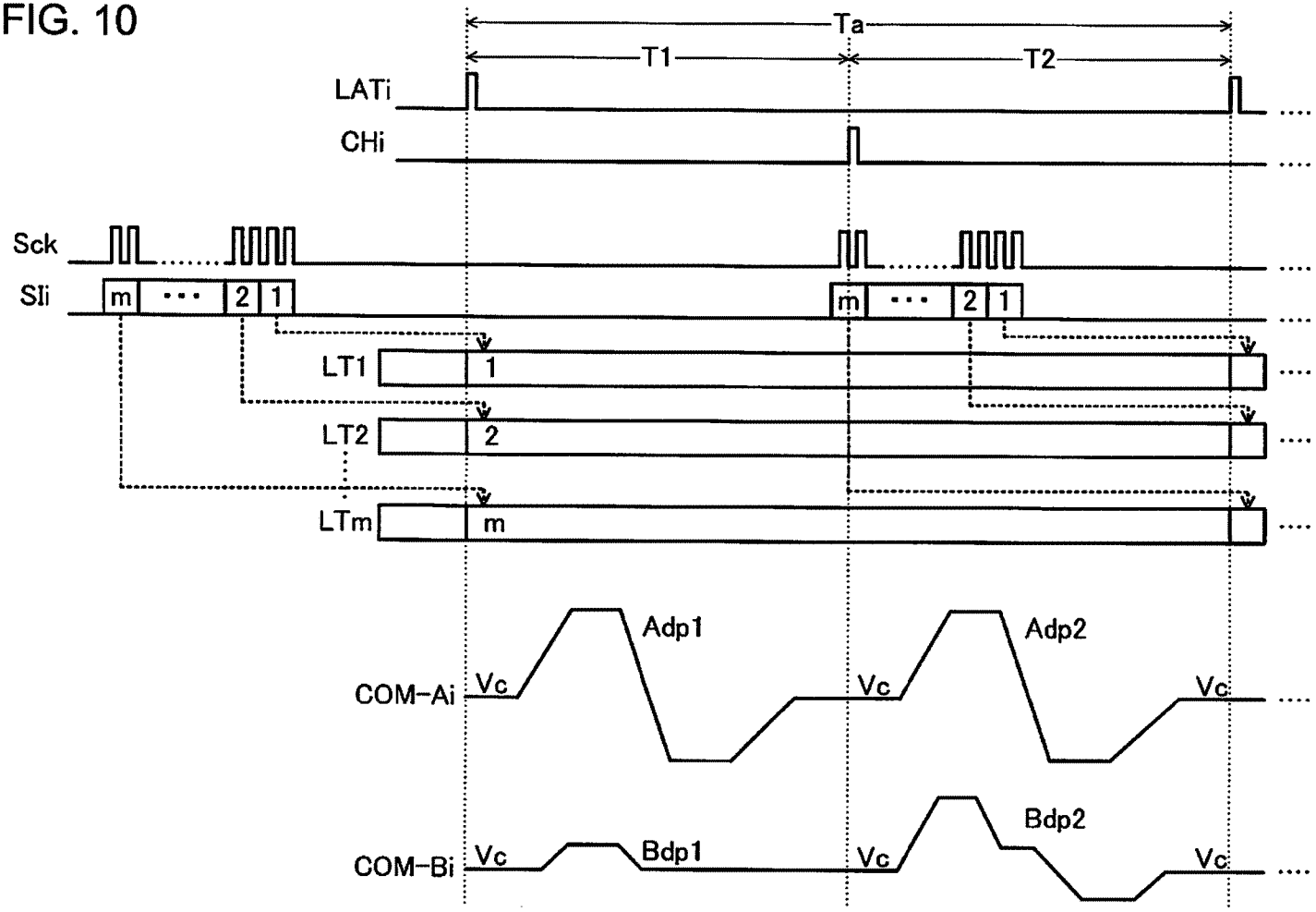
FIG. 10 is a view for illustrating operations of the selection control section and the selection section.

In addition, the driving signals COM-Ai and COM-Bi which are illustrated in FIGS. 5 and 10 are merely one example, and practically, combinations of various waveforms prepared in advance are used in accordance with the characteristics or the like of the recording sheet S.

5. Configuration of Head Unit

Figure 11:
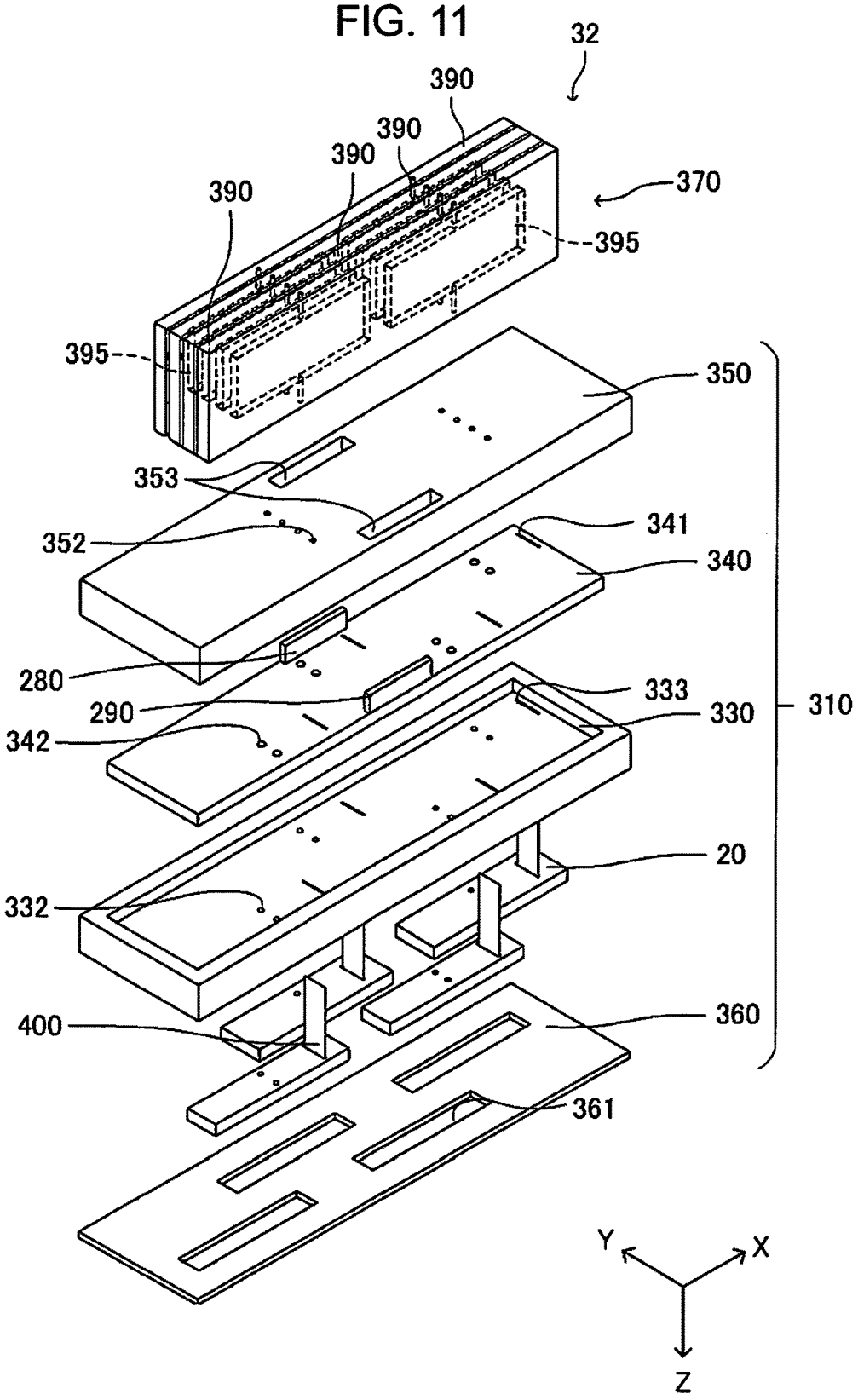
FIG. 11 is an exploded perspective view illustrating a configuration of the head unit.

FIG. 11 is an exploded perspective view illustrating the configuration of the head unit 32. In addition, (X, Y, Z) illustrated in FIG. 11 corresponds to "first direction X", "second direction Y", and "third direction Z" in FIGS. 1, 2, and 3.

As illustrated in FIG. 11, the head unit 32 includes a head main body 310 which ejects the ink which is the liquid, and a flow path member 370 which is fixed to the head main body 310.

The head main body 310 includes the n (here, four) driving modules 20, a holder 330 which holds the plurality of driving modules 20, a relay board 340 which is fixed to the holder 330, a supply member 350, and a fixing plate 360 which fixes the plurality of driving modules 20.

In the driving module 20, the number of rows in which the nozzles 122 which eject the ink as illustrated in FIG. 3 are aligned in the first direction X is plural, and in the embodiment, two rows are provided. On a surface opposite to a surface on which the nozzles 122 of each of the driving modules 20 are provided in the third direction Z, a wiring board 400 connected to a sealing plate 160 (refer to FIG. 12) which is a relay board provided on the inside of the driving module 20 is drawn out.

In the holder 330, on a side on which the fixing plate 360 in the third direction Z is provided, an accommodation section which is not illustrated and accommodates the plurality of driving modules 20 therein is provided. The accommodation section has a recessed shape which is open on a side on which the fixing plate 360 in the third direction Z is provided, and accommodates the plurality of driving modules 20 fixed by the fixing plate 360, and further, the opening of the accommodation section is sealed by the fixing plate 360. In other words, the driving module 20 is accommodated on the inside of a space formed by the accommodation section and the fixing plate 360.

In addition, in the holder 330, a communication flow path 332 for supplying the ink supplied from the supply member 350 to the driving module 20 is provided. Two communication flow paths 332 are provided for one driving module 20. In other words, the communication flow path 332 is provided in accordance with each row of the nozzles 122 provided in one driving module 20.

Furthermore, in the holder 330, a wiring insertion hole 333 for inserting the wiring board 400 which is electrically connected to the driving module 20 provided in the accommodation section into the surface on which the accommodation section in the third direction Z is provided and a different surface on the third direction Z side, is provided. The wiring board 400 is drawn out from the space formed by the accommodation section and the fixing plate 360 as being inserted into the wiring insertion hole 333 of the holder 330.

On a side on which the wiring board 400 of the holder 330 is drawn out, the relay board 340 is held. In the relay board 340, a driving wiring connection hole 341 which penetrates in the third direction Z which is the thickness direction is provided, and the wiring board 400 is, for example, a flexible printed board, penetrates the driving wiring connection hole 341 of the relay board 340, is bent, and is electrically connected to the relay board 340.

In addition, in the relay board 340, an insertion hole 342 is provided at a position which corresponds to the communication flow path 332 of the holder 330. The insertion hole 342 inserts a protrusion portion (not illustrated) provided in the supply member 350. The protrusion portion performs the supply of the ink to the holder 330 from the supply member 350 by connecting the supply member 350 and the communication flow path 332 of the holder 330 to each other.

Furthermore, in each of both sides in the second direction Y in the relay board 340, a control signal connector 280 and a driving signal connector 290 are provided. In addition, the relay board 340 is electrically connected to the control unit 10 via the flexible flat cables 190 and 191 (refer to FIG. 4). In the relay board 340, an IC (not illustrated) including the control signal receiving section 24 (refer to FIG. 4) and the control signal restoring section 25 (refer to FIG. 4) are loaded, and the serial control signals S1 to Sn and the clock signal Clk which are input from the control signal connector 280 are transmitted through the wiring provided in the relay board 340 and are input to the control signal receiving section 24 of the IC. In addition, the control signals (the clock signal Sck, the printing data signals SI1 to SIn, the latch signals LAT1 to LATn, and the change signals CH1 to CHn) restored by the control signal restoring section 25 of the IC are transmitted through the wiring provided in the relay board 340, and is output to each of the driving modules 20 via each of the wiring boards 400. In addition, the driving signals COM-A1 to COM-An and COM-B1 to COM-Bn, the high power source voltage signal HVDD, the low power source voltage signal LVDD, the reference voltage signal VBS, and the ground voltage signal GND which are input from the driving signal connector 290 are transmitted through the wiring provided in the relay board 340, and are output to each of the driving modules 20 via the wiring board 400.

The supply member 350 is fixed to the holder 330 on the third direction Z side. In addition, in the supply member 350, a supply flow path 352 for supplying the ink supplied from the flow path member 370 to the communication flow path 332 of the holder 330, is provided. The supply flow path 352 is provided to be open on both surfaces in the third direction Z of the supply member 350. In addition, the supply flow path 352 may include a flow path of the flow path member 370, and a flow path which extends in the first direction X or in the second direction Y in accordance with the positions of the insertion hole 342 of the relay board 340 and the communication flow path 332 of the holder 330.

In addition, in the supply member 350, a through-hole 353 which penetrates in the third direction Z at the positions that correspond to each of the control signal connector 280 and the driving signal connector 290, is provided. In other words, the flexible flat cables 190 and 191 (refer to FIG. 4) insert the through-hole 353 of the supply member 350, and are connected to the control signal connector 280 and the driving signal connector 290.

In addition, in the fixing plate 360 which blocks the opening of the accommodation section of the holder 330, an exposure opening section 361 which exposes the nozzle 122 of each of the driving modules 20, is provided. The exposure opening section 361 in the embodiment is independently provided in each of the driving modules 20, and is sealed by the fixing plate 360 between the driving modules 20 adjacent to each other. In addition, the fixing plate 360 is fixed to the driving module 20 in the circumferential edge portion of the exposure opening section 361.

The flow path member 370 is fixed to the supply member 350 side of the head main body 310 on the third direction Z side. The flow path member 370 is configured as the plurality of filter units 390 are stacked in the second direction Y. In addition, in the filter unit 390, a plurality of flow paths 395 are provided on the inside thereof, bubbles or foreign substances which are included in the ink are removed, and the ink is supplied to the supply member 350 provided in the head main body 310.

The head unit 32 in the embodiment supplies the ink supplied from the flow path member 370 to the driving module 20 via the supply flow path 352 and the communication flow path 332 which are provided in the head main body 310. In addition, by driving the piezoelectric element 60 provided in the driving module 20-*i* based on the above-described driving signals COM-Ai and COM-Bi, ink droplets are ejected from the nozzle 122.

6. Configuration of Driving Module

Figure 12:
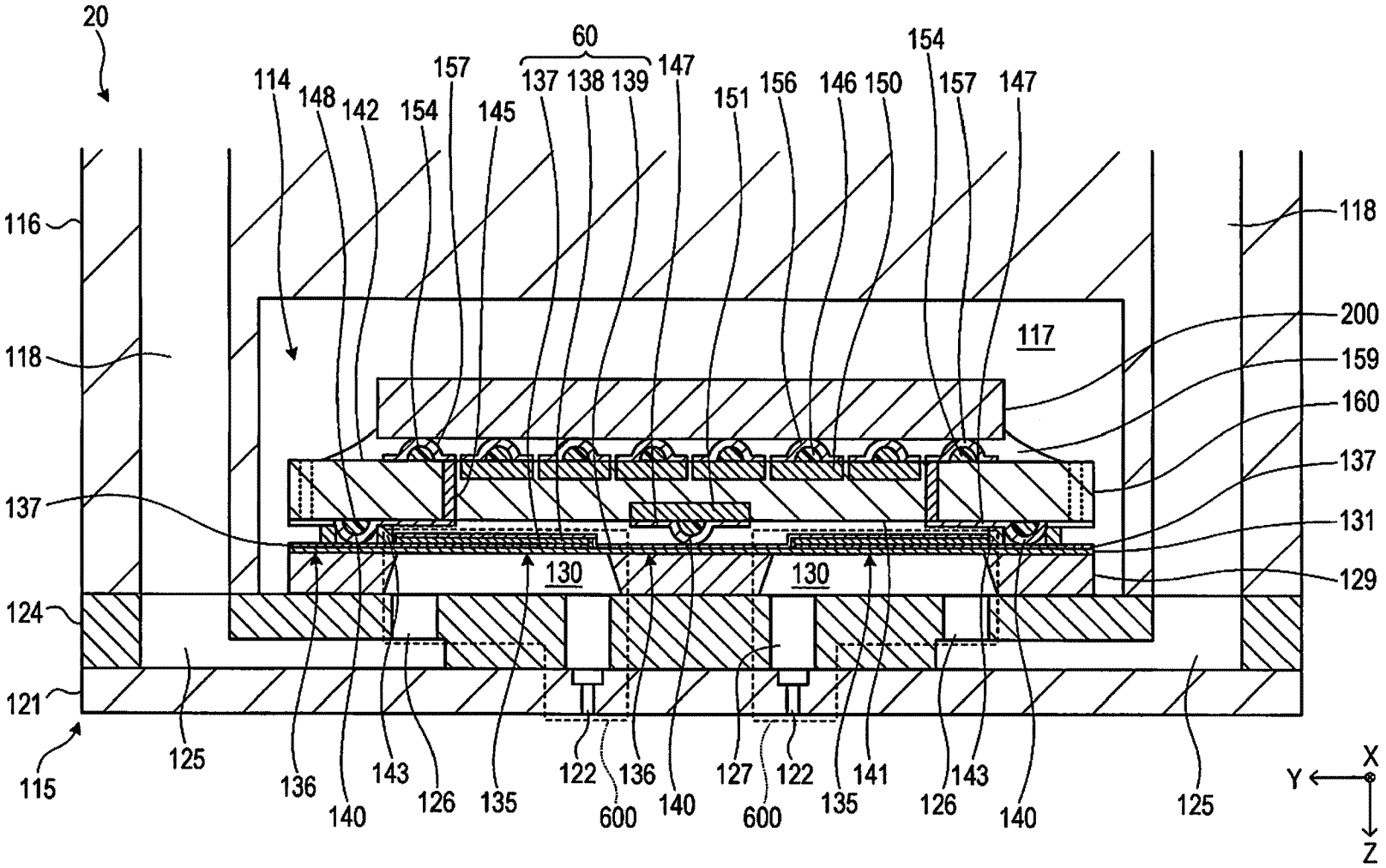
FIG. 12 is a sectional view illustrating an inner structure of a driving module.

FIG. 12 is a sectional view illustrating an inner structure of the driving module 20. In addition, (X, Y, Z) illustrated in FIG. 12 correspond to "first direction X", "second direction Y", and "third direction Z" in FIGS. 1, 2, and 3. As illustrated in FIG. 12, the driving module 20 is attached to a head case 116 in a state where an electronic device 114 and a flow path unit 115 are stacked.

Reservoirs 118 which supply the ink to each of the pressure chambers (cavities) 130 is formed on the inside of the head case 116. Two reservoirs 118 are a space in which common ink is stored in the plurality of pressure chambers 130 which are aligned, and are formed corresponding to the rows of the pressure chambers 130 which are aligned in two rows. The reservoir 118 communicates with the communication flow path 332 (refer to FIG. 11), and the ink is supplied to the reservoir 118 through the communication flow path 332. In addition, on the lower surface side of the head case 116, an accommodation space 117 in which the electronic device 114 (a driving IC 200, a pressure chamber forming board 129, the sealing plate 160, or the like) stacked on a communication board 124 is accommodated, is formed.

The flow path unit 115 includes the communication board 124 and the nozzle plate 121. In the communication board 124, a common liquid chamber 125 which communicates with the reservoir 118 and in which the common ink is stored in each of the pressure chambers 130, and an individual communication path 126 which individually supplies the ink from the reservoir 118 to each of the pressure chambers 130 via the common liquid chamber 125, are formed. The common liquid chamber 125 is a long empty portion which is along a nozzle row direction, and two rows of common liquid chambers 125 are formed corresponding to the rows of pressure chambers 130 which are aligned in two rows. The plurality of individual communication paths 126 are formed along the aligning direction of the pressure chamber 130 corresponding to the pressure chamber 130 in a thin plate portion of the common liquid chamber 125. The individual communication path 126 communicates with the end portion on one side in the longitudinal direction of the corresponding pressure chamber 130 in a state where the communication board 124 and the pressure chamber forming board 129 are bonded to each other.

In addition, at the positions which correspond to each of the nozzles 122 of the communication board 124, a nozzle communication path 127 which penetrates in the plate thickness direction of the communication board 124 is formed. In other words, the plurality of nozzle communication paths 127 are formed along the nozzle row direction corresponding to the nozzle row. The pressure chamber 130 and the nozzle 122 communicate with each other by the nozzle communication path 127. In a state where the communication board 124 and the pressure chamber forming board 129 are bonded to each other, the nozzle communication path 127 communicates with the end portion on the other side (a side opposite to the individual communication path 126) in the longitudinal direction of the corresponding pressure chamber 130.

The nozzle plate 121 is a board bonded to a lower surface (a surface opposite to the pressure chamber forming board 129) of the communication board 124. By the nozzle plate 121, the opening on the lower surface side of the space which is the common liquid chamber 125 is sealed. In addition, in the nozzle plate 121, the plurality of nozzles 122 are installed to be open in a shape of a straight line (shape of a row), and two nozzle rows are formed corresponding to the row of the pressure chamber 130 which are formed in two rows. The plurality of nozzles 122 (nozzle rows) which are aligned are provided at an equal interval along the first direction X at a pitch (for example, 600 dpi) which corresponds to a dot forming density from the nozzle 122 on one end side to the nozzle 122 on the other end side.

The electronic device 114 is a device having a shape of a thin plate which functions as an actuator that generates pressure fluctuation in the ink in each of the pressure chambers 130. The electronic device 114 becomes a unit in which the pressure chamber forming board 129, a vibration plate 131, the piezoelectric element 60, the sealing plate 160, and the driving IC 200 are stacked. In the driving IC 200, the selection control section 220 and the m selection sections 230 (refer to FIG. 4) are included.

In the pressure chamber forming board 129, a plurality of spaces which are supposed to be the pressure chamber 130 are aligned along the nozzle row direction. A lower part of the space is divided by the communication board 124, an upper part of the space is divided by the vibration plate 131, and the space configures the pressure chamber 130. Two rows of pressure chambers 130 are formed corresponding to the nozzle rows formed in two rows. Each of the pressure chambers 130 is a long space in a direction orthogonal to the nozzle row direction, the individual communication path 126 communicates with the end portion on one side in the longitudinal direction, and the nozzle communication path 127 communicates with the end portion on the other side.

The vibration plate 131 is an elastic member having a shape of a thin plate, and is stacked on the upper surface (a surface opposite to the communication board 124 side) of the pressure chamber forming board 129. An upper opening of the space which is supposed to be the pressure chamber 130 is sealed by the vibration plate 131. A part which corresponds to the upper opening of the pressure chamber 130 in the vibration plate 131 functions as a displacement unit which is displaced in a direction of being separated from or being close to the nozzle 122 in accordance with flexural deformation of the piezoelectric element 60. In other words, a region which corresponds to the upper opening of the pressure chamber 130 in the vibration plate 131 becomes a driving region 135 of which the flexural deformation is allowed. Meanwhile, a region which is out of the upper opening of the pressure chamber 130 in the vibration plate 131 becomes a non-driving region 136 in which the flexural deformation is inhibited.

In the driving region 135, the piezoelectric elements 60 are respectively stacked. Each of the piezoelectric elements 60 is formed in two rows in the nozzle row direction corresponding to the pressure chambers 130 which are aligned in two rows along the nozzle row direction. In the piezoelectric element 60, for example, a lower electrode layer 137 (individual electrode), a piezoelectric body layer 138, and an upper electrode layer 139 (common electrode) are consecutively stacked on the vibration plate 131. The piezoelectric element 60 configured in this manner is flexurally deformed in the direction of being separated from or being close to the nozzle 122 when an electric field which corresponds to the potential difference of both electrodes is imparted between the lower electrode layer 137 and the upper electrode layer 139. The end portion on the other side (an outer side in the longitudinal direction of the piezoelectric element 60) of the lower electrode layer 137 exceeds the region in which the piezoelectric body layer 138 is stacked from the driving region 135, and extends to the non-driving region 136. Meanwhile, the end portion on one side (an inner side in the longitudinal direction of the piezoelectric element 60) of the upper electrode layer 139 exceeds the region in which the piezoelectric body layer 138 is stacked from the driving region 135, and extends to the non-driving region 136 between the rows of the piezoelectric element 60.

The sealing plate 160 is a board having a shape of a flat plate which is disposed with space between the vibration plate 131 (or the piezoelectric element 60) and the board. The sealing plate 160 may function as a relay board which relays various signals, and may function as a protection board which protects the vibration plate 131 (or the piezoelectric element 60). On a second surface 142 (upper surface) on a side opposite to a first surface 141 (lower surface) which is a surface on the vibration plate 131 side of the sealing plate 160, the driving IC 200 which drives the piezoelectric element 60 is disposed. In other words, the vibration plate 131 on which the piezoelectric element 60 is stacked is connected to the first surface 141 of the sealing plate 160, and the driving IC 200 is connected to the second surface 142.

On the first surface 141 of the sealing plate 160, a plurality of bump electrodes 140 which output the driving signal from the driving IC 200 to the piezoelectric element 60 are formed. The plurality of bump electrodes 140 are formed along the nozzle row direction respectively at a position which corresponds to one lower electrode layer 137 (individual electrode) which extends to the outer side of one piezoelectric element 60, at a position which corresponds to the other lower electrode layer 137 (individual electrode) which extends to the outer side of the other piezoelectric element 60, and at a position which corresponds to the upper electrode layer 139 (common electrode) common to the plurality of piezoelectric elements 60 formed between the rows of both of the piezoelectric elements 60. In addition, each of the bump electrodes 140 is respectively connected to the corresponding lower electrode layer 137 and the upper electrode layer 139.

At least a part of the bump electrode 140 is provided on the surface of an elastic resin layer 148. The resin layer 148 is formed in a projection along the nozzle row direction on the first surface 141 of the sealing plate 160. The plurality of bump electrodes 140 which communicate with the lower electrode layer 137 (individual electrode) correspond to the piezoelectric elements 60 aligned in the nozzle row direction, and are formed along the nozzle row direction. Each of the bump electrodes 140 extends to any one of the piezoelectric element 60 side or a side opposite to the piezoelectric element 60 side from the upper part of the resin layer 148, and becomes a lower surface side wiring 147. In addition, the end portion opposite to the bump electrode 140 of the lower surface side wiring 147 is connected to a penetration wiring 145.

The plurality of bump electrodes 140 which correspond to the upper electrode layer 139 are formed on a lower surface side buried wiring 151 buried on the first surface 141 of the sealing plate 160 along the nozzle row direction. In addition, the bump electrodes 140 are formed to be the lower surface side wirings 147 which protrude on both sides in the width direction of the resin layer 148 from the upper part of the resin layer 148, and to be conductive with the lower surface side buried wiring 151. The plurality of bump electrodes 140 are formed along the nozzle row direction.

The sealing plate 160 and the pressure chamber forming board 129 are bonded to each other by a photosensitive adhesive 143 in a state where the bump electrode 140 is interposed therebetween. The photosensitive adhesives 143 are formed on both sides of each of the bump electrodes 140 in the direction orthogonal to the nozzle row direction. In addition, each of the photosensitive adhesives 143 is formed in a shape of a belt along the nozzle row direction in a state of being separated from the bump electrode 140.

On the second surface 142 of the sealing plate 160, a plurality of upper surface side buried wirings 150 which extend in the nozzle row direction are formed. Various positive voltage signals (the high power source voltage signal HVDD, the low power source voltage signal LVDD, the ground voltage signal GND, and the reference voltage signal VBS) and the driving signals COM-Ai and COM-Bi are supplied from the wiring board 400 (refer to FIG. 11) to the upper surface side buried wiring 150. On each of the upper surface side buried wirings 150, a plurality of bump electrodes 156 are formed along the nozzle row direction. At least a part of the bump electrode 156 is provided on the surface of an elastic resin layer 146. The resin layer 146 is formed in the projection which is along the nozzle row direction on the second surface 142 of the sealing plate 160. Each of the bump electrodes 156 is conductive to the wiring (not illustrated) on the inside of the driving IC 200 via a terminal (not illustrated) of the driving IC 200. In addition, on the second surface 142 of the sealing plate 160, a plurality of wirings (not illustrated) through which various control signals (the clock signal Sck, the printing data signals SI1 to SIn, the latch signals LAT1 to LATn, and the change signals CH1 to CHn) are supplied from the wiring board 400 are also formed, and the plurality of wirings are also conductive to the wiring on the inside of the driving IC 200 via the terminal of the driving IC 200.

Furthermore, in the region on both end sides on the second surface 142 of the sealing plate 160, a bump electrode 157 into which the output signal (driving signal) from the driving IC 200 is input, is formed. At least a part of the bump electrode 157 is provided on the surface of the elastic resin layer 154. The resin layer 154 is formed in the projection which is along the nozzle row direction on the second surface 142 of the sealing plate 160. In addition, the bump electrode 157 is connected to the corresponding lower surface side wiring 147 via the penetration wiring 145.

The penetration wiring 145 is a wiring which relays the signal between the first surface 141 and the second surface 142 of the sealing plate 160. By the penetration wiring 145, the bump electrode 157 and the lower surface side wiring 147 which extend from the corresponding bump electrode 140 are electrically connected to each other, and the driving signal from the driving IC 200 is transmitted to the pressure chamber forming board 129. In this manner, the sealing plate 160 functions as the relay board which relays the driving signal from the driving IC 200 to the pressure chamber forming board 129.

The driving IC 200 is an IC chip for driving the piezoelectric element 60, and is stacked on the second surface 142 of the sealing plate 160 via an adhesive 159. On the surface on the sealing plate 160 side of the driving IC 200, a plurality of input terminals (not illustrated) which are connected to each of the bump electrodes 156 are formed, and various positive voltage signals and the driving signals COM-Ai and COM-Bi are transmitted to each of the input terminals via the bump electrode 156 from the upper surface side buried wiring 150 provided on the sealing plate 160, or various control signals are transmitted from the plurality of wirings which are not illustrated. In addition, on the surface on the sealing plate 160 side of the driving IC 200, a plurality of output terminals (not illustrated) connected to each of the bump electrodes 157 are formed, and the signals (individual driving signals which drive each of the piezoelectric elements 60) from each of the output terminals are transmitted to each of the bump electrodes 157.

The driving IC 200 is a long chip which is extremely long in the nozzle row direction, and for example, the driving signals COM-Ai and COM-Bi which are transmitted to each of the input terminals are transmitted through a wiring of which the thickness or the width is small and the length is extremely long on the inside of the driving IC 200, and are supplied to each of the selection sections 230 (refer to FIG. 4) which outputs the individual driving signal Vout which drives each of the piezoelectric elements 60. Therefore, a resistance value between both ends of each of the inner wirings of the driving IC 200 is extremely large, the driving signals COM-Ai and COM-Bi which are transmitted through each of the inner wirings attenuate (the voltage level deteriorates) by receiving the influence of a voltage drop caused by a wiring resistance, and as a result, a malfunction is likely to occur as the selection section 230 becomes close to a terminal end. Here, the upper surface side buried wiring 150 of which the thickness or the width is sufficiently greater than that of the inner wiring of the driving IC 200 is also used as a reinforcing wiring of each of the inner wirings of the driving IC 200. In other words, each of the upper surface side buried wirings 150 is provided to be parallel to each of the inner wirings of the driving IC 200, and each of the signals is transmitted to each of the input terminals of the driving IC 200 via each of the upper surface side buried wirings 150 and the plurality of bump electrodes 156 formed along the nozzle row direction on each of the upper surface side buried wirings 150. Accordingly, for example, the voltage drop of the driving signals COM-Ai and COM-Bi which are supplied to each of the selection sections 230 is reduced, and the malfunction is unlikely to occur as the selection section 230 becomes close to the terminal end of the driving IC 200.

The bump electrodes 157 are formed in two rows on both sides of the bump electrode 156 corresponding to the row of the piezoelectric elements 60 aligned in two rows, and in the row of the bump electrode 157, an inter-center distance (that is, pitch) (pitch of the output terminals of the driving IC 200) of the bump electrodes 157 adjacent to each other is formed to be smaller than the pitch (pitch of the nozzle 122) of the bump electrode 140. In other words, the sealing plate 160 also achieves a role of absorbing a difference between the pitch of the output terminal of the driving IC 200 and the pitch of the nozzle 122, and accordingly, it is possible to reduce the size of the driving IC 200.

In addition, the driving module 20 formed as described above introduces the ink from an ink cartridge 22 to the pressure chamber 130 via an ink introduction path, the reservoir 118, the common liquid chamber 125, and the individual communication path 126. In this state, by supplying the driving signal from the driving IC 200 to the piezoelectric element 60 via each of the wirings formed in the sealing plate 160, the piezoelectric element 60 is driven and a pressure fluctuation is generated in the pressure chamber 130. By using the pressure fluctuation, the driving module 20 ejects the ink droplets from the nozzle 122 via the nozzle communication path 127.

In addition, the discharge section 600 (refer to FIG. 4) is configured of the piezoelectric element 60, the vibration plate 131, the pressure chamber 130, the individual communication path 126, the nozzle communication path 127, and the nozzle 122.

7. Configuration of Wiring Board

Figure 13:
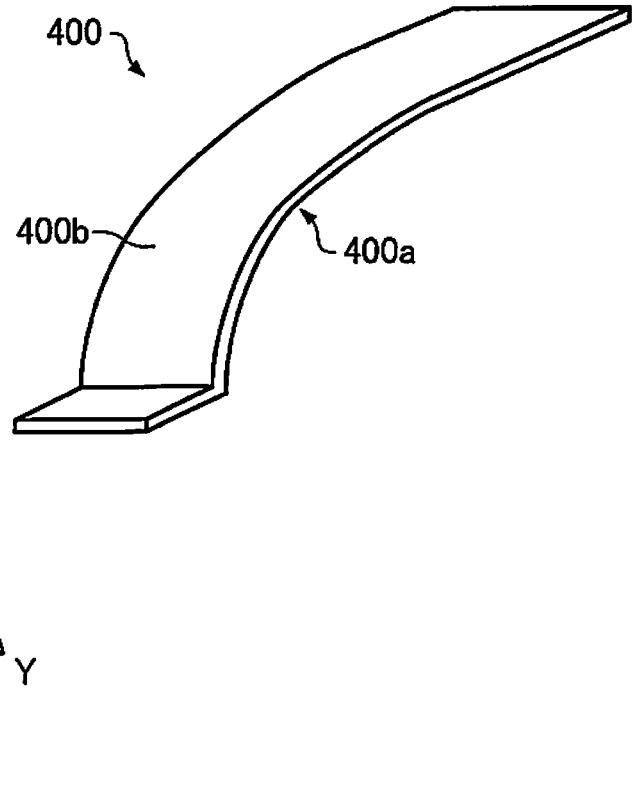
FIG. 13 is a perspective view of a wiring board.
Figure 14:
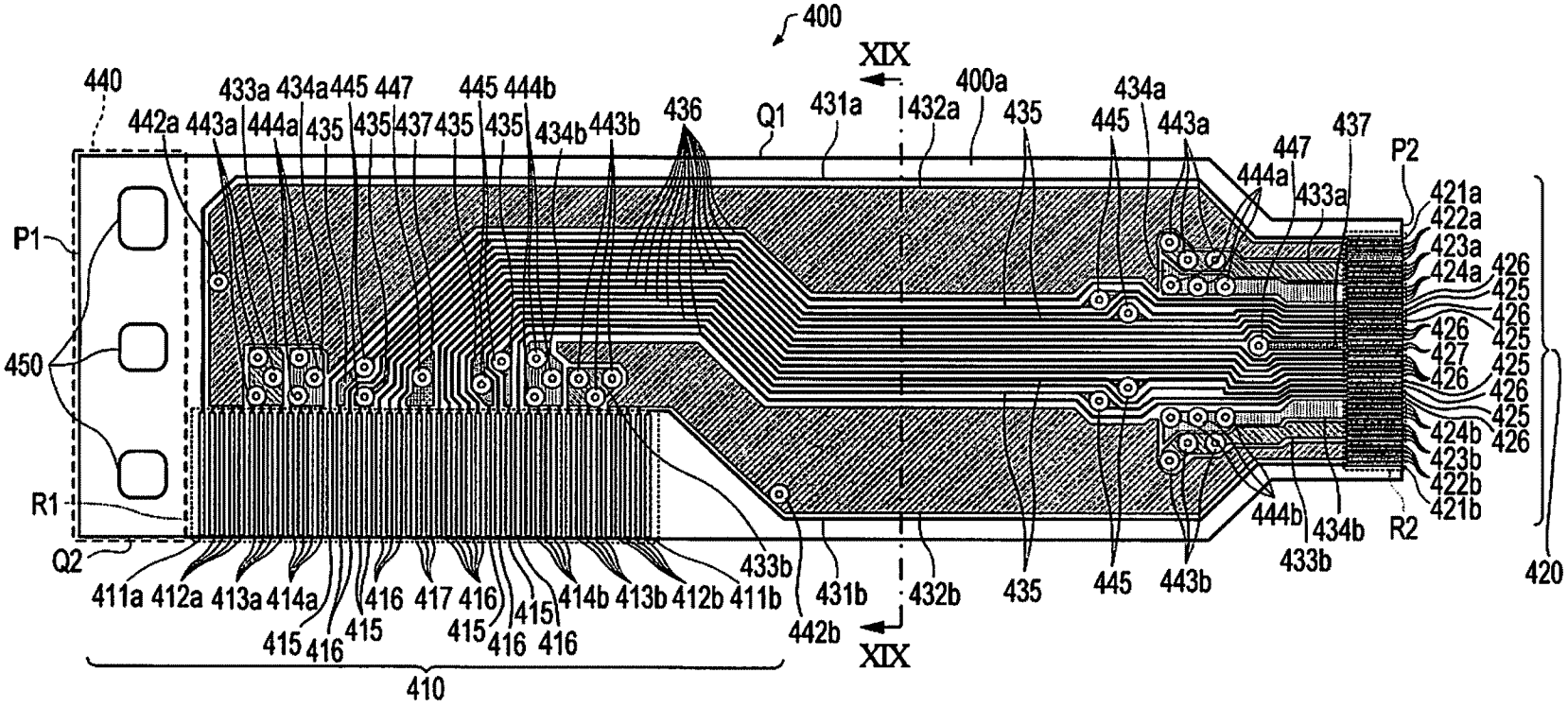
FIG. 14 is a plan view of a first surface of the wiring board.
Figure 15:
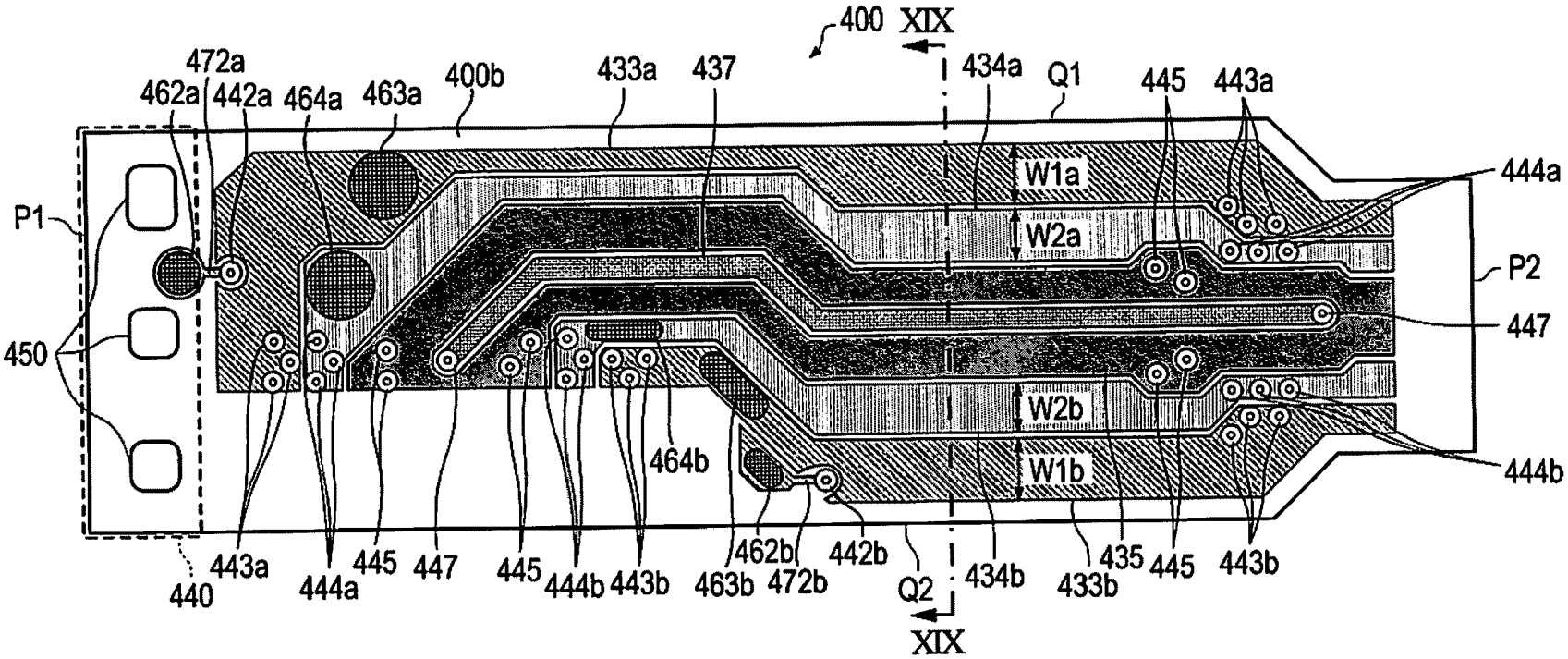
FIG. 15 is a plan view when a second surface of the wiring board is seen through from the first surface side.
Figure 16:
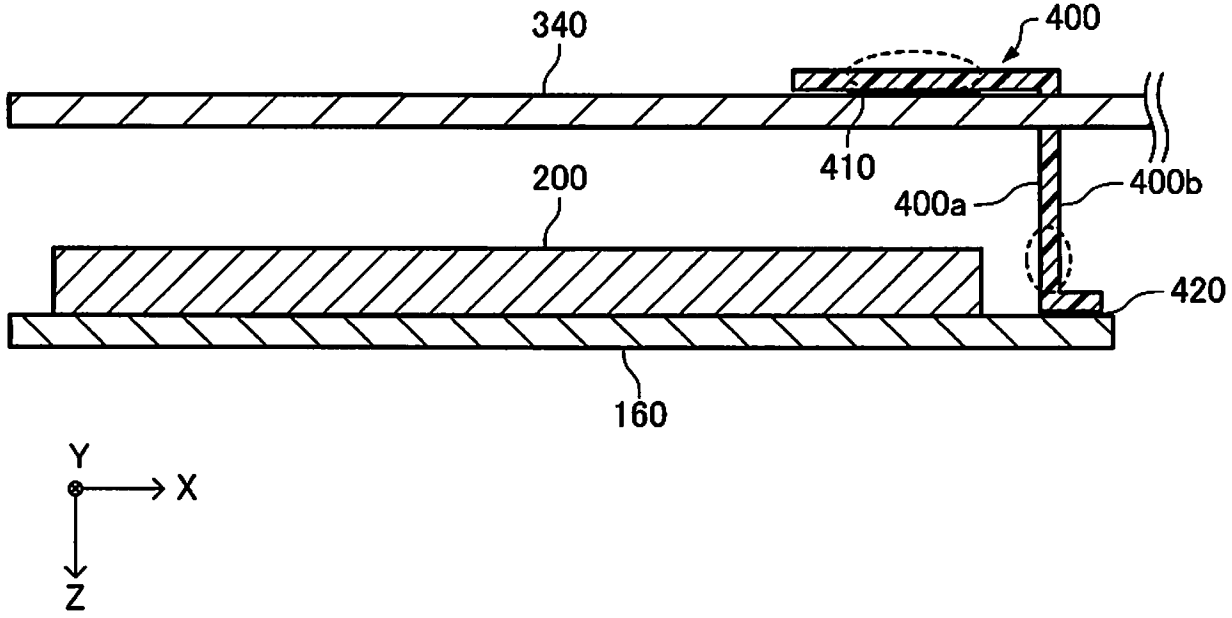
FIG. 16 is a view illustrating a state where the wiring board, and a relay board of the head unit and a sealing plate of the driving module, are connected to each other.
Figure 17:
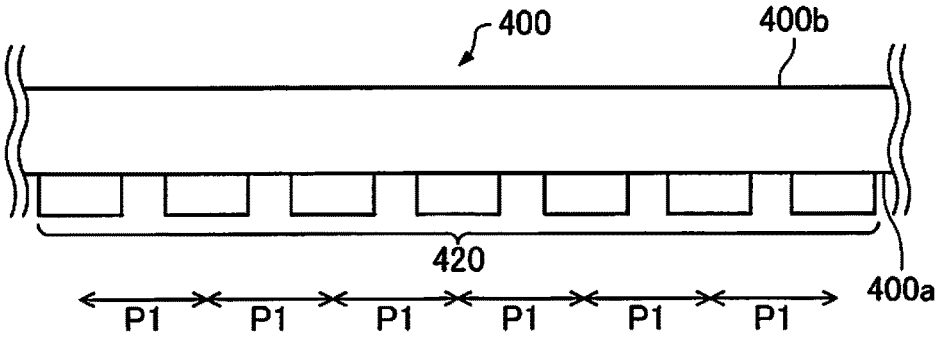
FIG. 17 is a side view when a part of an output terminal group of the wiring board is viewed from a short side.
Figure 18:
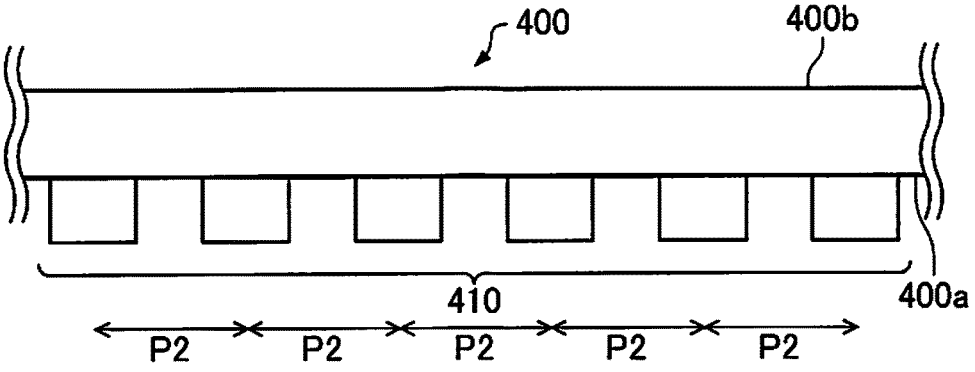
FIG. 18 is a side view when a part of an input terminal group of the wiring board is viewed from a long side.
Figure 19:
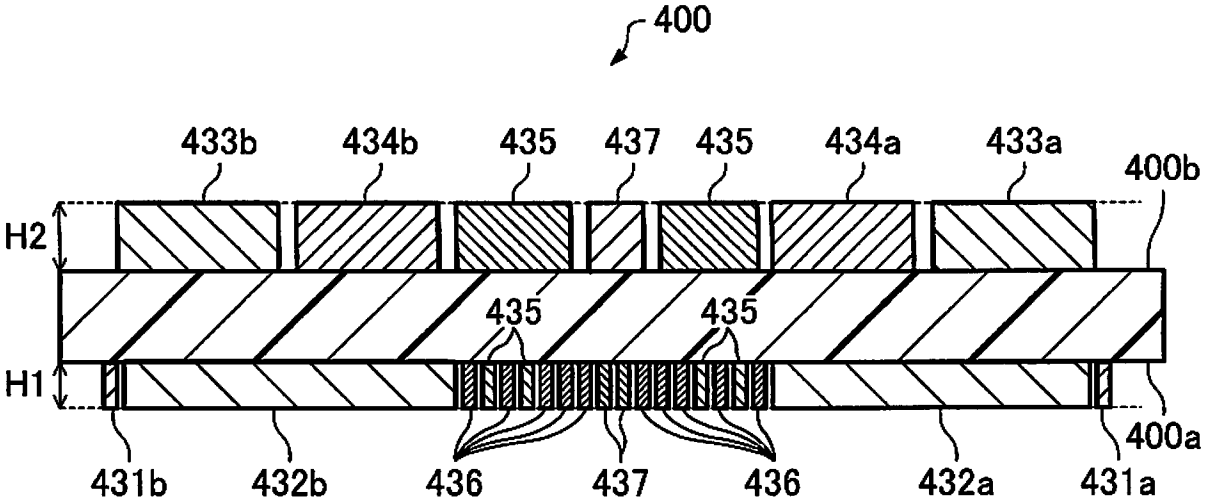
FIG. 19 is a sectional view when a section obtained by taking the wiring board along line XIX-XIX illustrated in FIGS. 14 and 15, viewed from the short side P2.

Next, a configuration of the wiring board 400 will be described with reference to FIGS. 13 to 19. FIG. 13 is a perspective view of the wiring board 400. FIG. 14 is a plan view of a first surface 400*a* of the wiring board 400. In addition, FIG. 15 is a plan view when a second surface 400*b* of the wiring board 400 is seen through from the first surface 400*a* side. In addition, FIG. 16 is a view illustrating a state where the wiring board 400, the relay board 340 (refer to FIG. 11) of the head unit 32, and the sealing plate 160 (refer to FIG. 12) of the driving module 20 are connected to each other. In addition, FIG. 17 is a side view when a part of an output terminal group 420 of the wiring board 400 is viewed from a short side P2 of the wiring board 400. In addition, FIG. 18 is a side view when a part of an input terminal group 410 of the wiring board 400 is viewed from a long side Q2 of the wiring board 400. In addition, FIG. 19 is a sectional view when a section obtained by cutting the wiring board 400 along line XIX-XIX illustrated in FIGS. 14 and 15 is viewed from the short side P2. In addition, (X, Y, Z) illustrated in FIGS. 13 and 16 correspond to "first direction X", "second direction Y", and "third direction Z" in FIGS. 1, 2, and 3. In addition, in FIGS. 17 and 18, each of transfer wirings is not illustrated.

As illustrated in FIG. 13, the wiring board 400 has high flexibility, and is easily bent. The wiring board 400 is a flexible print board made of a material, such as polyimide, a liquid crystal polymer, or a cycloolefin polymer, and wirings (not illustrated) are provided on both surfaces of the first surface 400*a* and the second surface 400*b*. In other words, the wiring board 400 is a flexible wiring board which includes two layers, such as the first surface 400*a* and the second surface 400*b* that opposes the first surface 400*a*, as the layer (wiring layer) on which the wiring is provided. In addition, although not illustrated in FIG. 13, the wiring board 400 has a through-hole (via) which electrically connects the first surface 400*a* and the second surface 400*b* to each other, and a part of the wiring provided on the first surface 400*a* and a part of the wiring provided on the second surface 400*b* are electrically connected to each other via the through-hole. In this manner, as the wiring board 400 is provided with the wirings on both of the surfaces, it is possible to have a size smaller than the board of a one-surface wiring, and it is advantageous to reduce the size of the head unit 32.

Although not seen in FIG. 13, on the first surface 400*a*, the input terminal group 410 and the output terminal group 420 are provided, and the first surface 400*a* side is connected to the relay board 340 (one example of "first board") and the sealing plate 160 (one example of "second board") of the driving module 20. In other words, in a state where the relay board 340 and the driving module 20 are connected to each other by the wiring board 400, while the first surface 400*a* is unlikely to be visually confirmed, the second surface 400*b* is easily visually confirmed.

As illustrated in FIG. 14, in a plan view of the wiring board 400, on the first surface 400*a* (one example of "first wiring layer") of the wiring board 400, the input terminal group 410 is provided along the long side Q2 (one example of "second side") of the wiring board 400. The input terminal group 410 includes input terminals 411*a* and 411*b* into which the high power source voltage signal HVDD is input, input terminals 412*a* and 412*b* (one example of "first input terminal") into which the reference voltage signal VBS is input, input terminals 413*a* and 413*b* (one example of "second input terminal") into which the driving signal COM-Ai (i is any number among 1 to n) (one example of "first driving signal") is input, input terminals 414*a* and 414*b* (one example of "second input terminal") into which the driving signal COM-Bi (one example of "second driving signal") is input, and an input terminal 415 into which the ground voltage signal GND (one example of "ground voltage signal") is input. In addition, the input terminal group 410 includes an input terminal 416 (one example of "control signal input terminal") into which various control signals (the clock signal Sck, the printing data signals SI1 to SIn, the latch signals LAT1 to LATn, and the change signals CH1 to CHn) are input, and an input terminal 417 (one example of "power source voltage signal input terminal") into which the low power source voltage signal LVDD (one example of "power source voltage signal") is input. Each of the input terminals included in the input terminal group 410 is connected to each of the output terminals (not illustrated) provided in the relay board 340 in a region R1 of the first surface 400*a* (refer to FIG. 16).

In addition, as illustrated in FIG. 14, on the first surface 400*a* of the wiring board 400, high power source voltage signal transfer wirings 431*a* and 431*b* which transfer the high power source voltage signal HVDD, reference voltage signal transfer wirings 432*a* and 432*b* which transfer the reference voltage signal VBS, first driving signal transfer wirings 433*a* and 433*b* which transfer the driving signal COM-Ai, and second driving signal transfer wirings 434*a* and 434*b* which transfer the driving signal COM-Bi, are provided. In addition, on the first surface 400*a* of the wiring board 400, a ground voltage signal transfer wiring 435 which transfers the ground voltage signal GND, a control signal transfer wiring 436 which transfers various control signals, and a low power source voltage signal transfer wiring 437 which transfers the low power source voltage signal LVDD, are provided.

The high power source voltage signal transfer wiring 431*a* is electrically connected to the input terminal 411*a*, and the high power source voltage signal transfer wiring 431*b* is electrically connected to the input terminal 411*b*. The reference voltage signal transfer wiring 432*a* (one example of "first wiring") is electrically connected to the input terminal 412*a*, and the reference voltage signal transfer wiring 432*b* (one example of "first wiring") is electrically connected to the input terminal 412*b*. The first driving signal transfer wiring 433*a* is electrically connected to the input terminal 413*a*, and the first driving signal transfer wiring 433*b* is electrically connected to the input terminal 413*b*. The second driving signal transfer wiring 434*a* is electrically connected to the input terminal 414*a*, and the second driving signal transfer wiring 434*b* is electrically connected to the input terminal 414*b*. The ground voltage signal transfer wiring 435 is electrically connected to the input terminal 415, the control signal transfer wiring 436 is electrically connected to the input terminal 416, and the low power source voltage signal transfer wiring 437 is electrically connected to the input terminal 417.

In addition, as illustrated in FIG. 14, in a plan view of the wiring board 400, on the first surface 400*a* of the wiring board 400, the output terminal group 420 is provided along the short side P2 (one example of "first side") different from the long side Q2 provided in the input terminal group 410. In other words, the input terminal group 410 and the output terminal group 420 are disposed on a surface which is the same as the wiring board 400. The output terminal group 420 includes output terminals 421*a* and 421*b* which output the high power source voltage signal HVDD, output terminals 422*a* and 422*b* (one example of "first output terminal") which output the reference voltage signal VBS, output terminals 423*a* and 423*b* (one example of "second output terminal") which output the driving signal COM-Ai, output terminals 424*a* and 424*b* (one example of "second output terminal") which outputs the driving signal COM-Bi, and an output terminal 425 which outputs the ground voltage signal GND. In addition, the output terminal group 420 includes an output terminal 426 (one example of "control signal output terminal") which outputs various control signals (the clock signal Sck, the printing data signals SI1 to SIn, the latch signals LAT1 to LATn, and the change signals CH1 to CHn), and the output terminal 427 (one example of "power source voltage signal output terminal") which outputs the low power source voltage signal LVDD. Each of the output terminals included in the output terminal group 420 is connected to each of the input terminals (not illustrated) provided in the sealing plate 160 of the driving module 20 in a region R2 of the first surface 400*a* (refer to FIG. 16).

In this manner, as the input terminal group 410 and the output terminal group 420 are disposed on the same surface of the wiring board 400, in the head unit 32 on which the relay board 340 and the sealing plate 160 are stacked, since the input terminal group 410 and the relay board 340 are connected to each other, and the output terminal group 420 and the sealing plate 160 are connected to each other, a space which is necessary for the connection becomes small, and the size of the wiring board 400 becomes small. Accordingly, a decrease in size of the head unit 32 is realized.

The output terminal 421*a* is electrically connected to the high power source voltage signal transfer wiring 431*a*, and outputs the high power source voltage signal HVDD to the driving module 20. In addition, the output terminal 421*b* is electrically connected to the high power source voltage signal transfer wiring 431*b*, and outputs the high power source voltage signal HVDD to the driving module 20. The output terminal 422*a* is electrically connected to the reference voltage signal transfer wiring 432*a*, and outputs the reference voltage signal VBS to the driving module 20. In addition, the output terminal 422*b* is electrically connected to the reference voltage signal transfer wiring 432*b*, and outputs the reference voltage signal VBS to the driving module 20. The output terminal 423*a* is electrically connected to the first driving signal transfer wiring 433*a*, and outputs the driving signal COM-Ai to the driving module 20. In addition, the output terminal 423*b* is electrically connected to the first driving signal transfer wiring 433*b*, and outputs the driving signal COM-Ai to the driving module 20. The output terminal 424*a* is electrically connected to the second driving signal transfer wiring 434*a*, and outputs the driving signal COM-Bi to the driving module 20. In addition, an output terminal 424*b* is electrically connected to the second driving signal transfer wiring 434*b*, and outputs the driving signal COM-Bi to the driving module 20. The output terminal 425 is electrically connected to the ground voltage signal transfer wiring 435, and outputs the ground voltage signal GND to the driving module 20. An output terminal 426 is electrically connected to the control signal transfer wiring 436, and outputs various control signals to the driving module 20. The output terminal 427 is electrically connected to the low power source voltage signal transfer wiring 437, and outputs the low power source voltage signal LVDD to the driving module 20.

The high power source voltage signal HVDD output from the output terminal 421*a*, the driving signal COM-Ai output from the output terminal 423*a*, and the driving signal COM-Bi output from the output terminal 424*a* are supplied to the selection section 230 which corresponds to each of the nozzles (discharge sections 600) included in one row (first nozzle row) of the two rows of nozzles provided in the driving module 20. In addition, the high power source voltage signal HVDD output from the output terminal 421*b*, and the driving signal COM-Ai output from the output terminal 423*b* and the driving signal COM-Bi output from the output terminal 424*b* are supplied to the selection section 230 which corresponds to each of the nozzles (discharge sections 600) included in the other row (second nozzle row) of the two rows of nozzles provided in the driving module 20. In other words, the output terminals 423*a* and 424*a* are electrically connected to one end (one example of "second end") of the piezoelectric element 60 included in each of the discharge sections 600 provided corresponding to the first nozzle row, and the output terminals 423*b* and 424*b* are electrically connected to one end (one example of "second end") of the piezoelectric element 60 included in each of the discharge sections 600 provided corresponding to the second nozzle row.

The reference voltage signal VBS output from the output terminal 422*a* is supplied to the discharge section 600 which discharges the liquid from each of the nozzles included in the first nozzle row. In addition, the reference voltage signal VBS output from the output terminal 422*b* is supplied to the discharge section 600 which discharges the liquid from each of the nozzles included in the second nozzle row. In other words, the output terminal 422*a* is electrically connected to the other end (one example of "first end") of the piezoelectric element 60 included in each of the discharge sections 600 provided corresponding to the first nozzle row, and the output terminal 422*b* is electrically connected to the other end (one example of "first end") of the piezoelectric element 60 included in each of the discharge sections 600 provided corresponding to the second nozzle row.

All of the ground voltage signal GND output from the output terminal 425, various control signals output from the output terminal 426, and the low power source voltage signal LVDD output from the output terminal 427, are commonly supplied to the selection control section 220.

Each of the transfer wirings is, for example, a wiring (copper plate wiring) formed by copper plating, and is covered with a resist (protection film). In addition, each of the input terminals included in the input terminal group 410 and each of the input terminals included in the output terminal group 420 are not covered with a resist, and for example, a part of a transfer wiring formed by copper plating is further formed by gold plating. In this manner, since each of the transfer wirings, each of the input terminals, and each of the output terminals do not use hard metal, such as nickel, as a material, and thus, has high flexibility, and contributes to connecting the relay board 340 and the driving module 20 to each other while saving space.

As illustrated in FIG. 15, on the second surface 400*b* (one example of "second wiring layer") of the wiring board 400, the first driving signal transfer wirings 433*a* and 433*b* which transfer the driving signal COM-Ai, the second driving signal transfer wirings 434*a* and 434*b* which transfer the driving signal COM-Bi, the ground voltage signal transfer wiring 435 (one example of "ground voltage signal transfer wiring") which transfers the ground voltage signal GND, and the low power source voltage signal transfer wiring 437 (one example of "power source voltage signal transfer wiring") which transfers the low power source voltage signal LVDD, are provided.

The first driving signal transfer wirings 433*a* and 433*b* provided on the second surface 400*b* are respectively connected to the first driving signal transfer wirings 433*a* and 433*b* which are provided on the first surface 400*a* via through-holes 443*a* and 443*b*. Therefore, the first driving signal transfer wiring 433*a* (one example of "second wiring" and "driving signal transfer wiring") provided on the second surface 400*b* and the input terminal 413*a* and the output terminal 423*a* which are provided on the first surface 400*a*, are electrically connected to each other via the through-hole 443*a*, the first driving signal transfer wiring 433*b* (one example of "second wiring" and "driving signal transfer wiring") which are provided on the second surface 400*b*, and the input terminal 413*b* and the output terminal 423*b* which are provided on the first surface 400*a*, are electrically connected to each other via the through-hole 443*b*. Similarly, the second driving signal transfer wirings 434*a* and 434*b* (one example of "second wiring" and "driving signal transfer wiring") which are provided on the second surface 400*b* are respectively connected to the second driving signal transfer wirings 434*a* and 434*b* which are provided on the first surface 400*a* via through-holes 444*a* and 444*b*. Therefore, the second driving signal transfer wiring 434*a* provided on the second surface 400*b*, and the input terminal 414*a* and the output terminal 424*a* which are provided on the first surface 400*a*, are electrically connected to each other via the through-hole 444*a*, and the second driving signal transfer wiring 434*b* provided on the second surface 400*b*, and the input terminal 414*b* and the output terminal 424*b* provided on the first surface 400*a* are electrically connected to each other via the through-hole 444*b*. Similarly, the ground voltage signal transfer wiring 435 and the low power source voltage signal transfer wiring 437 which are provided on the second surface 400*b* are respectively connected to the ground voltage signal transfer wiring 435 and the low power source voltage signal transfer wiring 437 which are provided on the first surface 400*a* via the through-holes 445 and 447. Therefore, the ground voltage signal transfer wiring 435 provided on the second surface 400*b* and the input terminal 415 and the output terminal 425 provided on the first surface 400*a* are electrically connected to each other via the through-hole 445, the low power source voltage signal transfer wiring 437 provided on the second surface 400*b*, and the input terminal 417 and the output terminal 427 which are provided on the first surface 400*a* are electrically connected to each other via the through-hole 447.

As illustrated in FIGS. 14 and 15, the through-hole 443*a* is provided in the vicinity of the input terminal 413*a* or the output terminal 423*a*, and the through-hole 443*b* is provided in the vicinity of the input terminal 413*b* or the output terminal 423*b*. Similarly, the through-hole 444*a* is provided in the vicinity of the input terminal 414*a* or the output terminal 424*a*, and the through-hole 444*b* is provided in the vicinity of the input terminal 414*b* or the output terminal 424*b*. Similarly, the through-hole 445 is provide in the vicinity of the input terminal 415 or the output terminal 425, and the through-hole 447 is provided in the vicinity of the input terminal 417 or the output terminal 427. In other words, each of the through-holes is provided in the vicinity of the input terminal group 410 or the output terminal group 420, and is not provided in the vicinity of the center of the wiring board 400. Accordingly, areas of each of the first driving signal transfer wirings 433*a* and 433*b* provided on the second surface 400*b* of the wiring board 400, the second driving signal transfer wirings 434*a* and 434*b*, and the ground voltage signal transfer wirings 435 and the low power source voltage signal transfer wiring 437 increase, the wiring impedance of each of the transfer wirings is reduced.

In addition, in the wiring board 400, a part near the regions R1 and R2 in which the input terminal group 410 and the output terminal group 420 are respectively connected to each other, is bent in a state (refer to FIG. 16) where the input terminal group 410 and the output terminal group 420 are respectively connected to the relay board 340 and the sealing plate 160. In the embodiment, since each of the through-holes provided in the wiring board 400 is provided in the region (a region illustrated by a dotted line in FIG. 16) in which the wiring board 400 is not bent, an external load caused by the bending may not be placed on each of the through-holes. Therefore, a concern about generation of a discharge defect, such as disconnection or a short circuit of a conductor in each of the through-holes, is reduced.

With reference to FIGS. 14 and 15, in the embodiment, the wiring which transfers various signals is provided by dividing the surface into both surfaces of the first surface 400*a* and the second surface 400*b* of the wiring board 400. In particular, the first driving signal transfer wirings 433*a* and 433*b* and the second driving signal transfer wirings 434*a* and 434*b* are provided on the second surface 400*b* different from the first surface 400*a* provided in the reference voltage signal transfer wirings 432*a* and 432*b* which require a large area for allowing a large electric current to flow. Accordingly, areas of the first driving signal transfer wirings 433*a* and 433*b* and the second driving signal transfer wirings 434*a* and 434*b* are sufficiently ensured, the wiring impedance is reduced, and a concern about deterioration of transfer accuracy of the driving signals COM-Ai and COM-Bi is reduced.

Furthermore, in the embodiment, the reference voltage signal transfer wiring 432*a* is provided in a region which opposes the region of the second surface 400*b* provided in the first driving signal transfer wiring 433*a* and the second driving signal transfer wiring 434*a* on the first surface 400*a*. Similarly, on the first surface 400*a*, the reference voltage signal transfer wiring 432*b* is provided in the region which opposes the region of the second surface 400*b* provided in the first driving signal transfer wiring 433*b* and the second driving signal transfer wiring 434*b*. In other words, the reference voltage signal transfer wiring 432*a* opposes both of the first driving signal transfer wiring 433*a* and the second driving signal transfer wiring 434*a*, and the reference voltage signal transfer wiring 432*b* opposes both of the first driving signal transfer wiring 433*b* and the second driving signal transfer wiring 434*b*. In each of the piezoelectric elements 60 included in the driving module 20-*i*, the driving signal COM-Ai and the driving signal COM-Bi are applied to one end, and the reference voltage signal VBS is applied to the other end. Therefore, the electric current path in which a large electric current flows in an order of the first driving signal transfer wiring 433*a* or the second driving signal transfer wiring 434*a* (or the first driving signal transfer wiring 433*b* or the second driving signal transfer wiring 434*b*), each of the piezoelectric elements 60, and the reference voltage signal transfer wiring 432*a* (or the reference voltage signal transfer wiring 432*b*), or in a reverse order, exists. In the embodiment, the first driving signal transfer wiring 433*a* and the second driving signal transfer wiring 434*a*, and the reference voltage signal transfer wiring 432*a*, are provided to oppose each other, the first driving signal transfer wiring 433*b* and the second driving signal transfer wiring 434*b*, and the reference voltage signal transfer wiring 432*b*, are provided to oppose each other, and thus, each of the electric current paths becomes short, and the wiring impedance of each of the electric current paths is reduced. In addition, for example, in the first driving signal transfer wirings 433*a* and 433*b* and the second driving signal transfer wirings 434*a* and 434*b*, in a case where the electric current flows in a direction toward the short side P2 from a short side P1 of the wiring board 400, the electric current flows in a direction toward the short side P1 from the short side P2 of the wiring board 400 in the reference voltage signal transfer wirings 432*a* and 432*b*. In other words, the electric current that flows through the first driving signal transfer wiring 433*a* and the second driving signal transfer wiring 434*a* and the electric current that flows the reference voltage signal transfer wiring 432*a* have direction different from each other, and have substantially the same total amount. Therefore, a magnetic field generated by the electric current that flows through the first driving signal transfer wiring 433*a* and the second driving signal transfer wiring 434*a*, and a magnetic field generated by the electric current that flows through the reference voltage signal transfer wiring 432*a*, offset each other. Because of the same reason, a magnetic field generated by the electric current that flows through the first driving signal transfer wiring 433*b* and the second driving signal transfer wiring 434*b*, and a magnetic field generated by the electric current that flows through the reference voltage signal transfer wiring 432*b*, offset each other. Accordingly, the wiring impedance of each of the electric current paths is further reduced. Furthermore, since a relative relationship of a position or a distance between the first driving signal transfer wiring 433*a* and the second driving signal transfer wiring 434*a*, and the reference voltage signal transfer wiring 432*a*, or a relative relationship of a position or a distance between the first driving signal transfer wiring 433*b* and the second driving signal transfer wiring 434*b*, and the reference voltage signal transfer wiring 432*b*, are the same as each other, a variation of transfer accuracy of the driving signals COM-Ai and COM-Bi is reduced.

In addition, in the embodiment, a large part of the first driving signal transfer wirings 433*a* and 433*b* and the second driving signal transfer wirings 434*a* and 434*b* is provided on the second surface 400*b* different from the first surface 400*a* on which the input terminal group 410 and the output terminal group 420 are provided. When the size of the driving module 20 is reduced, in the sealing plate 160, there is a possibility that a large area of the region to which the output terminal group 420 of the wiring board 400 is connected cannot be ensured. Therefore, in the embodiment, the plurality of output terminals included in the output terminal group 420 of the wiring board 400 are arranged at a narrow pitch, and the connection with the sealing plate 160 of the driving module 20 of which the size is reduced is possible. Meanwhile, the area of the relay board 340 is greater than the area of the sealing plate 160, and a large area of the region to which the input terminal group 410 of the wiring board 400 is connected is likely to be ensured. Therefore, in the embodiment, as illustrated in FIGS. 17 and 18, the pitch of the plurality of input terminals included in the input terminal group 410 is wider than the pitch of the plurality of output terminals included in the output terminal group 420. Therefore, the pitch of the plurality of input terminals 412*a* is wider than the pitch of the plurality of output terminals 423*a*, and the pitch of the plurality of input terminals 412*b* is wider than the pitch of the plurality of output terminals 423*b*. In addition, the pitch of the plurality of input terminals 413*a* and the pitch of the plurality of input terminals 414*a* are respectively wider than the pitch of the plurality of output terminals 423*a* and the pitch of the plurality of output terminals 424*a*, and the pitch of the plurality of input terminals 413*b* and the pitch of the plurality of input terminals 414*b* are respectively der than the pitch of the plurality of output terminals 423*b* and the plurality of output terminals 424*b*. In this manner, in the embodiment, in the wiring board 400, since the pitch of the input terminal group 410 is greater than the pitch of the output terminal group 420, appropriate connection between the input terminal group 410 and the relay board 340 is reliably and easily ensured.

In addition, in the sealing plate 160, since a wide area of the region to which the output terminal group 420 of the wiring board 400 is connected can be ensured, the short side P2 on which the output terminal group 420 of the wiring board 400 is provided cannot be shortened. Then, when the wiring board 400 has a constant width which is the same as the length of the short side P2, it is difficult to widen the width of each of the transfer wirings. Here, in the embodiment, except for the vicinity of the output terminal group 420, the width (a distance between a long side Q1 and the long side Q2) of the wiring board 400 is greater than the length of the short side P2. Accordingly, as illustrated in FIG. 14, on the first surface 400*a* of the wiring board 400, the width of the reference voltage signal transfer wirings 432*a* and 432*b* is wider than the vicinity of the short side P2 between the long side Q1 and the long side Q2. Similarly, as illustrated in FIG. 15, on the second surface 400*b* of the wiring board 400, the widths of each of the first driving signal transfer wirings 433*a* and 433*b* and the second driving signal transfer wirings 434*a* and 434*b* is wider than the vicinity of the short side P2 between the long side Q1 and the long side Q2. Therefore, the wiring impedance of each of the reference voltage signal transfer wirings 432*a* and 432*b* through which a large electric current flows, the first driving signal transfer wirings 433*a* and 433*b*, and the second driving signal transfer wirings 434*a* and 434*b*, is reduced.

In addition, on the first surface 400*a* of the wiring board 400, the input terminal group 410 and the output terminal group 420 are provided, and particularly, the plurality of output terminals included in the output terminal group 420 are arranged at a narrow pitch, and thus, the interval of the terminals or the wirings becomes extremely narrow. Then, due to the limits of processing accuracy of the terminal or the wiring, the wiring cannot be thin on the first surface 400*a* of the wiring board 400. Meanwhile, since the terminal is not provided on the second surface 400*b* of the wiring board 400, a restriction of the minimum wiring interval is small, and the first surface 400*a* and the relatively thick wiring can be formed. Therefore, in the embodiment, as illustrated in FIG. 19, on the wiring board 400, a thickness H2 of the transfer wirings 433*a*, 433*b*, 434*a*, 434*b*, 435, and 437 which are provided on the second surface 400*b* is greater than a thickness H1 of the transfer wirings 431*a*, 431*b*, 432*a*, 432*b*, 435, 436, and 437 which are provided on the first surface 400*a*. Therefore, the first driving signal transfer wirings 433*a* and 433*b* and the second driving signal transfer wirings 434*a* and 434*b* which are provided on the second surface 400*b* are thicker than the reference voltage signal transfer wirings 432*a* and 432*b* provided on the first surface 400*a*. In addition, in the embodiment, as a large part of the first driving signal transfer wirings 433*a* and 433*b* and the second driving signal transfer wirings 434*a* and 434*b* is provided on the second surface 400*b*, the first driving signal transfer wirings 433*a* and 433*b* and the second driving signal transfer wirings 434*a* and 434*b* can be thick, and thus, the wiring impedance is reduced.

In addition, with reference to FIG. 15, in the embodiment, on the second surface 400*b* of the wiring board 400, the first driving signal transfer wiring 433*a* is provided closer to the end side (long side Q1) of the wiring board 400 than the second driving signal transfer wiring 434*a*. Similarly, on the second surface 400*b*, the first driving signal transfer wiring 433*b* is provided closer to the end side (long side Q2) of the wiring board 400 than the second driving signal transfer wiring 434*b*. Since the amplitude of the driving signal COM-Ai is greater than that of the driving signal COM-Bi (refer to FIG. 5), in the embodiment, the first driving signal transfer wirings 433*a* and 433*b* are provided in the region separated from the ground voltage signal transfer wiring 435 and the low power source voltage signal transfer wiring 437, and accordingly, it is possible to reduce influence of noise radiated from the first driving signal transfer wirings 433*a* and 433*b* on the ground voltage signal GND and the low power source voltage signal LVDD.

In addition, with reference to FIG. 15, in the embodiment, in a plan view of the second surface 400*b* of the wiring board 400, the width of the first driving signal transfer wiring 433*a* is different from the width of the second driving signal transfer wiring 434*a*, and the width of the first driving signal transfer wiring 433*b* is different from the width of the second driving signal transfer wiring 434*b*. Specifically, in a plan view of the second surface 400*b* of the wiring board 400, a width (the maximum width W1*a*) of the first driving signal transfer wiring 433*a* is greater than a width (the maximum width W2*a*) of the second driving signal transfer wiring 434*a*. Similarly, in a plan view of the second surface 400*b*, a width (the maximum width W1*b*) of the first driving signal transfer wiring 433*b* is greater than a width (the maximum width W2*b*) of the second driving signal transfer wiring 434*b*. More specifically, on the second surface 400*b*, between the long side Q1 and the long side Q2, in a region in which the first driving signal transfer wirings 433*a* and 433*b*, the second driving signal transfer wirings 434*a* and 434*b*, the ground voltage signal transfer wiring 435, and the low power source voltage signal transfer wiring 437 run in parallel, the maximum widths W1*a* and W1*b* of the first driving signal transfer wirings 433*a* and 433*b* are greater than the maximum widths W2*a* and W2*b* of the second driving signal transfer wirings 434*a* and 434*b*. In other words, in the embodiment, since the wirings run in parallel, even when the widths of each of the transfer wirings becomes small, the wiring impedance of the first driving signal transfer wirings 433*a* and 433*b* through which a relatively large electric current flows is reduced. Accordingly, a concern about deterioration of transfer accuracy of the driving signals COM-Ai and COM-Bi is reduced.

As described above, since the wiring impedance of each of the reference voltage signal transfer wirings 432*a* and 432*b*, and the first driving signal transfer wirings 433*a* and 433*b* and the second driving signal transfer wirings 434*a* and 434*b* is reduced, the heat generation amount caused by the large electric currents that flow through each of the transfer wirings is reduced, and a temperature rise of the wiring board 400 is reduced, and thus, the wiring board 400 is unlikely to be damaged. In addition, in the head unit 32, since a heat amount transmitted to the driving module 20 from the wiring board 400 is small, a temperature gradient (a temperature deviation of each of the discharge sections 600) in the driving module 20 is small, and further, a concern about deterioration of transfer accuracy of the driving signals COM-Ai and COM-Bi is also reduced, and thus, discharge accuracy of the liquid is improved.

In addition, as illustrated in FIG. 14, in the embodiment, on the first surface 400*a*, the control signal transfer wiring 436 is provided in a region which does not oppose the region of the second surface 400*b* on which the first driving signal transfer wirings 433*a* and 433*b* and the second driving signal transfer wirings 434*a* and 434*b* are provided. Accordingly, since influence of noise radiated from the first driving signal transfer wirings 433*a* and 433*b* and the second driving signal transfer wirings 434*a* and 434*b* on various control signals is reduced, and thus, a concern about deterioration of transfer accuracy of the control signal is reduced.

In addition, in the embodiment, on the first surface 400*a*, between the reference voltage signal transfer wirings 432*a* and 432*b* and the control signal transfer wiring 436, the ground voltage signal transfer wiring 435 is provided. Therefore, various control signals transferred by the control signal transfer wiring 436 are guarded by the ground voltage signal transfer wiring 435, the influence of noise from the reference voltage signal transfer wirings 432*a* and 432*b* on various control signals is reduced, and thus, a concern about deterioration of transfer accuracy of the control signal is reduced. In addition, the low power source voltage signal transfer wiring 437 is provided between the reference voltage signal transfer wirings 432*a* and 432*b* and the control signal transfer wiring 436 such that the control signal is guarded.

Furthermore, in the embodiment, on the first surface 400*a*, the control signal transfer wiring 436 is provided in the region which opposes the region of the second surface 400*b* in which the ground voltage signal transfer wiring 435 or the low power source voltage signal transfer wiring 437 is provided. Accordingly, since various control signals are guarded by the ground voltage signal transfer wiring 435 and the low power source voltage signal transfer wiring 437 which have a constant voltage, a concern about deterioration of transfer accuracy of the control signal is further reduced.

In addition, as illustrated in FIG. 15, on the second surface 400*b* of the wiring board 400, the first driving signal transfer wiring 433*a* and the second driving signal transfer wiring 434*a* are provided closer to the end side (long side Q1) of the wiring board 400 than the ground voltage signal transfer wiring 435 or the low power source voltage signal transfer wiring 437. Similarly, on the second surface 400*b* of the wiring board 400, the first driving signal transfer wiring 433*b* and the second driving signal transfer wiring 434*b* are provided closer to the end side (long side Q2) of the wiring board 400 than the ground voltage signal transfer wiring 435 or the low power source voltage signal transfer wiring 437. Accordingly, n the wiring board 400, by the ground voltage signal transfer wiring 435 or the low power source voltage signal transfer wiring 437, various control signals are guarded against the noise radiated from each of the first driving signal transfer wirings 433*a* and 433*b* in which a large electric current flows and the second driving signal transfer wirings 434*a* and 434*b*.

In addition, as illustrated in FIGS. 14 and 15, in the embodiment, the reference voltage signal transfer wiring 432*a*, the first driving signal transfer wiring 433*a*, and the second driving signal transfer wiring 434*a* are provided closer to the end side (long side Q1) of the wiring board 400 than the control signal transfer wiring 436. Similarly, the reference voltage signal transfer wiring 432*b*, the first driving signal transfer wiring 433*b*, and the second driving signal transfer wiring 434*b* are provided closer to the end side (long side Q2) of the wiring board 400 than the control signal transfer wiring 436. In this manner, on the wiring board 400, since the reference voltage signal transfer wirings 432*a* and 432*b*, the first driving signal transfer wirings 433*a* and 433*b*, and the second driving signal transfer wirings 434*a* and 434*b* of which a heat generation amount is large since a large electric current flows therethrough, are provided closer to the end side than the control signal transfer wiring 436 of which the heat generation amount is small, the heat generation locations on the wiring board 400 are dispersed, and the maximum temperature of the wiring board 400 can be small.

Accordingly, the wiring board is unlikely to be damaged, the temperature gradient in the driving module 20 is reduced, and the discharge accuracy of the liquid is improved.

In addition, as illustrated in FIG. 14, the plurality of input terminals which are included in the input terminal group 410 and are aligned in order in a direction toward the short side P2 from the short side P1, and the plurality of output terminals which are included in the output terminal group 420 and are aligned in order in a direction toward the long side Q2 from the long side Q1, are respectively electrically connected to each other. In other words, the alignment of the input terminals into which various signals in the input terminal group 410 are input and the alignment of the output terminals from which various signals are output in the output terminal group 420, are the same as each other. In other words, on the wiring board 400, the plurality of wirings through which various signals are transferred are provided not to intersect with each other, and contribute to reducing the size of the wiring board 400.

In addition, the number of input terminals included in the input terminal group 410 and the number of output terminals included in the output terminal group 420 may be different from each other. For example, it is required that the wiring impedance of the first driving signal transfer wirings 433*a* and 433*b* or the second driving signal transfer wirings 434*a* and 434*b* is an appropriate wiring width (wiring impedance) which corresponds to the electric current amount. Meanwhile, as described above, the pitch of the plurality of input terminals included I the input terminal group 410 is wider than the pitch of the plurality of output terminals included in the output terminal group 420. Therefore, in order to sufficiently ensure the wiring width on the output terminal side of the first driving signal transfer wirings 433*a* and 433*b* or the second driving signal transfer wirings 434*a* and 434*b*, the number of output terminals 423*a* and 423*b* may be greater than the number of input terminals 413*a* and 413*b*.

In addition, as illustrated in FIGS. 14 and 15, the control signal transfer wiring 436 is provided on the first surface 400*a* provided with the input terminal group 410 and the output terminal group 420, and the ground voltage signal transfer wiring 435 or the low power source voltage signal transfer wiring 437 are provided on the second surface 400*b*. accordingly, since the wiring region on the first surface 400*a* and the wiring region of the second surface 400*b* are ensured with excellent balance, it is advantageous in reducing the size of the wiring board 400. Furthermore, in the embodiment, the sum (10 in FIGS. 14 and 15) of the total number (8 in FIGS. 14 and 15) of the through-hole 445 which corresponds to the ground voltage signal transfer wiring 435 and the total number (2 in FIGS. 14 and 15) of the through-hole 447 which corresponds to the low power source voltage signal transfer wiring 437 is equal to or less than two times (24 in FIGS. 14 and 15) the number of control signal transfer wirings 436, and is equal to or less than two times (12 in FIGS. 14 and 15) the total number of output terminals 425 and 427 (or the input terminals 415 and 417). The through-holes 445 and 447 are necessary respectively on the input terminal side and on the output terminal side, but when the total number of through-holes 445 and 447 is equal to or less than two times the number of control signal transfer wirings 436, the total number of the through-holes 445 and 447 on the input terminal side or on the output terminal side is equal to less than the number of control signal transfer wirings 436. Then, as described in the embodiment, since the necessary area of the wiring region in a case where the ground voltage signal transfer wiring 435 and the low power source voltage signal transfer wiring 437 on the second surface 400*b* is smaller than the area of the wiring region in a case where each of the control signal transfer wirings 436 is provided on the second surface 400*b* via the through-hole, it is advantageous in reducing the size of the wiring board 400. In addition, when the total number of through-holes 445 and 447 is equal to or less than two times the total number of output terminals 425 and 427 (or the input terminals 415 and 417), the total number of through-holes 445 and 447 on the output terminal side (or the input terminal side) is equal to or less than the total number of output terminals 425 and 427 (or the input terminals 415 and 417). Accordingly, a region necessary for the through-hole 445 and 447 is limited, and it is advantageous to reduce the size of the wiring board 400.

In addition, by reducing the size of the wiring board 400, it is possible to connect the relay board 340 and the sealing plate 160 of the driving module 20 of which the size is reduced to each other by the wiring board 400, and the small size of the head unit 32 is realized.

In addition, with reference to FIGS. 14 and 15, on the wiring board 400, a gripping section 440 for adjusting a connection position is provided at a position separated from the input terminal group 410 and the output terminal group 420. Specifically, the gripping section 440 is provided in the region in which the transfer wiring does not exist, along the short side P1 which opposes the short side P2 of the wiring board 400. In addition, in the gripping section 440, an opening section 450 which penetrates the first surface 400*a* and the second surface 400*b*, is provided. In the embodiment, after the output terminal group 420 provided on the first surface 400*a* of the wiring board 400 is connected to the input terminal group provided on the sealing plate 160 of the driving module 20, the input terminal group 410 provided on the first surface 400*a* of the wiring board 400 is connected to the output terminal group provided on the relay board 340. Therefore, it is possible to perform fine adjustment of the connection position by using an adjustment tool in the opening section 450 such that the input terminal group 410 of the wiring board 400 is appropriately connected to the output terminal group of the relay board 340. At this time, since the short side P2 of the wiring board 400 is fixed to the sealing plate 160, while it is difficult to finely adjust shift in the direction toward the long side Q2 from the long side Q1 of the connection position of the input terminal group 410 by using the adjustment tool, it is relatively easy to finely adjust the shift in the direction toward the short side P2 from the short side P1 of the connection position.

Here, in the embodiment, the input terminal group 410 is provided on the long side Q2 which does not oppose the short side P2 provided in the output terminal group 420. In other words, on the wiring board 400, the plurality of input terminals included in the input terminal group 410 are aligned in one row in an orientation different from the direction in which the plurality of output terminals included in the output terminal group 420 are aligned in one row (that is, an orientation which is not parallel), for example, in an orthogonal direction, and each of the transfer wirings in which each of the input terminals and each of the output terminals are electrically connected to each other has a bent shape. Therefore, in a state where the short side P2 of the wiring board 400 is fixed to the sealing plate 160, in a case where the connection position of the input terminal group 410 is shifted in the direction (long side direction) toward the short side P2 from the short side P1, it is possible to perform correction at an appropriate connection position by performing the fine adjustment by using the adjustment tool. Meanwhile, even when the connection position of the input terminal group 410 is shifted in the direction toward the long side Q2 from the long side Q1, since each of the input terminals included in the input terminal group 410 is shifted in the short side direction, an appropriate connection state is ensured, and it is necessary to finely adjust the connection position.

In addition, in FIGS. 14 and 15, the opening section 450 is provided in the gripping section 440 for the position adjustment, but the opening section 450 may not be provided. In this case, the fine adjustment of the connection position may be performed by gripping the gripping section 440 by using the adjustment tool. In addition, in the gripping section 440, a mark for positioning is given on the second surface 400*b* of the wiring board 400, and the fine adjustment of the connection position may be performed such that the mark for positioning and the predetermined position of the relay board 340 match each other.

In the embodiment, as illustrated in FIG. 15, in order to inspect whether or not the connection position between the wiring board 400, and the relay board 340 and the sealing plate 160 of the driving module 20 is appropriate, on the second surface 400*b* of the wiring board 400, test pads 462*a*, 462*b*, 463*a*, 463*b*, 464*a*, and 464*b* for connection inspection are provided at positions separated from the input terminal group 410 and the output terminal group 420. On the second surface 400*b* of the wiring board 400, conductive patterns 472*a* and 472*b* are provided, the test pad 462*a* is provided on the conductive pattern 472*a*, and the test pad 462*b* is provided on the conductive pattern 472*b*. In addition, the test pad 462*a* is electrically connected to the reference voltage signal transfer wiring 432*a* provided on the first surface 400*a* via the conductive pattern 472*a* and a through-hole 442*a*, and the test pad 462*b* is electrically connected to the reference voltage signal transfer wiring 432*b* provided on the first surface 400*a* via the conductive pattern 472*b* and a through-hole 442*b*. In addition, the test pad 463*a* is provided on the first driving signal transfer wiring 433*a*, is electrically connected to the first driving signal transfer wiring 433*a*, and the test pad 463*b* is provided on the first driving signal transfer wiring 433*b*, and is electrically connected to the first driving signal transfer wiring 433*b*. Similarly, the test pad 464*a* is provided on the second driving signal transfer wiring 434*a*, and is electrically connected to the second driving signal transfer wiring 434*a*, and the test pad 464*b* is provided on the second driving signal transfer wiring 434*b*, and is electrically connected to the second driving signal transfer wiring 434*b*.

In a state where the relay board 340 and the driving module 20 are connected to each other by the wiring board 400, while the first surface 400*a* on which the input terminal group 410 and the output terminal group 420 are provided are unlikely to be visually confirmed, the second surface 400*b* on the side opposite thereto is easily seen. Therefore, in the embodiment, in order to easily perform probing, the test pads 462*a*, 462*b*, 463*a*, 463*b*, 464*a*, and 464*b* are provided on the second surface 400*b* of the wiring board 400.

In addition, after the relay board 340 and the sealing plate 160 of the driving module 20 are connected to each other by the wiring board 400, when the inspection signal is supplied in order to the input terminals 412*a*, 412*b*, 413*a*, 413*b*, 414*a*, and 414*b* from the relay board 340, and the inspection signal is observed in order from the test pads 462*a*, 462*b*, 463*a*, 463*b*, 464*a*, and 464*b*, it is possible to determine that the connection between the input terminals 412*a*, 412*b*, 413*a*, 413*b*, 414*a*, and 414*b* and the relay board 340 is appropriate.

In addition, after the wiring board 400 and the sealing plate 160 of the driving module 20 are connected to each other (for example, before the wiring board 400 and the relay board 340 are connected to each other), the inspection signal is supplied in order to the output terminals 422*a*, 422*b*, 423*a*, 423*b*, 424*a*, and 424*b* from the sealing plate 160, and when the inspection signal is observed in order from the test pads 462*a*, 462*b*, 463*a*, 463*b*, 464*a*, and 464*b*, it is possible to determine that the connection between the output terminals 422*a*, 422*b*, 423*a*, 423*b*, 424*a*, and 424*b* and the relay board 340 is appropriate.

In addition, the test pad for the connection inspection which electrically connects each of the wirings to each other may be provided for the ground voltage signal transfer wiring 435, the control signal transfer wiring 436, and the low power source voltage signal transfer wiring 437. The test pads may be provided on the second surface 400*b* of the wiring board 400. In addition, in a case where it is not possible to ensure the region for disposing the test pad on the second surface 400*b* of the wiring board 400, for example, the board linked to the wiring board 400 is provided, the test pad for the connection inspection is provided on the surface which is the same as the second surface 400*b* of the wiring board 400 of the board, and after the connection inspection is finished, the board may be torn off from the wiring board 400.

8. Manufacturing Method of Head Unit

Figure 27:
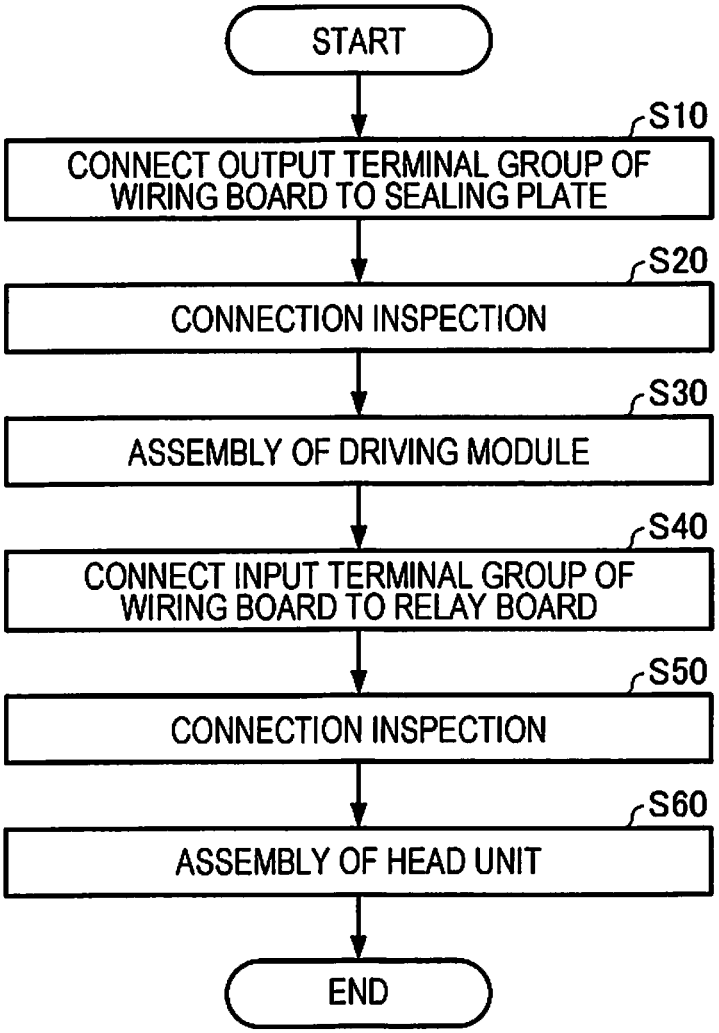
FIG. 27 is a flowchart view illustrating an example of a manufacturing method of the head unit.

FIG. 27 is a flowchart illustrating one example of a manufacturing method of the head unit 32 of the embodiment. In addition, in the flowchart of FIG. 27, an order of the process may appropriately change.

Figure 28:
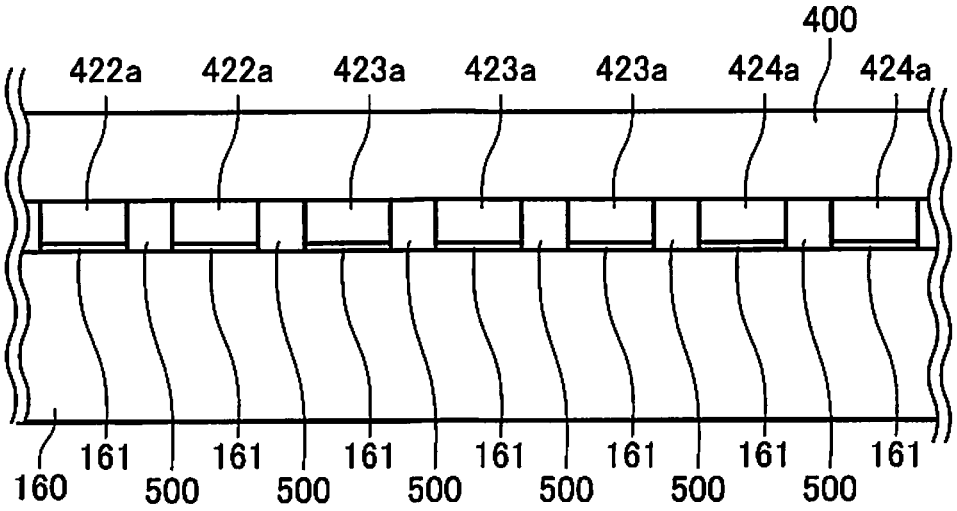
FIG. 28 is a side view when a connection part between the wiring board and the sealing plate is viewed from the short side of the wiring board.

In the embodiment, as illustrated in FIG. 27, first, the output terminal group 420 is connected to each of the sealing plates 160 in the region R2 of the first surface 400*a* of each of the wiring boards 400 (process S10). FIG. 28 is a view illustrating one example of the connection part between the wiring board 400 and the sealing plate 160 which are connected to each other in process S10, and is a side view when the connection part is viewed from the short side P2 of the wiring board 400. As illustrated in FIG. 28, the wiring board 400 and the sealing plate 160 are connected to each other in a state where each of the output terminals provided on the wiring board 400 comes into contact with each of input terminals 161 provided on the sealing plate 160, and an adhesive 500 fills a void between the terminals.

Next, the inspection signal is supplied to each of the output terminals of the output terminal group 420 from each of the sealing plates 160, and the connection inspection is performed by probing each of the test pads (process S20). For the wiring board 400 and the sealing plate 160 which failed in the connection inspection, the process returns to process S10, the connection is corrected, and then, the connection inspection of process S20 may be performed again.

Next, by using the plurality of sealing plates 160 which has passed the connection inspection of process S20 and to which the wiring board 400 is connected, each of the driving modules 20 is assembled (process S30).

Next, in the region R1 of the first surface 400*a* of each of the wiring boards 400, the input terminal group 410 and the relay board 340 are connected to each other (process S40). In the process S40, the gripping section 440 of the wiring board 400 is gripped and the connection position is finely adjusted by using the adjustment tool.

Next, the inspection signal is supplied to each of the input terminals of the input terminal group 410 from the relay board 340, and the connection inspection is performed by probing each of the test pad (process S50). In a case of failing in the connection inspection, the process returns to process S40, the connection is corrected, and then, the connection inspection of process S50 may be performed again.

Finally, by using the relay board 340 which has passed the connection inspection of process S50 and to which the plurality of driving modules 20 are connected via the plurality of wiring boards 400, the head unit 32 is assembled (process S60).

Here, for example, since three output terminals 423*a* illustrated in FIG. 28 are electrically connected to the first driving signal transfer wiring 433*a*, it is also possible to replace the output terminal with an output terminal having one width which is equal to the width of the first driving signal transfer wiring 433*a* I the vicinity of the region R1. However, then, since the space filled with the adhesive 500 is reduced, an adhesive force between the wiring board 400 and the sealing plate 160 deteriorates, and a connection failure is likely to be generated. Therefore, in the embodiment, the wiring board 400 has a structure in which the plurality of output terminals having a small width are arranged at a narrow pitch in the output terminal group 420. Accordingly, the space filled with the adhesive increases, the adhesive force between the wiring board 400 and the sealing plate 160 increases, the connection failure is unlikely to be generated, and reliability of the head unit 32 is improved. However, since the output terminal group 420 is disposed at a narrow pitch on the wiring board 400, when the connection position at which the wiring board 400 and the sealing plate 160 are connected to each other is shifted by several μm to several tens of μm, the connection failure is generated. In other words, the connection between the wiring board 400 and the sealing plate 160 becomes difficult. Meanwhile, as described above, since the plurality of input terminals of the input terminal group 410 is disposed at a wider pitch on the wiring board 400, the connection between the wiring board 400 and the relay board 340 is easier than the connection between the wiring board 400 and the sealing plate 160. Here, in the flowchart of FIG. 27, process S10 for connecting the wiring board 400 and the sealing plate 160 of which the connection is difficult, is performed before process S40 for connecting the wiring board 400 and the relay board 340 to each other. Accordingly, it is advantageous to achieve low costs by reducing or yielding the number of manufacturing processes of the head unit 32.

9. Actions and Effects

As described above, in the liquid discharge apparatus 1 according to the embodiment, in the head unit 32, each of the driving modules 20 includes multiple piezoelectric elements 60 of which the density is high, and thus, the number of piezoelectric elements 60 which are driven at the same time increases. Therefore, in each of the wiring boards 400 connected to each of the driving modules 20, the electric current that flows through each of the reference voltage signal transfer wirings 432*a* and 432*b*, the first driving signal transfer wirings 433*a* and 433*b*, and the second driving signal transfer wirings 434*a* and 434*b*, is likely to increase. Meanwhile, in each of the wiring boards 400, as the reference voltage signal transfer wirings 432*a* and 432*b* are provided on the first surface 400*a*, and as the first driving signal transfer wirings 433*a* and 433*b* and the second driving signal transfer wirings 434*a* and 434*b* are provided on the second surface 400*b*, areas of each of the transfer wirings are sufficiently ensured. Therefore, the wiring impedance of each of the reference voltage signal transfer wirings 432*a* and 432*b*, the first driving signal transfer wirings 433*a* and 433*b*, and the second driving signal transfer wirings 434*a* and 434*b* is reduced, and the heat generation amount caused by the electric currents that flow through each of the transfer wirings is reduced. Therefore, each of the wiring boards 400 can correspond to the small size of the driving module 20. In addition, in each of the wiring boards 400, as the first driving signal transfer wirings 433*a* and 433*b* and the second driving signal transfer wirings 434*a* and 434*b* which are provided on the second surface 400*b* are electrically connected to the output terminals 423*a*, 423*b*, 424*a*, and 424*b* via each of the through-holes 443*a*, 443*b*, 444*a*, and 444*b*, all of the output terminals included in the output terminal group 420 can be disposed on the first surface 400*a*. Therefore, the output terminal group 420 can be relatively easily connected to the sealing plate 160 of the driving module 20 in the region R2. Furthermore, in each of the wiring boards 400, since all of the input terminals included in the input terminal group 410 are also provided on the first surface 400*a*, in a state where the output terminal group 420 is connected to the sealing plate 160 of the driving module 20, the input terminal group 410 can be relatively easily connected to the relay board 340 in the region R1. Therefore, in the liquid discharge apparatus 1 according to the embodiment, it is possible to avoid a case where the manufacturing of the head unit 32 becomes difficult while providing the wiring board 400 connected to the driving module 20 including the multiple piezoelectric elements 60 of which the density is high.

In addition, since the first driving signal transfer wiring 433*a* and the second driving signal transfer wiring 434*a*, and the reference voltage signal transfer wiring 432*a* are provided to oppose each other, and the first driving signal transfer wiring 433*b* and the second driving signal transfer wiring 434*b*, and the reference voltage signal transfer wiring 432*b* are provided to oppose each other, each of the electric current paths is shortened, a magnetic field generated by the electric current that flows through each of the transfer wirings offset each other, and thus, the wiring impedance of each of the electric current paths is reduced.

In addition, since the relative relationship of the position or the distance between the first driving signal transfer wiring 433*a* and the second driving signal transfer wiring 434*a*, and the reference voltage signal transfer wiring 432*a*, or the relative relationship of the position or the distance between the first driving signal transfer wiring 433*b* and the second driving signal transfer wiring 434*b*, and the reference voltage signal transfer wiring 432*b*, are equal to each other, a variation of transfer accuracy of the driving signals COM-A1 to COM-An and COM-B1 to COM-Bn is reduced.

In addition, since the thickness of the first driving signal transfer wirings 433*a* and 433*b* and the second driving signal transfer wirings 434*a* and 434*b* which are provided on the second surface 400*b* of the wiring board 400 is greater than the thickness of the reference voltage signal transfer wirings 432*a* and 432*b*, an impedance value per unit area is smaller than that of the reference voltage signal transfer wirings 432*a* and 432*b*. Therefore, the heat generation amount caused by the electric current that flows through each of the first driving signal transfer wirings 433*a* and 433*b* and the second driving signal transfer wirings 434*a* and 434*b* is more efficiently reduced. Therefore, in the liquid discharge apparatus 1 according to the embodiment, in the head unit 32, since it is possible to reduce the heat generation amount of each of the wiring boards 400, each of the wiring boards 400 is unlikely to be damaged, the heat amount transmitted to each of the driving modules 20 is reduced, and it is possible to discharge the liquid with high accuracy.

In addition, the width of the first driving signal transfer wirings 433*a* and 433*b* is different from the width of the second driving signal transfer wirings 434*a* and 434*b*, and the wiring impedance of each of the first driving signal transfer wirings 433*a* and 433*b* and the second driving signal transfer wirings 434*a* and 434*b* is an appropriate value. Specifically, since the width (the maximum width) of the first driving signal transfer wirings 433*a* and 433*b* is greater than the width (the maximum width) of the second driving signal transfer wirings 434*a* and 434*b*, the wiring impedance of the first driving signal transfer wirings 433*a* and 433*b* through which a larger electric current flows is reduced, and the heat generation amount of each of the wiring boards 400 is reduced.

In addition, in each of the wiring boards 400, since the input terminal group 410 and the output terminal group 420 are provided along a side on which the input terminal group 410 and the output terminal group 420 do not oppose each other, each of the transfer wirings is disposed with high efficiency, and the wiring impedance of each of the transfer wirings is reduced.

In addition, in the liquid discharge apparatus 1 according to the embodiment, in each of the wiring boards 400, since the plurality of input terminals included in the input terminal group 410 are aligned in one row in the direction orthogonal to the direction in which the plurality of output terminals included in the output terminal group 420 are aligned in one row, even after the output terminal group 420 and the sealing plate 160 of the driving module 20 are connected to each other, it is relatively easy to grip the gripping section 440 by using the adjustment tool or the like, and to finely adjust the connection position of the input terminal group 410. In addition, in the liquid discharge apparatus 1 according to the embodiment, since each of the wiring boards 400 has the wiring layers on both surfaces, the size is reduced while ensuring a large wiring region, and as the plurality of output terminals of the output terminal group 420 are arranged at a narrow pitch, the connection with the sealing plate 160 of the driving module 20 of which the size is reduced is possible, and it is possible to realize a small size of the head unit 32. In addition, in each of the wiring boards 400, since the pitch of the input terminal groups 410 is greater than the pitch of the output terminal group 420, appropriate connection between the input terminal group 410 and the relay board 340 is reliably and easily ensured. Therefore, in the liquid discharge apparatus 1 according to the embodiment, since it is possible to reduce the number of manufacturing processes of the head unit 32, and to improve yield, it is possible to reduce the manufacturing costs.

In addition, in the liquid discharge apparatus 1 according to the embodiment, in the head unit 32, the inspection signal is supplied to each of the input terminals of the input terminal group 410 from the relay board 340, and based on whether or not the inspection signal from each of the test pad is observed, it is possible to perform the connection inspection between the input terminal group 410 and the relay board 340. In addition, in a state where the input terminal group 410 is connected to the relay board 340, and the output terminal group 420 is connected to the sealing plate 160 of the driving module 20, even in a state where the first surface 400*a* of the wiring board 400 cannot be visually confirmed, it is possible to probe the test pad provided on the second surface 400*b* that can be visually confirmed, and thus, it is possible to easily perform the connection inspection of the wiring board 400.

Furthermore, in the liquid discharge apparatus 1 according to the embodiment, since all of the through-holes are provided in the region which is not bent in the wiring board 400, it is possible to reduce a concern about generation of a failure, such as a discharge defect of the head unit 32, caused by generation of a conduction failure, such as disconnection or a short circuit of a conductor in each of the through-holes, can be reduced.

Above, in the liquid discharge apparatus 1 according to the embodiment, since transfer accuracy of the driving signals COM-Ai and COM-Bi in each of the wiring boards 400 is improved, and it is possible to reduce the heat generation amount of each of the wiring boards 400, each of the wiring boards 400 is unlikely to be damaged, and it is possible to discharge the liquid from each of the head units 32 with high accuracy.

In addition, in the liquid discharge apparatus 1 according to the embodiment, the first driving signal transfer wiring 433*a* and the second driving signal transfer wiring 434*a*, and the reference voltage signal transfer wiring 432*a* are provided to oppose each other, and the first driving signal transfer wiring 433*b* and the second driving signal transfer wiring 434*b*, and the reference voltage signal transfer wiring 432*b* are provided to oppose each other. Therefore, each of the electric current paths is shortened, and the magnetic field generated by the electric current that flows through each of the transfer wirings offset each other, and thus, the wiring impedance of each of the electric current paths is reduced.

In addition, since the relative relationship of the position or the distance between the first driving signal transfer wiring 433*a* and the second driving signal transfer wiring 434*a*, or the relative relationship of the position or the distance between the first driving signal transfer wiring 433*b* and the second driving signal transfer wiring 434*b*, and the reference voltage signal transfer wiring 432*b*, are equal to each other, a variation of transfer accuracy of the driving signals COM-A1 to COM-An and COM-B1 to COM-Bn is reduced. Therefore, in the liquid discharge apparatus 1 according to the embodiment, transfer accuracy of the driving signals COM-Ai and COM-Bi in each of the wiring boards 400 is improved, and it is possible to discharge the liquid from each of the head units 32 with high accuracy.

In addition, in the liquid discharge apparatus 1 according to the embodiment, on the second surface 400*b* of each of the wiring boards 400, the first driving signal transfer wirings 433*a* and 433*b* are provided in the region separated from the ground voltage signal transfer wiring 435 and the low power source voltage signal transfer wiring 437. Therefore, since influence of large noise radiated from the first driving signal transfer wirings 433*a* and 433*b* through which the driving signals COM-Ai having the largest amplitude is transferred on the ground voltage signal GND or the low power source voltage signal LVDD is reduced, and it is possible to discharge the liquid from each of the head units 32 with high accuracy.

In addition, in the liquid discharge apparatus 1 according to the embodiment, in each of the wiring boards 400, since the control signal transfer wiring 436 does not oppose the first driving signal transfer wirings 433*a* and 433*b* and the second driving signal transfer wirings 434*a* and 434*b*, influence of noise radiated from the first driving signal transfer wirings 433*a* and 433*b* and the second driving signal transfer wirings 434*a* and 434*b* on various control signals is reduced.

Furthermore, in the liquid discharge apparatus 1 according to the embodiment, on the first surface 400*a* of each of the wiring boards 400, since the ground voltage signal transfer wiring 435 or the low power source voltage signal transfer wiring 437 is provided between the reference voltage signal transfer wirings 432*a* and 432*b* through which a large electric current flows and the control signal transfer wiring 436, various control signals transferred by the control signal transfer wiring 436 are guarded by the ground voltage signal transfer wiring 435 or the low power source voltage signal transfer wiring 437. Accordingly, in each of the wiring boards 400, influence of large noise radiated from the reference voltage signal transfer wirings 432*a* and 432*b* on various control signals is reduced. Furthermore, in each of the wiring boards 400, the reference voltage signal transfer wirings 432*a* and 432*b*, and the first driving signal transfer wirings 433*a* and 433*b* and the second driving signal transfer wirings 434*a* and 434*b*, are provided on end side, the control signal transfer wiring 436, and the ground voltage signal transfer wiring 435 and the low power source voltage signal transfer wiring 437 are provided to oppose the each other, and thus, various control signals are guarded by the ground voltage signal transfer wiring 435 and the low power source voltage signal transfer wiring 437. Therefore, in the liquid discharge apparatus 1 according to the embodiment, since a concern about deterioration of transfer accuracy of the control signal in each of the wiring boards 400 is reduced, it is possible to discharge the liquid from each of the head units 32 with high accuracy.

In addition, in the liquid discharge apparatus 1 according to the embodiment, since each of the wiring boards 400 has the wiring layers on both surfaces, the size is reduced while ensuring a large wiring region, and thus, it is possible to correspond to the small size of the driving module 20, and to realize the small size of the head unit 32.

In addition, in the liquid discharge apparatus 1 according to the embodiment, in each of the wiring boards 400, since the plurality of input terminals included in the input terminal group 410 are aligned in one row in the direction orthogonal to the direction in which the plurality of output terminals included in the output terminal group 420 are aligned in one row, even after the output terminal group 420 and the sealing plate 160 of the driving module 20 are connected to each other, it is relatively easy to finely adjust the connection position of the input terminal group 410. Therefore, in the liquid discharge apparatus 1 according to the embodiment, since it is possible to reduce the number of manufacturing processes of the head unit 32, and to improve yield, it is possible to reduce the manufacturing costs.

10. Modification Example

Figure 20:
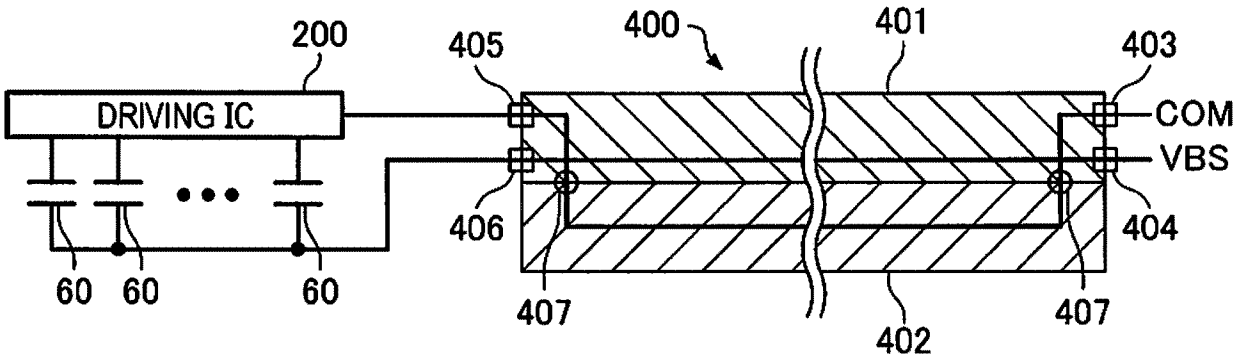
FIG. 20 is a view schematically illustrating a configuration of the wiring board in the embodiment.

In the above-described embodiment, the input terminals 412*a* and 412*b* into which the reference voltage signal VBS is input, and the input terminals 413*a* and 413*b* into which the driving signal COM-Ai is input and the input terminals 414*a* and 414*b* into which the driving signal COM-Bi is input are provided on the first surface 400*a* of the wiring board 400. Similarly, the output terminals 422*a* and 422*b* from which the reference voltage signal VBS is output, and the output terminals 423*a* and 423*b* from which the driving signal COM-Ai is output and the output terminals 424*a* and 424*b* from which the driving signal COM-Bi is output, are provided on the first surface 400*a* of the wiring board 400. In addition, the reference voltage signal transfer wirings 432*a* and 432*b* through which the reference voltage signal VBS is transferred is provided on the first surface 400*a*, and the first driving signal transfer wirings 433*a* and 433*b* through which the driving signal COM-Ai is transferred and the second driving signal transfer wirings 434*a* and 434*b*, are provided on the first surface 400*a* and on the second surface 400*b*. In addition, the first driving signal transfer wirings 433*a* and 433*b* provided on the second surface 400*b* are respectively connected to the first driving signal transfer wirings 433*a* and 433*b* provided on the first surface 400*a* via the through-holes 443*a* and 443*b*, and the second driving signal transfer wirings 434*a* and 434*b* provided on the second surface 400*b* are respectively connected to the second driving signal transfer wirings 434*a* and 434*b* provided on the first surface 400*a* via the through-holes 444*a* and 444*b*. FIG. 20 is a view schematically illustrating a configuration of the wiring board 400. In FIG. 20, a driving signal COM is the driving signal COM-Ai and the driving signal COM-Bi. In addition, a first wiring layer 401 corresponds to the first surface 400*a*, and a second wiring layer 402 corresponds to the second surface 400*b*. In addition, an input terminal 403 corresponds to the input terminals 413*a*, 413*b*, 414*a*, and 414*b*, and an input terminal 404 corresponds to the input terminals 412*a* and 412*b*. In addition, an output terminal 405 corresponds to the output terminals 423*a*, 423*b*, 424*a*, and 424*b*, and an output terminal 406 corresponds to the output terminals 422*a* and 422*b*. In addition, a through-hole 407 corresponds to the through-holes 443*a*, 443*b*, 444*a*, and 444*b*. In addition, in FIG. 20, the driving IC 200 to which the driving signal COM is applied and the piezoelectric element 60 to which the reference voltage signal VBS is applied, are also illustrated. As illustrated in FIG. 20, in the wiring board 400 in the above-described embodiment, the driving signal COM is input from the input terminal 403, is transmitted in an order of the first wiring layer 401, the through-hole 407, the second wiring layer 402, the through-hole 407, and the first wiring layer 401, and is output from the output terminal 405. In addition, the reference voltage signal VBS is input from the input terminal 404, is transmitted to the first wiring layer 401, and is output from the output terminal 406.

Meanwhile, FIGS. 21 to 25 are views schematically illustrating configurations of modification examples of the wiring board 400. In FIGS. 21 to 25, configuration elements similar to those of FIG. 20 will be given the same reference numbers.

Figure 21:
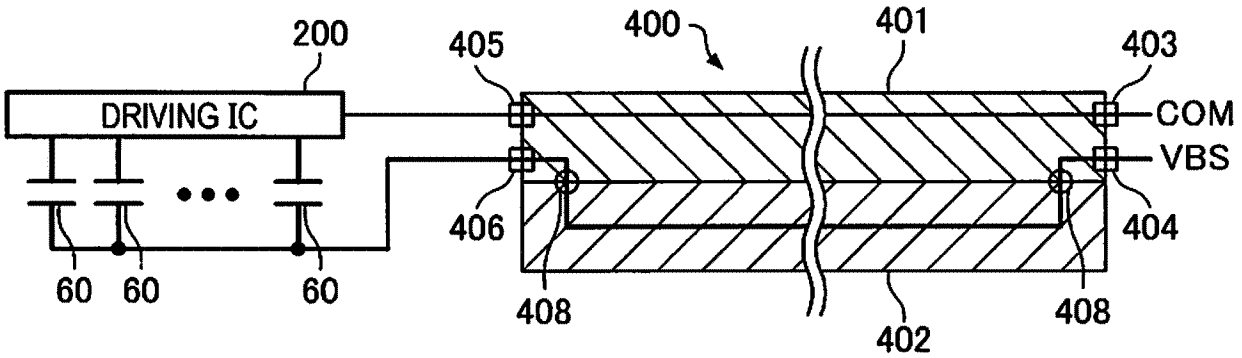
FIG. 21 is a view schematically illustrating a configuration of a modification example of the wiring board.

In the wiring board 400 of the modification example illustrated in FIG. 21, the input terminals 403 and 404 and the output terminals 405 and 406 are provided on the first wiring layer 401. In addition, the driving signal COM is input from the input terminal 403, is transmitted to the first wiring layer 401, and is output from the output terminal 405. In addition, the reference voltage signal VBS is input from the input terminal 404, is transmitted in an order of the first wiring layer 401, a through-hole 408, the second wiring layer 402, the through-hole 408, and the first wiring layer 401, and is output from the output terminal 406. In the wiring board 400 illustrated in FIG. 20, the driving signal COM is mainly transmitted through the wiring provided on the second wiring layer 402, and the reference voltage signal VBS is mainly transmitted through the wiring provided on the first wiring layer 401. Meanwhile, in the wiring board 400 of the modification example illustrated in FIG. 21, the driving signal COM is mainly transmitted through the wiring (another one example of "first wiring") provided on the first wiring layer 401, and the reference voltage signal VBS is mainly transmitted through the wiring (another one example of "second wiring") provided on the second wiring layer 402.

Figure 22:
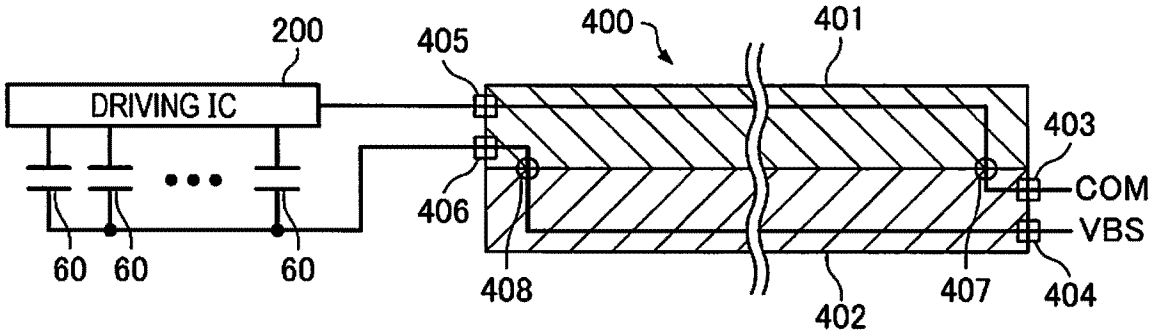
FIG. 22 is a view schematically illustrating a configuration of a modification example of the wiring board.
Figure 23:
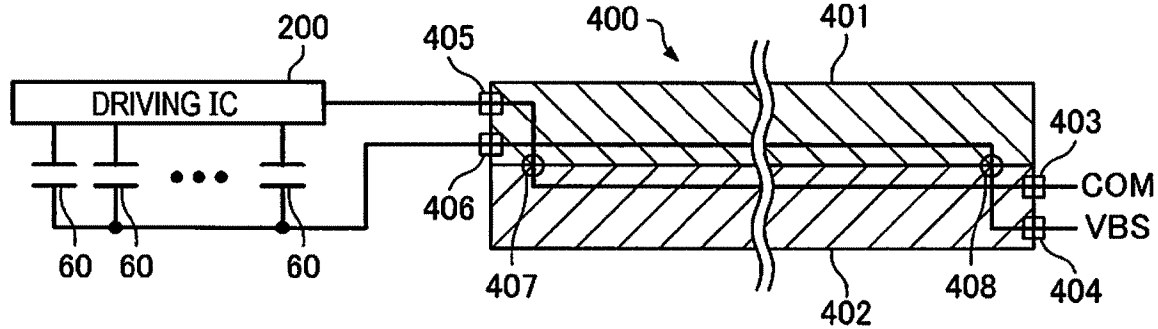
FIG. 23 is a view schematically illustrating a configuration of a modification example of the wiring board.

In addition, in the wiring board 400 of the modification example illustrated in FIGS. 22 and 23, both of the input terminals 403 and 404 are provided on the second wiring layer 402, and both of the output terminals 405 and 406 are provided on the first wiring layer 401. In addition, the driving signal COM is input from the input terminal 403, is transmitted in an order of the second wiring layer 402, the through-hole 407, and the first wiring layer 401, and is output from the output terminal 405. In addition, the reference voltage signal VBS is input from the input terminal 404, is transmitted in an order of the second wiring layer 402, the through-hole 408, the first wiring layer 401, and is output from the output terminal 406. In the wiring board 400 of the modification example illustrated in FIG. 22, while the driving signal COM is mainly transmitted through the wiring provided on the first wiring layer 401, and the reference voltage signal VBS is mainly transmitted through the wiring provided on the second wiring layer 402, in the wiring board 400 of the modification example illustrated in FIG. 23, the driving signal COM is mainly transmitted through the wiring provided on the second wiring layer 402, and the reference voltage signal VBS is mainly transmitted through the wiring provided on the first wiring layer 401.

Figure 24:
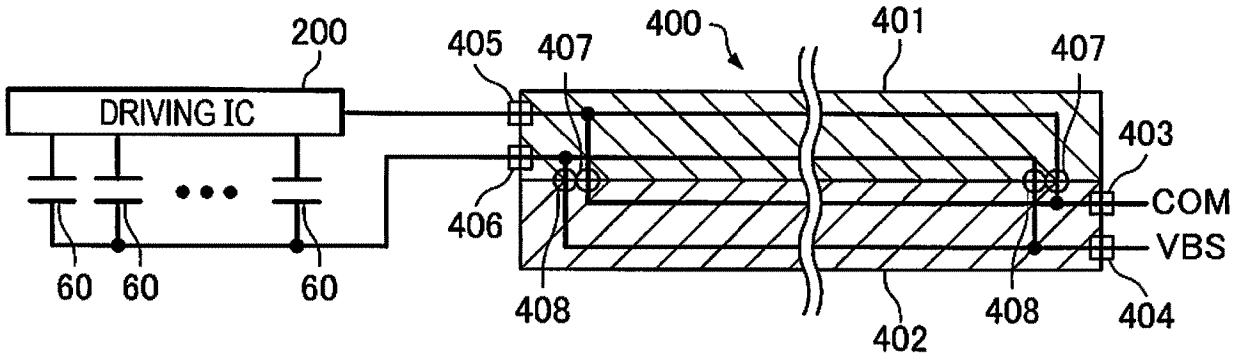
FIG. 24 is a view schematically illustrating a configuration of a modification example of the wiring board.
Figure 25:
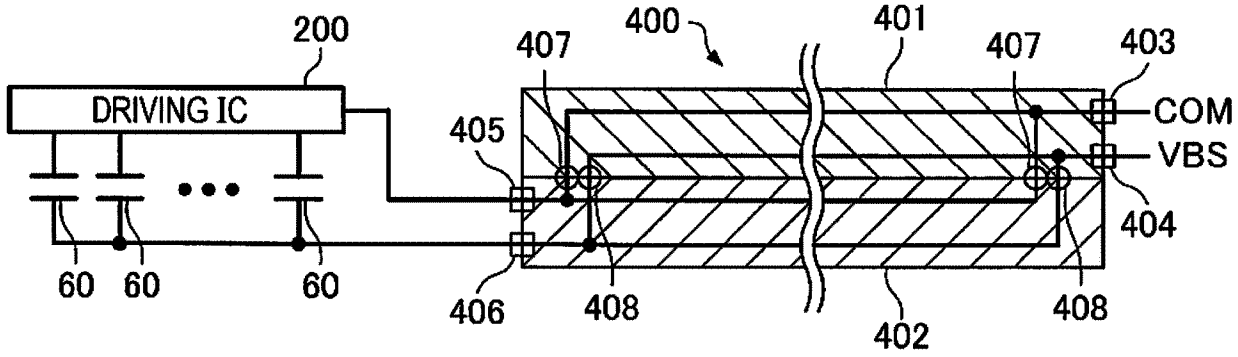
FIG. 25 is a view schematically illustrating a configuration of a modification example of the wiring board.

In addition, in the wiring board 400 of the modification example illustrated in FIG. 24, the input terminals 403 and 404 are provided on the second wiring layer 402, and the output terminals 405 and 406 are provided on the first wiring layer 401. In addition, the driving signal COM is input from the input terminal 403, and is branched on the second wiring layer 402, one branch of the driving signal COM is transmitted on the first wiring layer 401 via the through-hole 407, and reaches the output terminal 405, and the other branch of the driving signal COM is transmitted on the second wiring layer 402, and reaches the output terminal 405 via the through-hole 407. Similarly, the reference voltage signal VBS is input from the input terminal 404, and is branched on the second wiring layer 402, one branch of the reference voltage signal VBS is transmitted on the first wiring layer 401 via the through-hole 408, and reaches the output terminal 406, and the other branch of the reference voltage signal VBS is transmitted on the second wiring layer 402, and reaches the output terminal 406 via the through-hole 408. In the wiring board 400 of the modification example illustrated in FIG. 25, the input terminals 403 and 404 are provided on the first wiring layer 401, and the output terminals 405 and 406 are provided on the second wiring layer 402. In addition, the driving signal COM is input from the input terminal 403, and is branched on the first wiring layer 401, one branch of the driving signal COM is transmitted on the second wiring layer 402 via the through-hole 407, and reaches the output terminal 405, and the other branch of the driving signal COM is transmitted on the first wiring layer 401, and reaches the output terminal 405 via the through-hole 407. Similarly, the reference voltage signal VBS is input from the input terminal 404, and is branched on the first wiring layer 401, one branch of the reference voltage signal VBS is transmitted on the second wiring layer 402 via the through-hole 408, and reaches the output terminal 406, and the other branch of the reference voltage signal VBS is transmitted on the first wiring layer 401, and reaches the output terminal 406 via the through-hole 408. In other words, in the wiring board 400 of the modification example illustrated in FIGS. 24 and 25, both of the driving signal COM and the reference voltage signal VBS are respectively divided and transmitted on the first wiring layer 401 and the second wiring layer 402, and are output from the output terminals 405 and 406.

In addition, even in the wiring board 400 of the modification example illustrated in FIGS. 21 to 25, it is desirable that the transfer wiring of the reference voltage signal VBS and the transfer wiring of the driving signal COM which are provided on the wiring layers different from each other, oppose each other.

In addition, in the above-described embodiment, a case where the wiring board 400 is a single layer board and the wiring layer has two layers (the first surface 400*a* and the second surface 400*b*), is described, but the wiring board 400 may be a multiple layer board on which the plurality of boards are stacked and the wiring layer has three or more layers. In a case where the wiring board 400 has three or more wiring layers, the first surface 400*a* and the second surface 400*b* may respectively be wiring layers on the surface of the wiring board 400, and may be inner wiring layers. In addition, even in a case where the wiring board 400 has three or more wiring layers, it is desirable that the reference voltage signal transfer wiring 432*a* opposes both of the first driving signal transfer wiring 433*a* and the second driving signal transfer wiring 434*a*. For example, as the reference voltage signal transfer wiring 432*a*, and the first driving signal transfer wiring 433*a* and the second driving signal transfer wiring 434*a* are provided on the wiring layers different from each other, and the reference voltage signal transfer wiring 432*a* is interposed between the first driving signal transfer wiring 433*a* and the second driving signal transfer wiring 434*a*, the reference voltage signal transfer wiring 432*a* may oppose both of the first driving signal transfer wiring 433*a* and the second driving signal transfer wiring 434*a*. Disposition of the reference voltage signal transfer wiring 432*b*, and the first driving signal transfer wiring 433*b* and the second driving signal transfer wiring 434*b* is also similar. In addition, in a case where the wiring board 400 has three or more wiring layers, it is desirable that at least one wiring layer which is thicker than the wiring layer on which the output terminal group 420 is provided exists, and the first driving signal transfer wirings 433*a* and

433*b* and the second driving signal transfer wirings 434*a* and 434*b* are provided on the wiring layer which is thicker than the wiring layer provided in the output terminal group 420.

In addition, in the above-described embodiment, on the wiring board 400, a pair of the first driving signal transfer wiring 433*a* through which the driving signal COM-Ai is transferred and the second driving signal transfer wiring 434*a* through which the driving signal COM-Bi is transferred is provided on the long side Q1, and a pair of the first driving signal transfer wiring 433*b* through which the driving signal COM-Ai is transferred and the second driving signal transfer wiring 434*b* through which the driving signal COM-Bi is transferred is provided on the long side Q2. In other words, on the wiring board 400, two pairs of the first driving signal transfer wiring and the second driving signal transfer wiring are provided, but not being limited thereto, only one pair of these may be provided, or three or more pairs may be provided.

In addition, in the above-described embodiment, based on the various control signals, the driving IC 200 outputs the driving signal Vout to each of the piezoelectric elements 60 by combining the trapezoidal waveforms (driving waveforms) Adp1 and Adp2 of the driving signal COM-Ai and the trapezoidal waveforms (driving waveforms) Bdp1 and Bdp2 of the driving signal COM-Bi, but the invention is not limited thereto. For example, four driving circuits respectively generate a first driving signal having a driving waveform which corresponds to "large dot", a second driving signal having a driving waveform which corresponds to "medium dot", a third driving signal having a driving waveform which corresponds to "small dot", and a fourth driving signal having a driving waveform which corresponds to "not recorded". The driving IC 200 may output the driving signal Vout to each of the piezoelectric elements 60 by selecting any one of the first driving signal, the second driving signal, the third driving signal, and the fourth driving signal, based on various control signals.

Figure 26:
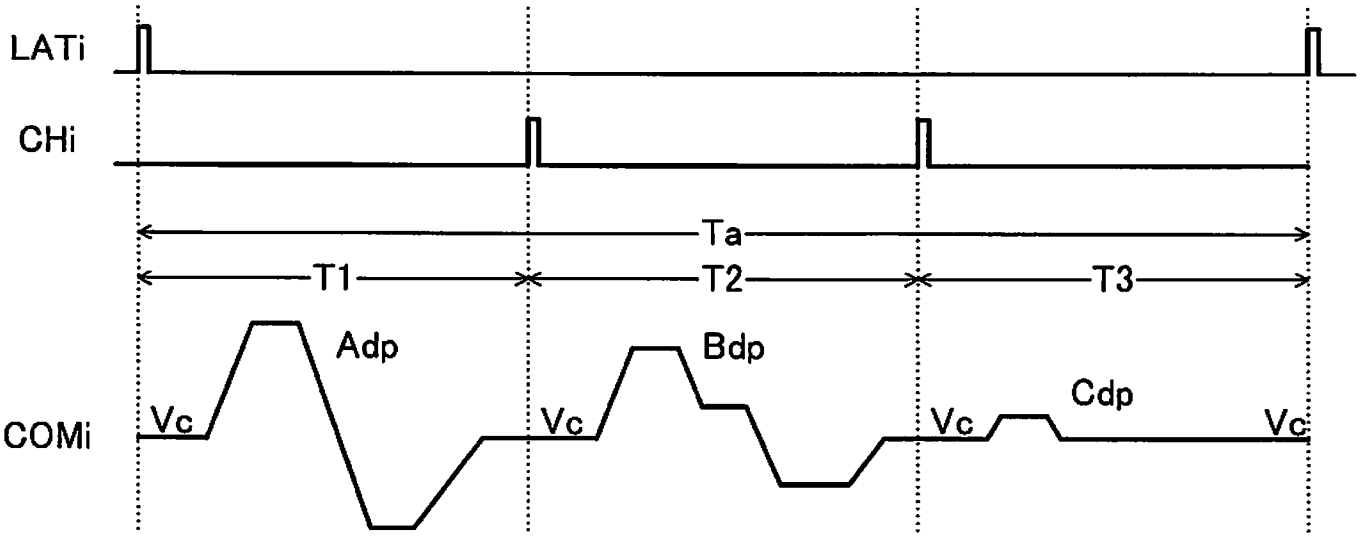
FIG. 26 is a view illustrating a modification example of a driving signal.

In addition, for example, the driving circuit may generate a driving signal COMi having a plurality of driving waveforms Adp, Bdp, and Cdp as illustrated in FIG. 26, and the driving IC 200 may output the driving signal Vout to each of the piezoelectric elements 60 by selecting one or a plurality of driving waveforms from the plurality of driving waveforms Adp, Bdp, and Cdp, based on various control signals (the latch signal LATi or the change signal CHi). Driving signals COMAi illustrated in FIG. 26 respectively have the driving waveforms Adp, Bdp, and Cdp, in the periods T1, T2, and T3 in the cycle Ta. In addition, for example, the driving signal Vout which corresponds to "large dot" has the driving waveform Adp and the driving waveform Bdp of the driving signal COMi, the driving signal Vout which corresponds to "medium dot" only has the driving waveform Adp, the driving signal Vout which corresponds to "small dot" only has the driving waveform Bdp, and the driving signal Vout which corresponds to "not recorded" only has the driving waveform Cdp. In this case, for example, on the wiring board 400 illustrated in FIGS. 14 and 15, the first driving signal transfer wiring 433*a* and the second driving signal transfer wiring 434*a* are replaced to one wiring through which the driving signal COMi is transferred, and the first driving signal transfer wiring 433*b* and the second driving signal transfer wiring 434*b* are replaced to one wiring through which the driving signal COMi is transferred.

In addition, in the above-described embodiment, the control unit 10 and each of the head units 32 are connected to each other by the two flexible flat cables 190 and 191, but may be connected to each other by one flexible flat cable, or may be connected to each other by three or more flexible flat cable. Otherwise, various signals may be wirelessly transferred to each of the head units 32 from the control unit 10.

In addition, in the above-described embodiment, an example in which the piezo-type liquid discharge apparatus in which the driving circuit drives the piezoelectric element (capacitive load) that serves as the driving element is described, but the invention can also be employed in a liquid discharge apparatus in which the driving circuit drives a driving element other than the capacitive load. An example of the liquid discharge apparatus includes a thermal type (bubble type) liquid discharge apparatus in which a driving circuit drives a heat generation element (for example, resistance) that serves as a driving element, and which discharges liquid by using bubbles generated as the heat generation element is headed.

Above, the embodiment and the modification examples are described, but the invention is not limited to the embodiment and the modification examples, and can be realized in various aspects within a range that does not depart from the spirit. For example, it is also possible to appropriately combine the above-described embodiment and each of the modification examples with each other.

The invention practically has a configuration which is the same as the configuration described in the embodiment (for example, a configuration which has the same functions, method, and results, or a configuration which has the same purpose and effects). In addition, the invention has a configuration in which a part which is not essential in the configuration described in the embodiment is replaced. In addition, the invention has a configuration which achieves an action effect or a configuration which can achieve the same purpose which are the same as those of the configuration described in the embodiment. In addition, the invention has a configuration obtained by adding a known technology to the configuration described in the embodiment.

The entire disclosure of Japanese Patent Application No. 2016-248691, filed Dec. 22, 2016, No. 2017-191774, filed Sep. 29, 2017, Application No. 2017-191775, filed Sep. 29, 2017, Application No. 2017-191776, filed Sep. 29, 2017 are expressly incorporated by reference herein.

What is claimed is:

1. A head unit comprising:

a first board;

a driving module including 600 or more driving elements which are aligned at a density of 300 or more driving elements per one inch, and a second board; and a flexible wiring board which connects the first board and the second board to each other, wherein the flexible wiring board includes a first wiring layer, a second wiring layer which opposes the first wiring layer, a first output terminal which is electrically connected to a first end of the driving element, a second output terminal which is electrically connected to a second end of the driving element, a first wiring which is electrically connected to the first output terminal, a second wiring which is electrically connected to the second output terminal, and a through-hole which electrically connects the first wiring layer and the second wiring layer to each other, wherein the second wiring is provided on the second wiring layer, and wherein the second wiring and the second output terminal are electrically connected to each other via the through-hole.

2. The head unit according to claim 1, wherein the flexible wiring board further includes a first input terminal which is electrically connected to the first wiring, and a second input terminal which is electrically connected to the second wiring, wherein the first output terminal and the second output terminal are provided along a first side of the flexible wiring board, and wherein the first input terminal and the second input terminal are provided along a second side different from the first side of the flexible wiring board.

3. The head unit according to claim 1, wherein the flexible wiring board further includes a control signal input terminal into which a control signal that controls discharge of liquid is input, a control signal transfer wiring which is electrically connected to the control signal input terminal and transfers the control signal, and a control signal output terminal which is electrically connected to the control signal transfer wiring, and outputs the control signal to the driving module, and wherein the control signal transfer wiring is provided in a region that does not oppose a region in which the second wiring is provided, on the first wiring layer of the flexible wiring board.

4. The head unit according to claim 3, wherein the flexible wiring board further includes a power source voltage signal input terminal into which a power source voltage signal is input, a power source voltage signal transfer wiring which is electrically connected to the power source voltage signal input terminal and transfers the power source voltage signal, and a power source voltage signal output terminal which is electrically connected to the power source voltage signal transfer wiring, and outputs the power source voltage signal to the driving module, wherein the power source voltage signal transfer wiring is provided on the second wiring layer of the flexible wiring board, and wherein the control signal transfer wiring is provided in a region which opposes a region in which the power source voltage signal transfer wiring is provided.

5. The head unit according to claim 1, wherein the first wiring is provided on the first wiring layer, and wherein the first wiring opposes the second wiring.

6. The head unit according to claim 1, wherein the flexible wiring board has a plurality of second wirings, each of which is the second wiring, wherein the first wiring is a reference voltage signal transfer wiring which transfers a reference voltage signal, and wherein the plurality of the second wirings include a first driving signal transfer wiring that transfers a first driving signal, and a second driving signal transfer wiring that transfers a second driving signal.

7. The head unit according to claim 6, wherein an amplitude of the first driving signal is greater than that of the second driving signal, and wherein, on the second wiring layer, the first driving signal transfer wiring is provided closer to an end side of the flexible wiring board than the second driving signal transfer wiring.

8. The head unit according to claim 6, wherein the width of the first driving signal transfer wiring is different from the width of the second driving signal transfer wiring.

9. The head unit according to claim 6, wherein an amplitude of the first driving signal is greater than that of the second driving signal, and wherein the width of the first driving signal transfer wiring is greater than the width of the second driving signal transfer wiring.

10. The head unit according to claim 6, wherein both of the first driving signal transfer wiring and the second driving signal transfer wiring are provided on the second wiring layer, and wherein the reference voltage signal transfer wiring is provided on the first wiring layer, and opposes both of the first driving signal transfer wiring and the second driving signal transfer wiring.

11. The head unit according to claim 1, wherein the flexible wiring board further includes a power source voltage signal transfer wiring that transfers a power source voltage signal or a ground voltage signal transfer wiring that transfers a ground voltage signal, and wherein, on the second wiring layer, the second wiring is provided closer to an end side of the flexible wiring board than the power source voltage signal transfer wiring or the ground voltage signal transfer wiring.

12. The head unit according to claim 1, wherein the first wiring is provided on the first wiring layer, and wherein the second wiring is thicker than the first wiring.

13. A liquid discharge apparatus comprising:

a first board;

a driving module including 600 or more driving elements which are aligned at a density of 300 or more driving elements per one inch, and a second board; and a flexible wiring board which connects the first board and the second board to each other, wherein the flexible wiring board includes a first wiring layer, a second wiring layer which opposes the first wiring layer, a first output terminal which is electrically connected to a first end of the driving element, a second output terminal which is electrically connected to a second end of the driving element, a first wiring which is electrically connected to the first output terminal, a second wiring which is electrically connected to the second output terminal, and a through-hole which electrically connects the first wiring layer and the second wiring layer to each other, wherein the second wiring is provided on the second wiring layer, and wherein the second wiring and the second output terminal are electrically connected to each other via the through-hole.

* * * * *